US008029383B2

(12) United States Patent
Yamamoto

(10) Patent No.: US 8,029,383 B2
(45) Date of Patent: Oct. 4, 2011

(54) GOLF CLUB

(75) Inventor: Akio Yamamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 37 days.

(21) Appl. No.: 12/230,664

(22) Filed: Sep. 3, 2008

(65) Prior Publication Data

US 2009/0156323 A1 Jun. 18, 2009

(30) Foreign Application Priority Data

Dec. 13, 2007 (JP) ..... 2007-321951
Dec. 28, 2007 (JP) ..... 2007-338722
Jan. 11, 2008 (JP) ..... 2008-004163

(51) Int. Cl.
*A63B 53/02* (2006.01)

(52) U.S. Cl. ..... 473/307; 473/309

(58) Field of Classification Search ..... 473/294, 473/296–299, 288, 307, 309, 315
See application file for complete search history.

(56) References Cited

U.S. PATENT DOCUMENTS 1,895,417 A * 1/1933 Lard ..... 473/310
4,014,568 A * 3/1977 Carter et al. ..... 285/39
5,951,411 A * 9/1999 Wood et al. ..... 473/307
6,620,054 B2 * 9/2003 Tseng ..... 473/306
7,083,529 B2 * 8/2006 Cackett et al. ..... 473/309
7,335,113 B2 * 2/2008 Hocknell et al. ..... 473/307
7,427,239 B2 * 9/2008 Hocknell et al. ..... 473/307
7,465,239 B2 * 12/2008 Hocknell et al. ..... 473/307
7,819,754 B2 * 10/2010 Evans et al. ..... 473/307
2002/0037773 A1 * 3/2002 Wood et al. ..... 473/246
2006/0293115 A1 12/2006 Hocknell et al.
2007/0078026 A1 * 4/2007 Holt et al. ..... 473/305
2008/0051211 A1 * 2/2008 Hocknell et al. ..... 473/307
2008/0280694 A1 * 11/2008 Hocknell et al. ..... 473/288
2008/0280695 A1 * 11/2008 Hocknell et al. ..... 473/288

* cited by examiner

*Primary Examiner* — Stephen L. Blau
(74) *Attorney, Agent, or Firm* — Birch, Stewart, Kolasch & Birch, LLP

(57) ABSTRACT

A hosel portion (22) has a screw portion (32) formed on an internal surface or external surface thereof and a hosel hole (28). A screw member (10) has a through hole (30) for causing a shaft (6) and an inner member (8) to penetrate therethrough, a screw portion (32) and a downward surface (56). The screw portion (32) of the screw member (10) and a screw portion (26) of the hosel portion (22) are coupled to each other. The inner member (8) has a shaft inserting hole (40) opened on an upper end side thereof, a lower surface (42) which can be engaged with a receiving surface (60), and an upward surface (44). At least a part of the inner member (8) is inserted into the hosel hole (28). The shaft (6) and the shaft inserting hole (40) are fixed to each other through bonding and/or fitting. The shaft (6) and a head (4) are fixed to each other through an engagement of the downward surface (56) and the upward surface (44) and an engagement of the receiving surface (60) and the lower surface (42). In another embodiment, a shaft (6*c*) and a head (4*c*) are fixed to each other through an engagement of a downward surface (35*c*) and an upward surface (44*c*) and an engagement of a receiving surface (60*c*) and an engaging side surface (42*c*).

8 Claims, 35 Drawing Sheets

GOLF CLUB

This application claims priority on Patent Application No. 2007-321951 filed in JAPAN on Dec. 13, 2007, Patent Application No. 2008-004163 filed in JAPAN on Jan. 11, 2008, and Patent Application No. 2007-338722 filed in JAPAN on Dec. 28, 2007, the entire contents of which are hereby incorporated by reference.

BACKGROUND OF THE INVENTION

1. Field of the Invention

The present invention relates to a golf club.

2. Description of the Related Art

In an aspect of a development and sale of a golf club, a performance of a head or a shaft is evaluated. As an evaluating method, hitting is carried out through a tester, a swing robot or the like.

In the case in which the performances of the shafts are to be compared with each other, it is preferable to use the same type of heads to be attached to the shafts. By using the same type of heads, an influence of a difference in the head is lessened so that the performances of the shafts can be accurately compared with each other. For example, in the case in which a comparison test is carried out for three types of shafts, the same type of heads are attached to the three types of shafts respectively to execute the comparison test.

Even if the same type of heads are used, however, a variation in the performance is strictly present in the heads inevitably. In order to compare the performances of the shafts more accurately, it is preferable to sequentially attach the same head to each shaft newly, thereby carrying out the test.

The comparison test for the performance of the head is also the same as the foregoing. Even if the same type of shaft is attached to each head, a variation in the performance is strictly present in the shafts inevitably. In order to compare the performances of the heads with each other more accurately, it is preferable to sequentially attach the same shaft to each head newly, thereby carrying out the test.

In the case in which the performances of the head and the shaft are evaluated, accordingly, it is preferable that the head and the shaft should be attached and removed easily.

The easiness of the attachment and removal of the head and the shaft can be useful in various aspects. If the attachment and removal can easily be carried out, a golf player can easily attach the head and the shaft newly by himself (herself). For example, a golf player which cannot satisfy a performance of a purchased golf club can easily attach a head and a shaft newly by himself (herself). Moreover, the golf player himself (herself) can easily assemble an original golf club which is obtained by combining a favorite head with a favorite shaft. The golf player can purchase the favorite head and the favorite shaft and can assemble them by himself (herself). Furthermore, a shop for selling a golf club can select a combination of a head and a shaft which correspond to an aptitude for the golf player and can sell the golf club. A head and a shaft which can easily be attached and removed can cause the golf club to be readily custom-made.

Usually, the head and the shaft are bonded to each other with an adhesive. In order to separate the head and the shaft bonded to each other, it is necessary to pull the shaft from a shaft hole by a strong external force while heating a bonded portion at a high temperature to thermally decompose the adhesive. A labor, equipment and a time are required for the work. Moreover, there is also a possibility that the shaft or the head might be damaged in the heating or pull-out. Usually, the attachment and removal of the head and the shaft cannot be thus carried out easily.

On the other hand, US Patent Application No. US2006/0293115 A1 has disclosed a structure in which an attachment and removal of a head and a shaft can easily be carried out.

SUMMARY OF THE INVENTION

With the structure described in the document, a screw is inserted through a bottom face of a sole and a head and a shaft are fixedly attached to each other with the screw. A special structure having a hole penetrating through a sole surface is required for the head. The structure described in the document can be restrictively applied to the head having the special structure and has a low universality. Moreover, the structure described in the document is complicated.

It is an object of the present invention to provide a golf club in which a shaft and a head can easily be attached and removed with a simple structure.

A golf club according to the present invention includes a shaft, a head, an inner member and a screw member. The head has a hosel portion and a receiving surface. The hosel portion has a screw portion formed on an internal surface or external surface thereof and a hosel hole. The screw member has a through hole for causing the shaft and the inner member to penetrate therethrough, a screw portion and a downward surface. A screw portion of the screw member and a screw portion of the hosel portion are coupled to each other. The inner member has a shaft inserting hole opened on an upper end side thereof, an engaging surface which can be engaged with the receiving surface, and an upward surface. At least a part of the inner member is inserted into the hosel hole. The shaft and the shaft inserting hole are fixed to each other through bonding and/or fitting. The downward surface of the screw member and the upward surface of the inner member are engaged with each other directly or indirectly, and the inner member is controlled to be moved upward with respect to the hosel hole through the engagement. The receiving surface of the head and the engaging surface of the inner member are engaged with each other directly or indirectly, and the inner member is controlled to be rotated with respect to the hosel hole through the engagement.

In a preferable golf club according to the present invention, the engaging surface is set to be a lower surface of the inner member. More specifically, the golf club includes a shaft, a head, an inner member and a screw member. The head has a hosel portion and a receiving surface. The hosel portion has a screw portion formed on an internal surface or external surface thereof and a hosel hole. The screw member has a through hole for causing the shaft and the inner member to penetrate therethrough, a screw portion and a downward surface. A screw portion of the screw member and a screw portion of the hosel portion are coupled to each other. The inner member has a shaft inserting hole opened on an upper end side thereof, a lower surface which can be engaged with the receiving surface, and an upward surface. At least a part of the inner member is inserted into the hosel hole. The shaft and the shaft inserting hole are fixed to each other through bonding and/or fitting. The downward surface of the screw member and the upward surface of the inner member are engaged with each other directly or indirectly, and the inner member is controlled to be moved upward with respect to the hosel hole through the engagement. The receiving surface of the head and the lower surface of the inner member are engaged with each other directly or indirectly, and the inner member is controlled to be rotated with respect to the hosel hole through the engagement.

It is preferable that the screw portion of the hosel portion should be a female screw disposed on an internal surface thereof, and the screw portion of the screw member should be a male screw disposed on an external surface thereof.

It is preferable that the lower surface of the inner member should have at least one projection or recess. It is preferable that the receiving surface should have at least one recess or projection corresponding to the projection or recess of the lower surface. It is preferable that the projection present on the lower surface of the inner member or the receiving surface should take a sectional shape which is tapered.

Another golf club according to the present invention includes a shaft, a head, an inner member and a screw member. The head has a hosel portion. The hosel portion has a hosel hole and a female screw constituting a part of the hosel hole. The screw member has a through hole for causing the shaft and the inner member to penetrate therethrough, a male screw and a downward surface. The male screw of the screw member and the female screw of the hosel portion are coupled to each other. The inner member has a shaft inserting hole opened on an upper end side thereof, and an upward surface. At least a part of the inner member is inserted into the hosel hole. The shaft and the shaft inserting hole are fixed to each other through bonding and/or fitting. The downward surface of the screw member and the upward surface of the inner member are engaged with each other directly or indirectly, and the inner member is controlled to be moved upward with respect to the hosel hole through the engagement.

In a further preferable golf club according to the present invention, the engaging surface is set to be an engaging side surface of the inner member. More specifically, the golf club includes a shaft, a head, an inner member and a screw member. The head has a hosel portion and a receiving surface. The hosel portion has a screw portion formed on an internal surface or external surface thereof and a hosel hole. The screw member has a through hole for causing the shaft and the inner member to penetrate therethrough, a screw portion and a downward surface. A screw portion of the screw member and a screw portion of the hosel portion are coupled to each other. The inner member has a shaft inserting hole opened on an upper end side thereof, an engaging side surface which can be engaged with the receiving surface, a bottom face, and an upward surface. At least a part of the inner member is inserted into the hosel hole. The shaft and the shaft inserting hole are fixed to each other through bonding and/or fitting. The downward surface of the screw member and the upward surface of the inner member are engaged with each other directly or indirectly, and the inner member is controlled to be moved upward with respect to the hosel hole through the engagement. The receiving surface of the head and the engaging side surface of the inner member are engaged with each other directly or indirectly, and the inner member is controlled to be rotated with respect to the hosel hole through the engagement.

It is preferable that the screw portion of the hosel portion should be a female screw disposed on an internal surface thereof, and the screw portion of the screw member should be a male screw disposed on an external surface thereof.

It is preferable that the inner member should have a cylindrical surface positioned on an upper side of the engaging side surface. It is preferable that an upper end of the engaging side surface should be extended outward in a radial direction from the cylindrical surface so that a step surface is formed on a boundary between the cylindrical surface and the engaging side surface, and the step surface should serve as the upward surface. It is preferable that a shape of a section in a radial direction of the engaging side surface should be non-circular and should have a rotational symmetry. It is preferable that a shape of a section in the radial direction of the receiving surface should be non-circular and should have the rotational symmetry corresponding to the sectional shape of the engaging side surface.

It is preferable that the engaging side surface and the receiving surface should have inclined surfaces which are inclined to approach a shaft axis in a downward direction. It is preferable that an inclination angle θ1 of the inclined surfaces with respect to the shaft axis should be equal to or greater than one degree and should be equal to or smaller than ten degrees.

It is preferable that when a radius of a circle which is circumscribed on the upward surface is represented by R1*c* and a radius of the cylindrical surface is represented by R2*c*, the following expression should be satisfied.

$$1.15 \leqq R1c/R2c \leqq 1.50$$

According to the present invention, it is possible to provide a golf club in which a head and a shaft can easily be attached and removed with a simple structure.

DESCRIPTION OF THE PREFERRED EMBODIMENTS

The present invention will be described below in detail based on preferred embodiments with reference to the drawings. In the present application, terms indicative of upper and lower parts, for example, "upper end", "upper", "lower end", "lower" and the like are used. In the present application, "upper" implies an upper side in a direction of a shaft axis Z1, that is, a rear end side of a shaft or a grip side of a golf club. Moreover, "lower" implies a lower side in the direction of the shaft axis Z1, that is, a sole side of a head. If there is no particular description, it is assumed that "axial direction" implies the direction of the shaft axis Z1 and "circumferential direction" implies a circumferential direction with respect to the axial direction, and "radial direction" implies a perpendicular direction to the axial direction in the present application.

Figure 1:
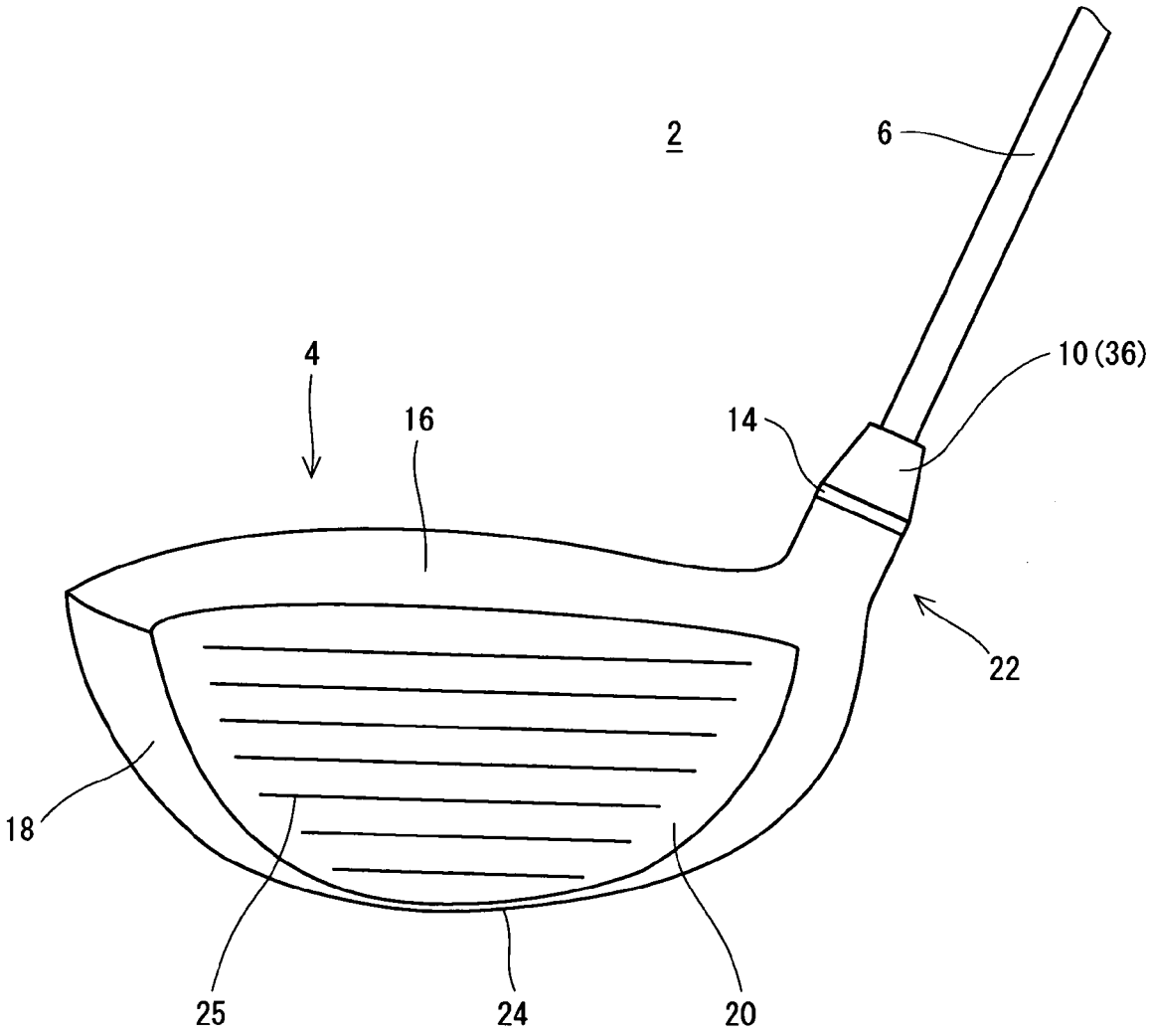
FIG. 1 is a view showing a part of a golf club according to a first embodiment of the present invention.

As shown in FIG. 1, a golf club 2 includes a head 4 and a shaft 6. The head 4 is attached to one of ends of the shaft 6. A grip is attached to the other end of the shaft 6, which is not shown. The shaft 6 is tubular.

Figure 2:
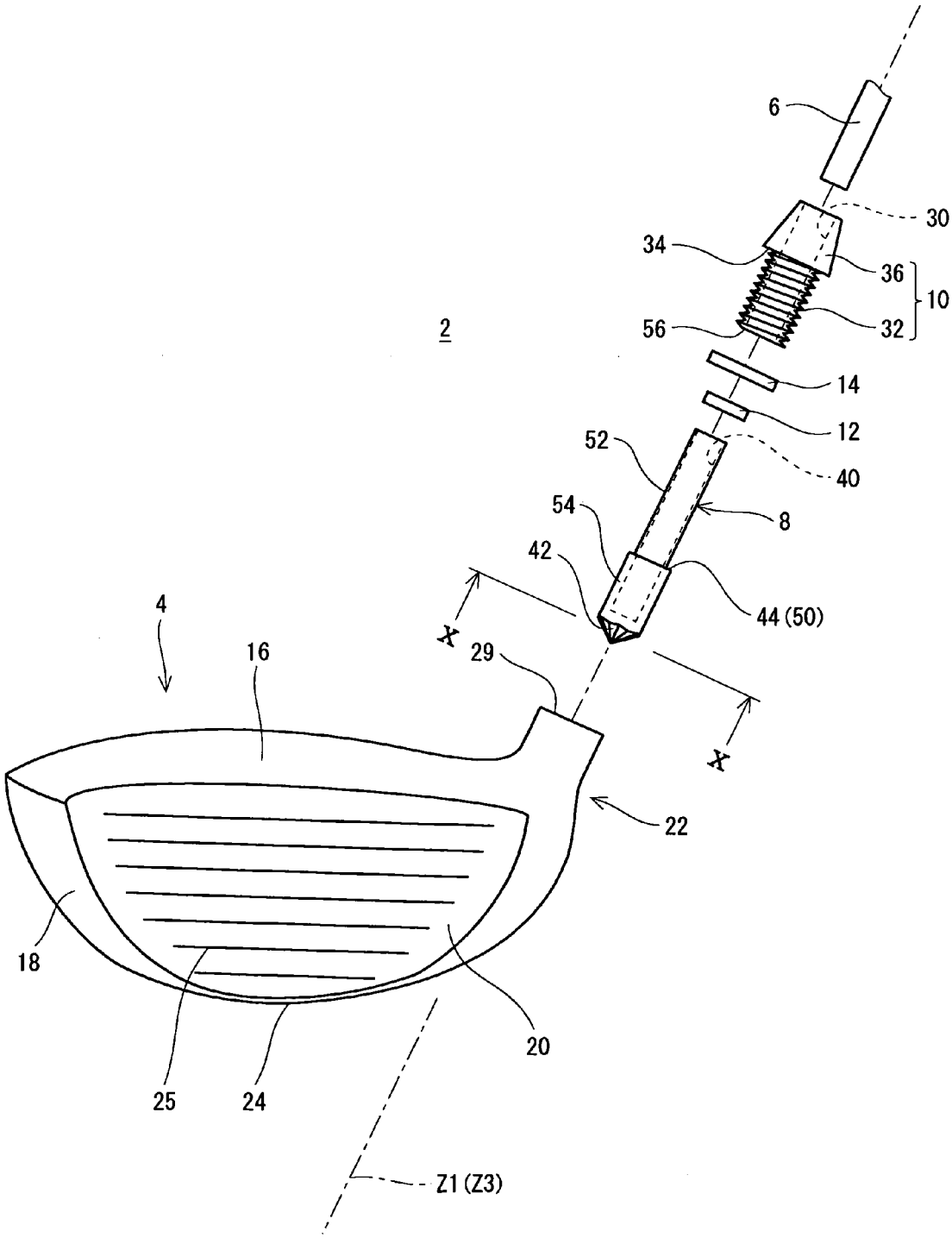
FIG. 2 is an exploded view showing the golf club of FIG. 1.

As shown in FIG. 2, the golf club 2 includes an inner member 8, a screw member 10, a washer 12 and a washer 14. The inner member 8, the screw member 10, the washer 12 and the washer 14 are concerned in a coupling of the head 4 and the shaft 6.

The head 4 is a golf club head of a wood type. The head 4 has a crown portion 16, a side portion 18, a face portion 20, a hosel portion 22 and a sole portion 24. The head 4 is hollow. The face portion 20 is provided with a face line 25. The head 4 may be a golf club head of an iron type or any other type.

Figure 3:
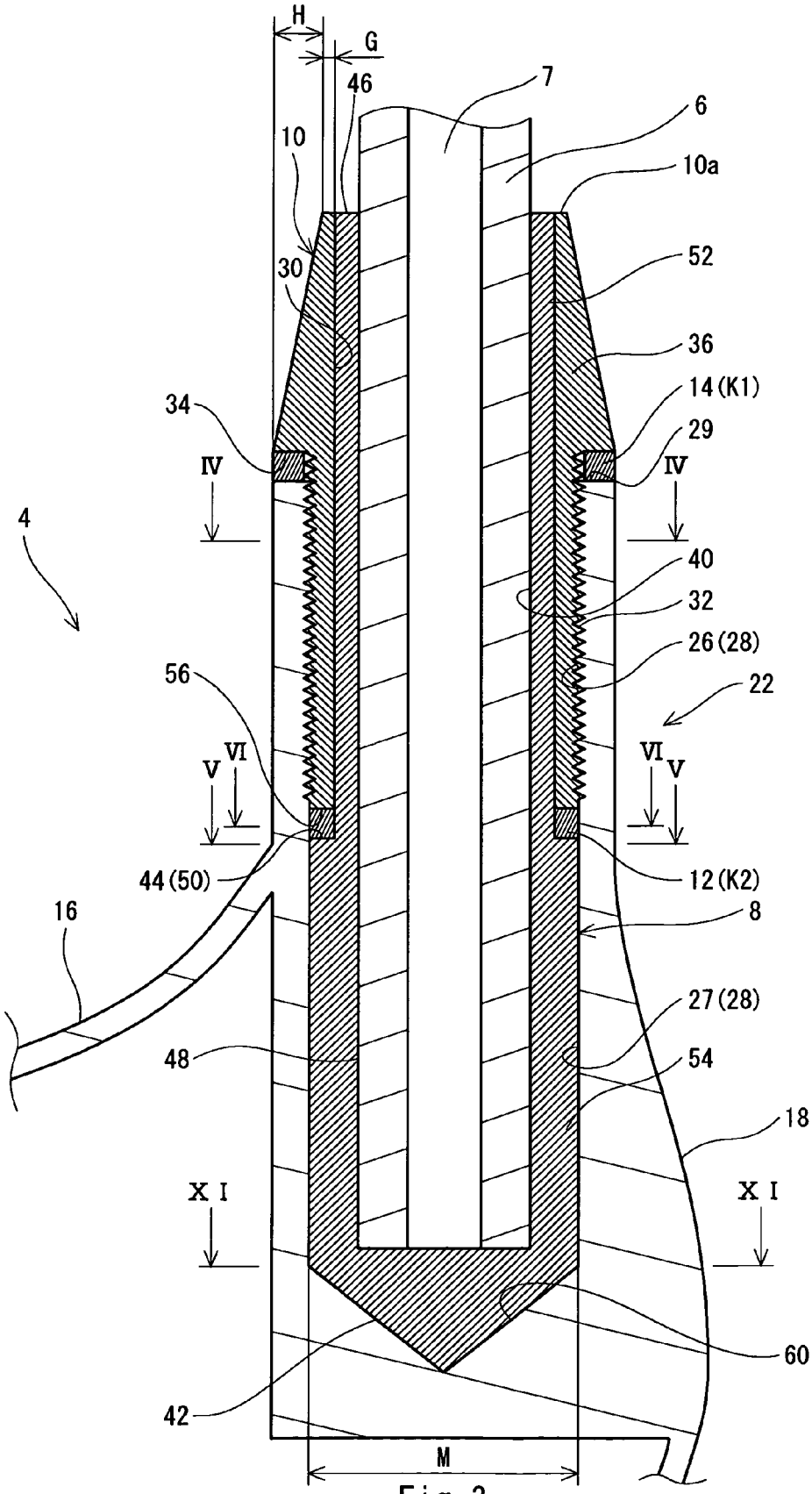
FIG. 3 is a sectional view showing the golf club of FIG. 1, which is taken along a shaft axis.
Figure 4:
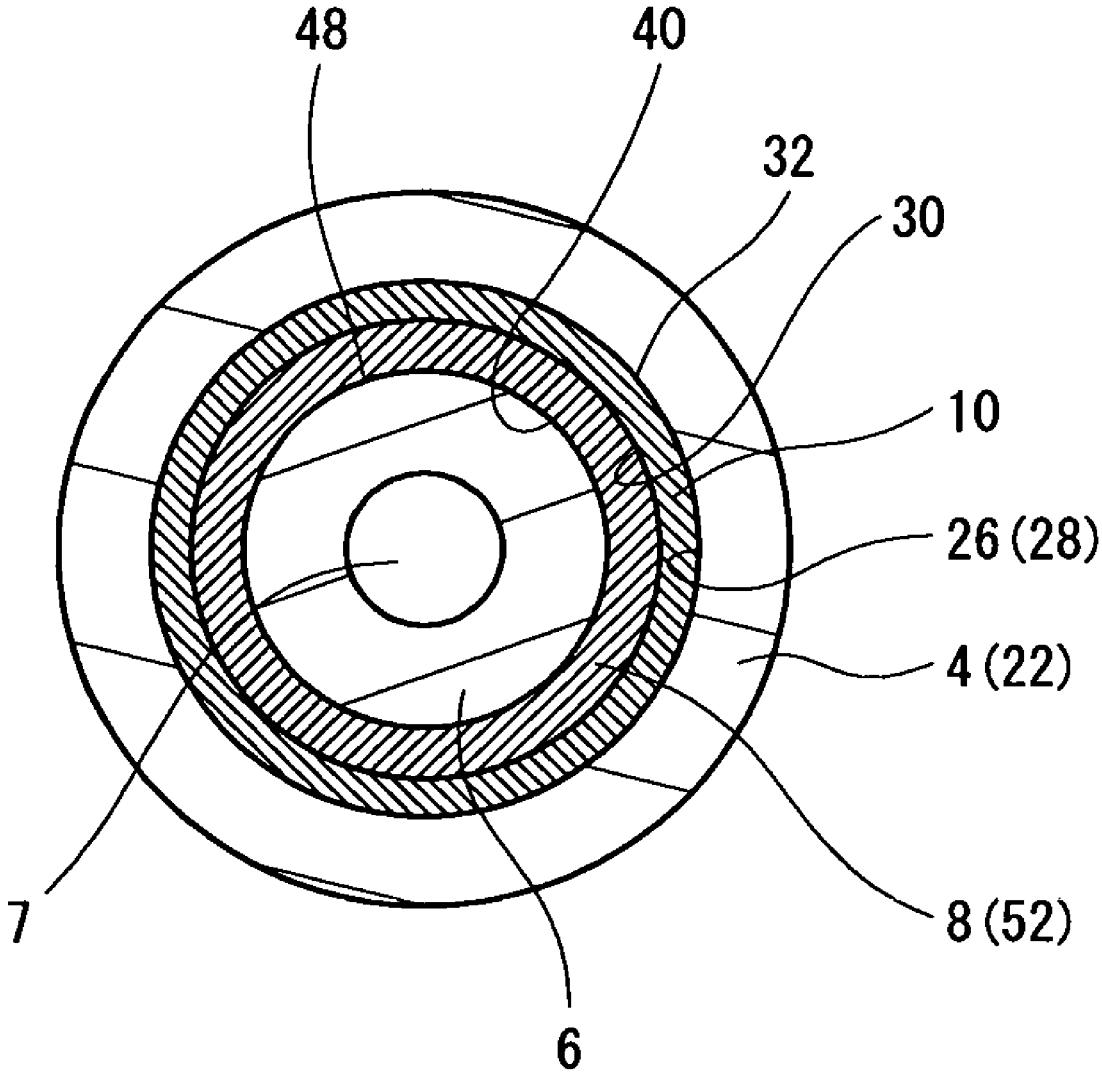
FIG. 4 is a sectional view showing the golf club taken along an IV-IV line in FIG. 3.
Figure 5:
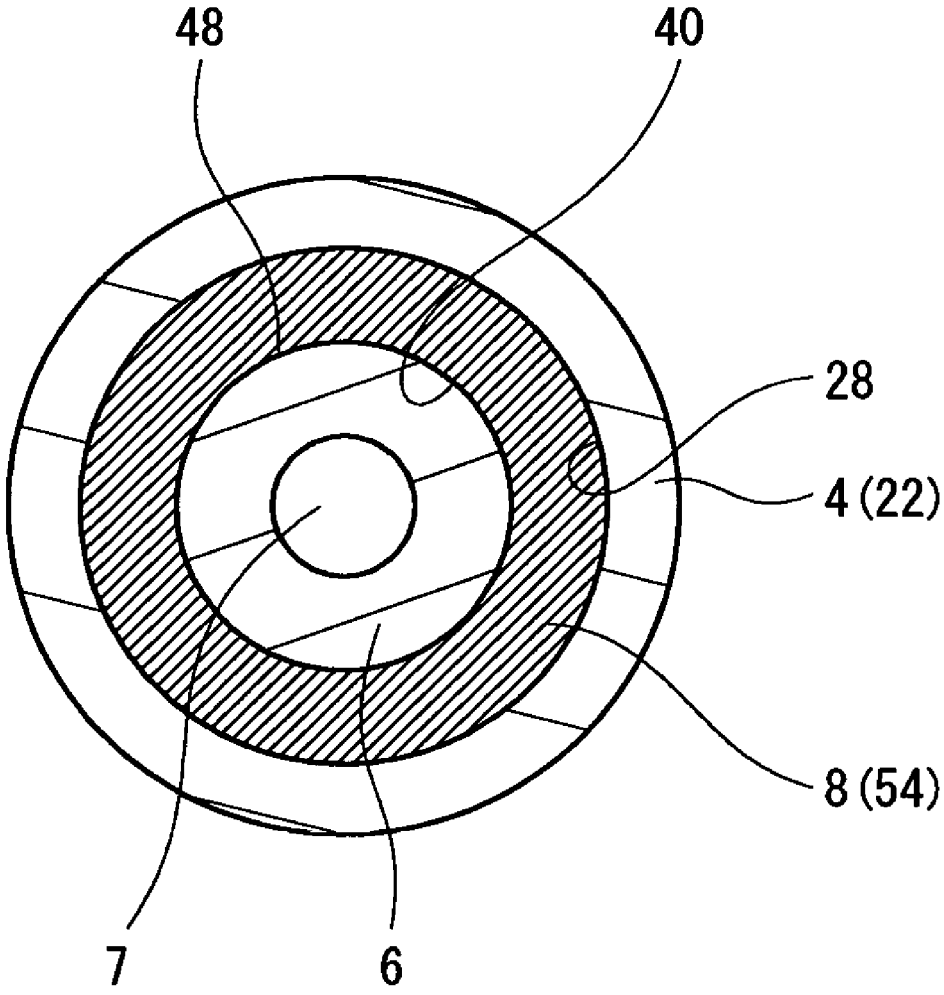
FIG. 5 is a sectional view showing the golf club taken along a V-V line in FIG. 3.
Figure 6:
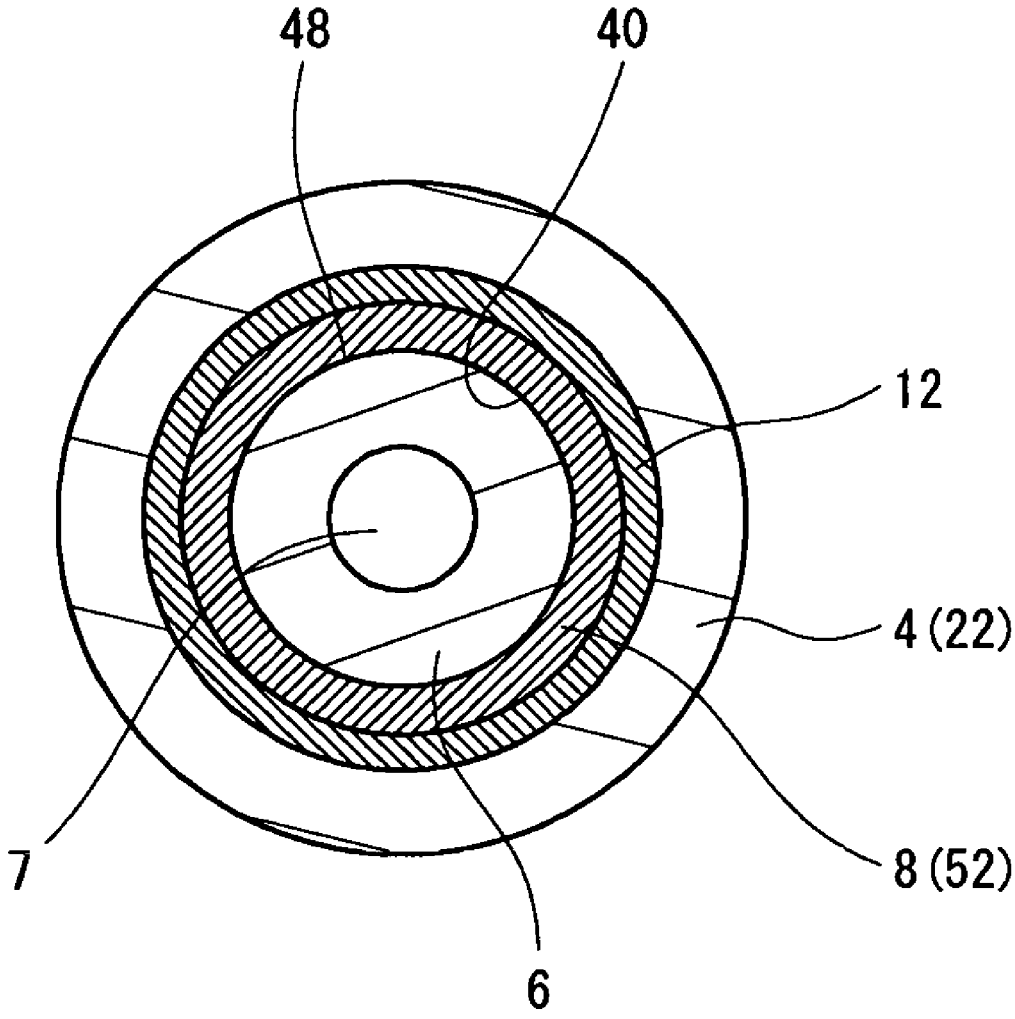
FIG. 6 is a sectional view taken along a VI-VI line in FIG. 3.

FIG. 3 is a sectional view showing the vicinity of the hosel portion 22. FIG. 3 is a sectional view taken along a plane including the shaft axis Z1. FIG. 4 is a sectional view showing the golf club 2 taken along an IV-IV line in FIG. 3. FIG. 5 is a sectional view showing the golf club 2 taken along a V-V line in FIG. 3. FIG. 6 is a sectional view showing the golf club 2 taken along a VI-VI line in FIG. 3. For easy understanding of the drawings, a sectional shape of a screw portion is not taken into consideration in FIGS. 4, 5 and 6.

The shaft 6 has a hollow portion 7. The hosel portion 22 has a screw portion 26 formed on an internal surface thereof and a hosel hole 28. The screw portion 26 constitutes a part of the hosel hole 28. The hosel hole 28 has a screw portion 26 and a non-screw portion 27. The non-screw portion 27 is positioned on a lower side of the screw portion 26. A surface of the non-screw portion 27 is a smooth circumferential surface. As shown in FIG. 3, the screw portion 26 is a female screw. The screw portion 26 is formed in an upper part of the hosel hole 28. The screw portion 26 is provided from an end face 29 of the hosel portion 22 to a middle position of the hosel hole 28.

The screw member 10 has a through hole 30, a screw portion 32, and downward surfaces 34 and 56 (see FIGS. 2 and 3). Furthermore, the screw member 10 has an exposed portion 36. The through hole 30 penetrates the screw portion 32 and the exposed portion 36. A lower part of the screw member 10 is set to be the screw portion 32. The screw portion 32 constitutes a part of an external surface of the screw member 10. The screw portion 32 is a male screw. An internal surface of the screw portion 32 serves as the through hole 30. An upper part of the screw member 10 is set to be the exposed portion 36. The screw portion 32 is not visually recognized from an outside. In the golf club 2, the exposed portion 36 is exposed to the outside. An internal surface of the exposed portion 36 serves as the through hole 30.

The downward surface 34 is positioned on a boundary between the screw portion 32 and the exposed portion 36. The downward surface 34 is a step surface. The downward surface 34 is a plane. The downward surface 34 takes an annular shape. The downward surface 34 is extended in a radial direction. An outside diameter of the downward surface 34 is larger than an outside diameter (a maximum diameter) of the screw portion 32. In the screw member 10, the outside diameter of the downward surface 34 is larger than a maximum diameter in a portion provided under the downward surface 34. The downward surface 34 is extended outward in the radial direction from the screw portion 32. The downward surface 34 may be inclined to the radial direction. The downward surface can receive an upward force.

An external surface of the exposed portion 36 forms a conical surface (a conical projection surface). An outside diameter of the exposed portion 36 is increased toward a lower side. The exposed portion 36 has a maximum outside diameter at a lower end thereof. The maximum diameter of the exposed portion 36 is substantially equal to an outside diameter of the end face 29 of the hosel portion 22.

In an appearance, the exposed portion 36 looks like a so-called ferrule. The golf club usually has the ferrule. The appearance of the exposed portion 36 is the same as that of the ferrule. The golf club 2 has the same appearance as that of an ordinary golf club. A large number of golf players that are familiar with the ordinary golf club do not feel uncomfortable in the appearance of the golf club 2.

The through hole 30 penetrates the screw member 10. The through hole 30 and the screw member 10 are coaxial with each other. The screw member 10 and the shaft 6 are disposed coaxially. The screw member 10 and the inner member 8 are disposed coaxially.

The washer 14 takes an annular shape. The washer 14 is provided between the end face 29 of the hosel portion 22 and the downward surface 34. An outside diameter of the washer 14 is substantially equal to that of the end face 29 of the hosel portion 22. The outside diameter of the washer 14 is substantially equal to that of the downward surface 34. In an appearance, the washer 14 easily seems to be integral with the hosel portion 22 or the exposed portion 36. A large number of golf players that are familiar with an ordinary golf club do not feel uncomfortable in the appearance of the washer 14 and the hosel portion 22. It is preferable that a color of an external surface of the washer 14 should be the same as that of the external surface of the hosel portion 22 or the exposed portion 36. For example, the external surfaces of the exposed portion 36 and the washer 14 may have a black color. The washer 14 may be eliminated. In the case in which the washer 14 is not provided, the appearance of the golf club 2 is substantially identical to that of the ordinary golf club, resulting in no uncomfortable feeling.

As shown in FIG. 3, the screw portion 32 of the screw member 10 and the screw portion 26 of the hosel portion 22 are coupled to each other. More specifically, the screw portion 32 to be the male screw and the screw portion 26 to be the female screw are coupled to each other. Through the screw coupling, the screw member 10 is fixed to the head 4.

The screw coupling is constituted to carry out tightening by a force received from a ball in hitting. The head 4 is right-handed. In case of the right-handed head 4, the head 4 tries to be rotated clockwise around the shaft axis Z1 as seen from above (the grip side) by the force received from the ball in the hitting. By the rotation, the screw portion 26 (the female screw) and the screw portion 32 (the male screw) are tightened. When the screw member 10 is rotated counterclockwise as seen from above (the grip side), the screw portion 26 and the screw portion 32 are tightened. To the contrary, when the screw member 10 is rotated clockwise as seen from above (the grip side), the tightening of the screw portions 26 and 32 is loosened. Thus, the screw portions 26 and 32 are left-hand screws.

In case of the right-handed golf club, thus, it is preferable that the screw portions 26 and 32 should be set to be the left-hand screws. By setting them to be the left-hand screws, the screw coupling can be prevented from being loosened due to an impact in the hitting. In order to prevent the screw coupling from being loosened due to the impact in the hitting, it is preferable that the screw portions 26 and 32 should be right-handed screws in case of the left-handed golf club.

Figure 7:
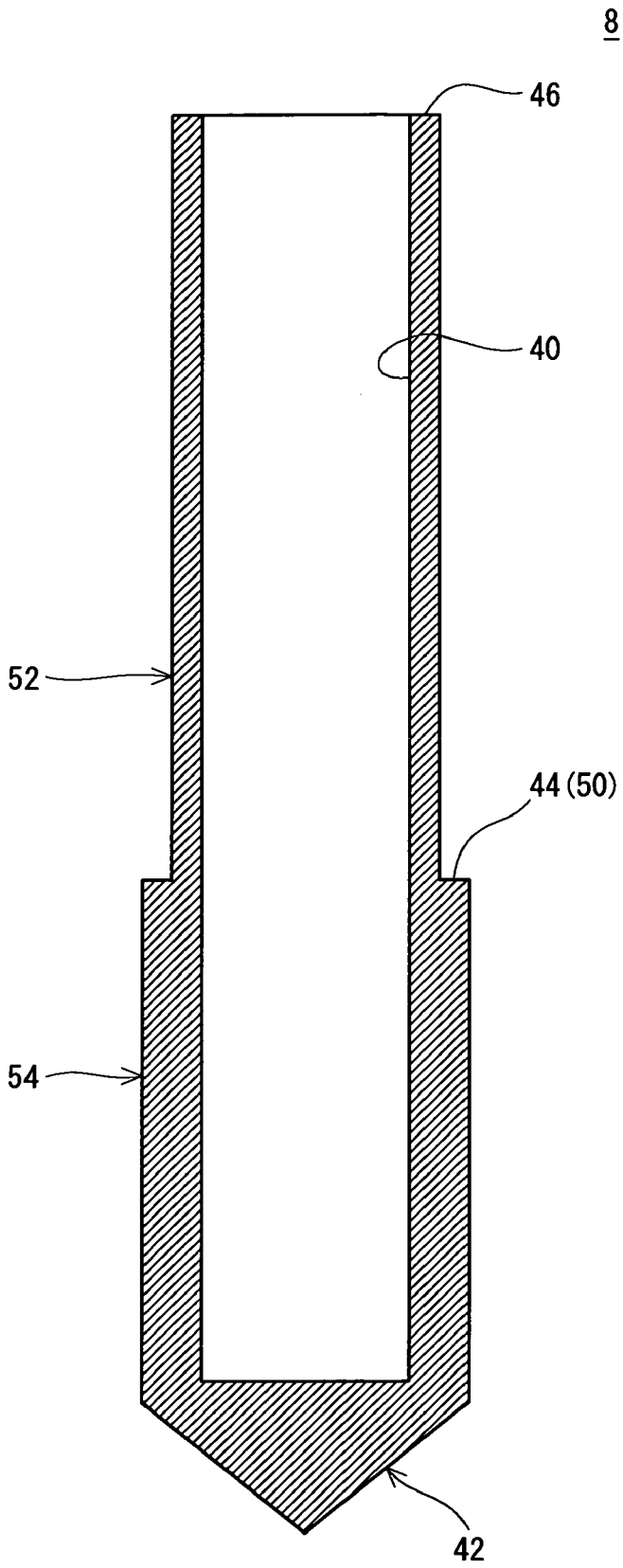
FIG. 7 is a sectional view showing an inner member.
Figure 8:
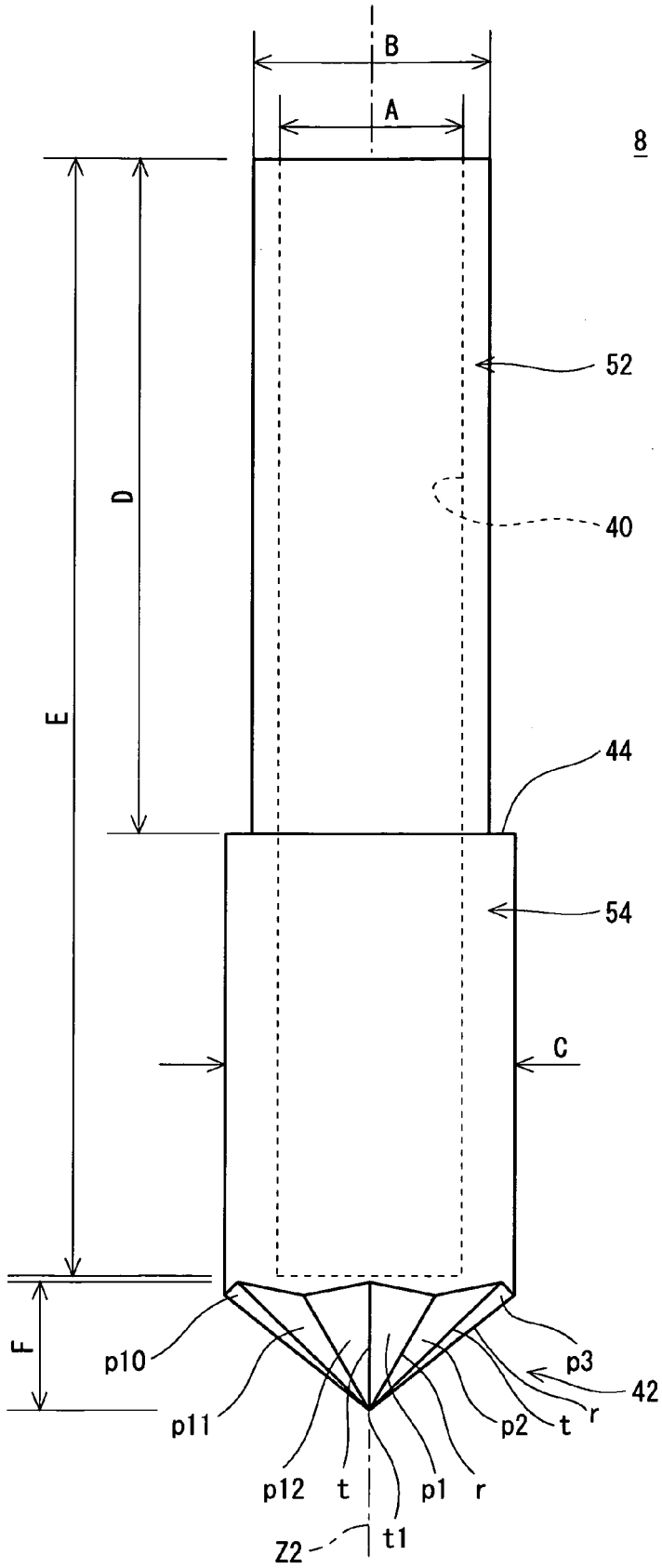
FIG. 8 is a side view showing the inner member.
Figure 9:
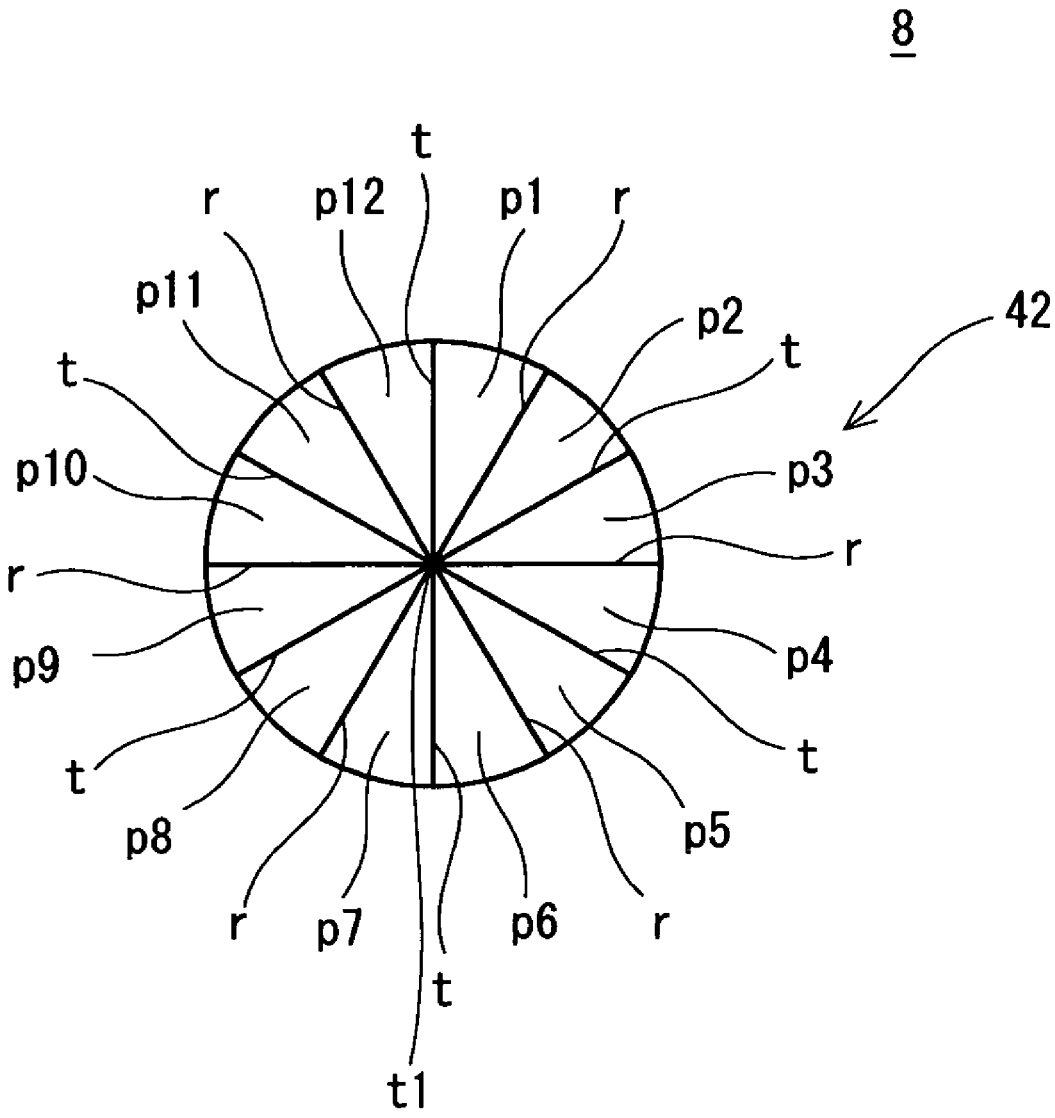
FIG. 9 is a plan view showing the inner member seen from below.
Figure 10:
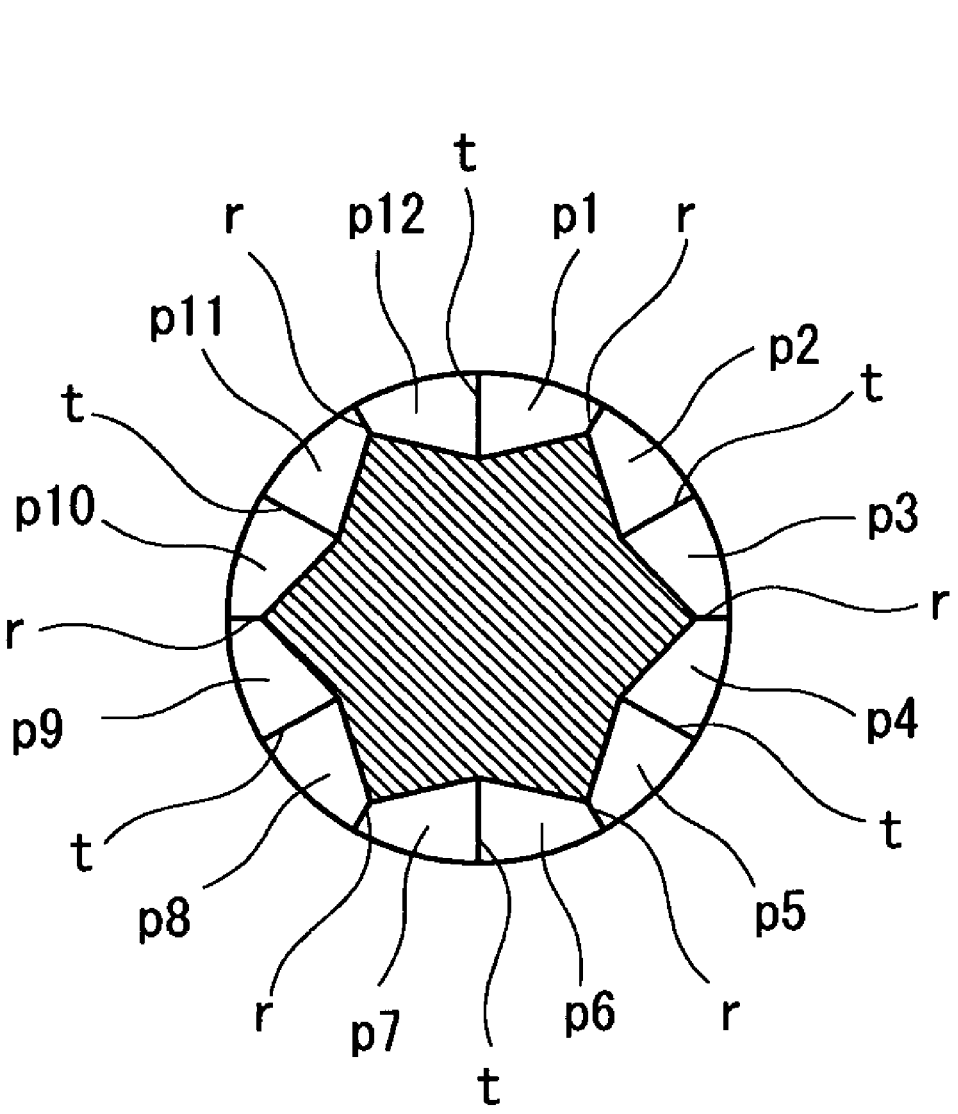
FIG. 10 is a sectional view showing the inner member taken along an X-X line in FIG. 2.
Figure 11:
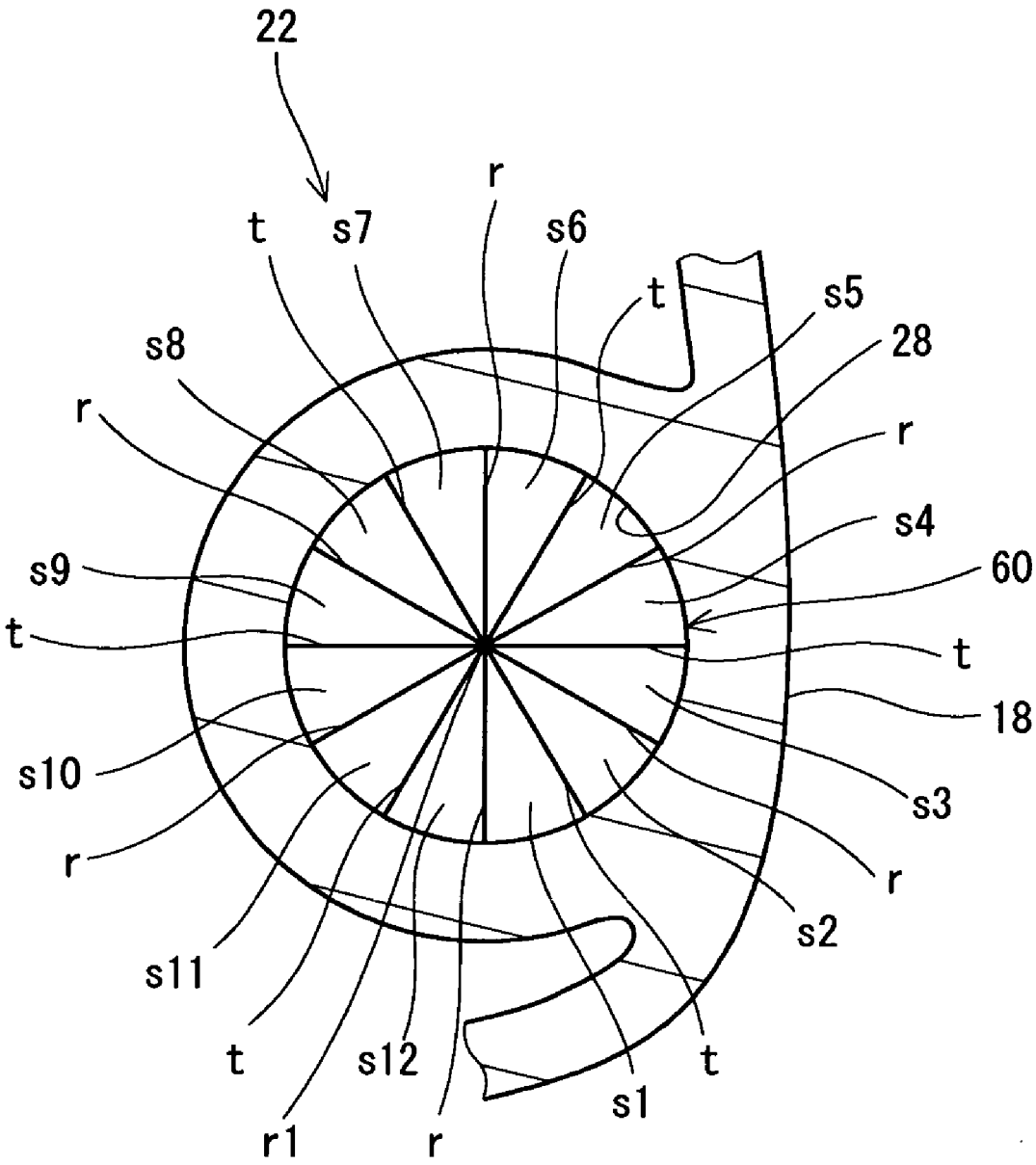
FIG. 11 is a sectional view showing a hosel portion taken along an XI-XI line in FIG. 3.

FIG. 7 is a sectional view showing the inner member 8. FIG. 7 is a sectional view taken along a plane including the shaft axis Z1. FIG. 8 is a side view showing the inner member 8. FIG. 9 is a plan view showing the inner member 8 seen from below. FIG. 10 is a sectional view showing the inner member 8 taken along an X-X line in FIG. 2. FIG. 11 is a sectional view showing the hosel portion 22 taken along an XI-XI line in FIG. 3.

The inner member 8 has a part inserted in the hosel hole 28. As shown in FIG. 3, a lower part of the inner member 8 is inserted in the hosel hole 28. A portion of the inner member 8 which is not inserted in the hosel hole 28 is positioned on an inside of the exposed portion 36 in the screw member 10 and an inside of the washer 14.

As shown in FIG. 7 and the like, the inner member 8 has a shaft inserting hole 40, a lower surface 42 and an upward surface 44. The shaft inserting hole 40 is opened toward an upper end side of the inner member 8. The shaft inserting hole 40 is opened at an upper end face 46 of the inner member 8.

The inner member 8 is fixed to the shaft 6. The inner member 8 is bonded to the shaft 6. The inner member 8 is bonded to the shaft 6 with an adhesive. The shaft inserting hole 40 is bonded to an external surface 48 of the shaft 6. In the sectional views of the present application, an adhesive layer is not shown. The inner member 8 and the shaft 6 may be fixed by a method other than the bond. Examples of the fixing method include fitting. In respect of a productivity and a fixing strength, the bonding through the adhesive is preferable.

The upward surface 44 is disposed in a middle position in a longitudinal direction of the inner member 8. An outside diameter of an upper part (a small diameter portion 52) of the inner member 8 is smaller than that of a lower part (a large diameter portion 54) of the inner member 8. Due to a difference in the outside diameter, a step surface 50 is provided. The step surface 50 serves as the upward surface 44. The upward surface 44 takes an annular shape. The upward surface 44 is extended in the radial direction. An inside diameter of the upward surface 44 is equal to the outside diameter of the small diameter portion 52. An outside diameter of the upward surface 44 is equal to that of the large diameter portion 54. The upward surface 44 may be inclined to the radial direction. Moreover, the position of the upward surface 44 is not restricted. The upward surface 44 does not need to take the annular shape. For example, the upward surface 44 may be an upper surface of a projection. The upward surface can receive a downward force.

The outside diameter of the large diameter portion 54 is almost equal to a diameter of the non-screw portion 27 in the hosel hole 28. The outside diameter of the small diameter portion 52 is almost equal to a diameter of the through hole 30. A clearance is not substantially present between the inner member 8 and the hosel hole 28.

As shown in FIG. 3, the washer 12 is provided between the upward surface 44 and the screw member 10. The washer 12 is provided between the lower end face 56 of the screw member 10 and the upward surface 44. The lower end face 56 is a downward surface. The washer 12 can prevent the upward surface 44 and the downward surface 56 from being worn out. The washer 12 does not need to be provided.

The downward surface 56 takes an annular shape. The downward surface 56 is extended in the radial direction. The downward surface 56 serves as a lower end face of the screw portion 32. The downward surface 56 may be inclined to the radial direction. The downward surface can receive an upward force.

The lower surface 42 wholly takes a tapered shape. The lower surface 42 of the inner member 8 has a surface of recess and projection. As shown in FIGS. 8, 9 and 10, the lower surface 42 is constituted by a plurality of planes. The lower surface 42 is constituted by 12 planes. The lower surface 42 is constituted by planes p1, p2, p3, p4, p5, p6, p7, p8, p9, p10, p11 and p12 (see FIGS. 9 and 10).

The planes p1 to p12 are divided through an edge line r and a valley line t. The edge line r forms a set of apexes of projections. The valley line t forms a set of the deepest points of the recess.

As seen on a plane in FIG. 9, referring to the lower surface 42, the valley line t and the edge line rare arranged alternately in a circumferential direction. Furthermore, the valley line t and the edge line r are disposed uniformly in the circumferential direction. As seen on the plane in FIG. 9, an angle defined by the valley line t and the edge line r which are adjacent to each other is constant. As seen on the plane in FIG. 9, the valley line t and the edge line r are extended radially from the apex t1. An angle defined by a central axis Z2 of the inner member 8 and the edge line r is constant for all of the edge lines r. Lengths of all the edge lines r are equal to each other. An angle defined by the central axis Z2 of the inner member 8 and the valley line t is constant for all of the valley lines t. Lengths of all the valley lines t are equal to each other. The central axis Z2 of the inner member 8 passes through the apex t1. One of ends of the valley line t serves as the apex t1 and the other end of the valley line t is positioned on the external surface of the large diameter portion 54. One of ends of the edge line r serves as the apex t1 and the other end of the edge line r is positioned on the external surface of the large diameter portion 54. The central axis Z2 and the shaft axis Z1 are substantially coincident with each other.

As shown in FIGS. 3 and 11, the head 4 has a receiving surface 60. The receiving surface 60 serves as a bottom face of the hosel hole 28. The receiving surface 60 is a concavo-convex surface. A shape of the concavo-convex surface corresponds to that of the lower surface 42 of the inner member 8.

As shown in FIG. 11, the receiving surface 60 is constituted by a plurality of planes. The receiving surface 60 is constituted by 12 planes. The receiving surface 60 is constituted by planes s1, s2, s3, s4, s5, s6, s7, s8, s9, s10, s11 and s12 (see FIG. 11).

The planes s1 to s12 are divided through an edge line r and a valley line t. As shown in FIG. 11, the edge line r and the valley line t are arranged alternately in a circumferential direction.

As seen on a plane in FIG. 11, referring to the receiving surface 60, the valley line t and the edge line r are arranged alternately in the circumferential direction. As seen on the plane in FIG. 11, an angle defined by the valley line t and the edge line r which are adjacent to each other is constant. As seen on the plane in FIG. 11, the valley line t and the edge line r are extended radially from the lowest point r1. One of ends of the valley line t serves as the lowest point r1 and the other end of the valley line t is positioned on a surface of the non-screw portion 27. One of ends of the edge line r serves as the lowest point r1 and the other end of the edge line r is positioned on the surface of the non-screw portion 27. An angle defined by a central axis Z3 of the hosel hole 28 and the edge line r is constant for all of the edge lines r. Lengths of all the edge lines r are equal to each other. An angle defined by the central axis Z3 and the valley line t is constant for all of the valley lines t. Lengths of all the valley lines t are equal to each other. The central axis Z3 passes through the lowest point r1. The central axis Z3 and the shaft axis Z1 are substantially coincident with each other.

The receiving surface 60 is a concavo-convex surface corresponding to the lower surface 42 of the inner member 8. The lower surface 42 and the receiving surface 60 are provided in face contact with each other. The edge line r of the lower surface 42 and the valley line t of the receiving surface 60 are provided in line contact with each other. The valley line t of the lower surface 42 and the edge line r of the receiving surface 60 are provided in line contact with each other. The planes p1 and s1 are provided in face contact with each other. The planes p2 and s2 are provided in face contact with each other. The planes p3 and s3 are provided in face contact with each other. The planes p4 and s4 are provided in face contact with each other. The planes p5 and s5 are provided in face contact with each other. The planes p6 and s6 are provided in face contact with each other. The planes p7 and s7 are provided in face contact with each other. The planes p8 and s8 are provided in face contact with each other. The planes p9 and s9 are provided in face contact with each other. The planes p10 and s10 are provided in face contact with each other. The planes p11 and s11 are provided in face contact with each other. The planes p12 and s12 are provided in face contact with each other. The planes constituting the lower surface 42 and those constituting the receiving surface 60 are provided in face contact with each other.

In the lower surface 42, at least a part of the concavo-convex surface is an inclined surface to the shaft axis Z1. In the lower surface 42 according to the present embodiment, all of the surfaces (the planes p1 to p12) constituting the recesses and projections are inclined to the shaft axis Z1.

In the receiving surface 60, at least a part of the concavo-convex surface is an inclined surface to the shaft axis Z1. In the receiving surface 60 according to the present embodiment, all of the surfaces (the planes s1 to s12) constituting the recesses and projections are inclined to the shaft axis Z1.

In the lower surface 42, a projection is formed by the planes p1 and p2. On the other hand, in the receiving surface 60, a recess is formed by the planes s1 and s2. The projection of the lower surface 42 is fitted in a recess of the receiving surface 60.

In the lower surface 42, a recess is formed by the planes p2 and p3. On the other hand, in the receiving surface 60, a projection is formed by the planes s2 and s3. The projection of the receiving surface 60 is fitted in a recess of the lower surface 42.

In the lower surface 42, the recesses and the projections are arranged alternately in the circumferential direction. In the receiving surface 60, the projections and recesses are arranged alternately in the circumferential direction. The recess of the lower surface 42 and the projection of the receiving surface 60 are fitted each other, and the projection of the lower surface 42 and the recess of the receiving surface 60 are fitted each other.

Thus, the lower surface 42 has at least one projection. More specifically, the lower surface 42 has six projections. Moreover, the lower surface 42 has at least one recess. In other words, the lower surface 42 has six recesses. A section of the projection owned by the lower surface 42 takes a tapered shape. The sectional shape of the projection is a triangle setting the edge line r to be an apex.

Moreover, the receiving surface 60 has at least one projection. More specifically, the receiving surface 60 has six projections. Furthermore, the receiving surface 60 has at least one recess. More specifically, the receiving surface 60 has six recesses. A section of the projection owned by the receiving surface 60 takes a tapered shape. More specifically, the sectional shape of the projection is a triangle setting the edge line r to be an apex.

In the present embodiment, the section of the projection of the lower surface 42 takes the tapered shape. Therefore, the projection of the lower surface 42 is easily fitted in the recess of the receiving surface 60. Moreover, the section of the projection of the receiving surface 60 takes the tapered shape. Therefore, the projection of the receiving surface 60 is easily fitted in the recess of the lower surface 42. Accordingly, the inner member 8 can easily be attached to and removed from the head 4. In other words, the shaft 6 can easily be attached to and removed from the head 4.

As described above, the recess of the lower surface 42 and the projection of the receiving surface 60 are engaged with each other. Moreover, the projection of the lower surface 42 and the recess of the receiving surface 60 are engaged with each other. By the engagement of the lower surface 42 and the receiving surface 60, the inner member 8 is controlled to be rotated with respect to the hosel hole 28. The lower surface 42 and the receiving surface 60 are engaged to control a rotation of the inner member 8 (a rotation around the shaft axis Z1) in the hosel hole 28. Another member may be provided between the lower surface 42 and the receiving surface 60.

As described above, moreover, the downward surface 56 of the screw member 10 and the upward surface 44 of the inner member 8 are engaged with each other. In the embodiment described above, the engagement is indirectly carried out. More specifically, the engagement is implemented through the washer 12. The downward surface 56 and the upward surface 44 may be directly engaged with each other. By the engagement, the inner member 8 is controlled to be moved upward with respect to the hosel hole 28.

The engagement (abutment) of the lower surface 42 and the receiving surface 60 is maintained until the inner member 8 is moved upward with respect to the hosel hole 28. Due to the engagement of the lower surface 42 and the receiving surface 60, the inner member 8 cannot be rotated with respect to the hosel hole 28. By the receiving surface 60, the inner member 8 is also controlled to be moved downward with respect to the hosel hole 28.

Thus, the inner member 8 cannot be moved vertically with respect to the hosel hole 28 and cannot be rotated with respect to the hosel hole 28. The inner member 8 is fixed to the hosel hole 28. The inner member 8 and the hosel hole 28 are not bonded to each other. However, the inner member 8 is held in the hosel hole 28, and at the same time, is fixed to the hosel hole 28.

The shaft 6 having the inner member 8 can be attached to and removed from the head 4. The shaft 6 can be attached by fixing the screw member 10 to the head 4. The shaft 6 can be removed by releasing the fixation of the screw member 10 to the head 4. By loosening a screw mechanism, the fixation of the head 4 and the shaft 6 can easily be released.

Examples of a procedure for assembling the golf club 2 include the following procedure.

[Assembling Procedure] Steps (1) to (5) which will be Described Below (1) The screw portion 32 of the screw member 10 is inserted into the washer 14 and the shaft 6 is inserted into the through hole 30 of the screw member 10.

(2) The small diameter portion 52 of the inner member 8 is inserted into the washer 12.

(3) The shaft 6 is inserted into the shaft inserting hole 40 of the inner member 8 and the shaft 6 and the inner member 8 are bonded to each other with an adhesive or the like.

(4) The inner member 8 is inserted into the hosel hole 28.

(5) The screw member 10 and the hosel portion 22 are fixed to each other.

After the assembly is carried out in accordance with the procedure, the shaft 6 can easily be attached and removed. More specifically, the shaft 6 can be attached to and removed from the head 4 through the screw mechanism. When the shaft 6 is to be sold as a component which has not been assembled, a member subjected to the steps (1) to (3) may be sold in the assembling procedure.

The washers 14 and 12 do not need to be provided. However, the washers 12 and 14 are important for reliably engaging the receiving surface 60 with the lower surface 42. In order to achieve an abutment (1) of the receiving surface 60 and the lower surface 42, an abutment (2) of the end face 29 and the downward surface 34 and an abutment (3) of the downward surface 56 of the screw member 10 and the upward surface 44 at the same time, high dimensional accuracy is required. By setting the washer 14 or 12 to be formed by an elastically deformable material, it is possible to reduce the dimensional accuracy. From this viewpoint, it is preferable that a material of a member K1 (the washer 14) interposed between the downward surface 34 and the end face 29 should be elastically deformable by an axial force of screw coupling. It is preferable that the abutment (engagement) of the receiving surface 60 and the lower surface 42 should be achieved within a range of the elastic deformation of the member K1 through the axial force of the screw coupling. Similarly, it is preferable that a material of a member K2 (the washer 12) interposed between the downward surface 56 of the screw member 10 and the upward surface 44 should be elastically deformable by the axial force of the screw coupling. It is preferable that the abutment of the receiving surface 60 and the lower surface 42 should be achieved within a range of the elastic deformation of the member K2 through the axial force of the screw coupling. It is preferable that the lower surface 42 should press the receiving surface 60 by the axial force of the screw coupling. By the pressing, it is possible to enhance a relative rotation controlling effect. By the presence of the member K1 or K2, it is possible to easily achieve the structure in which the lower surface 42 presses the receiving surface 60.

In order to enhance a beauty without the interposed member recognized visually, it is preferable that the member K1 (the washer 14) should not be provided and the member K2 (the washer 12) should be provided. In this case, it is preferable that the abutment of the downward surface 34 and the end face 29 should be achieved and the abutment (engagement) of the receiving surface 60 and the lower surface 42 should be achieved within the range of the elastic deformation of the member K2 through the axial force of the screw coupling.

It is also possible to employ a structure in which a clearance is provided between the end face 29 of the hosel portion 22 and the downward surface 34 in a state in which the receiving surface 60 abuts on the lower surface 42. In this case, the structure is preferable in that the abutment of the receiving surface 60 and the lower surface 42 can be reliably carried out and is not preferable in that the clearance between the downward surface 34 and the end face 29 might be recognized visually. In respect of an appearance, it is also preferable that the member K1 should be present. In respect of the appearance, it is preferable that the clearance should not be present between the downward surface 34 and the end face 29.

Figure 12:
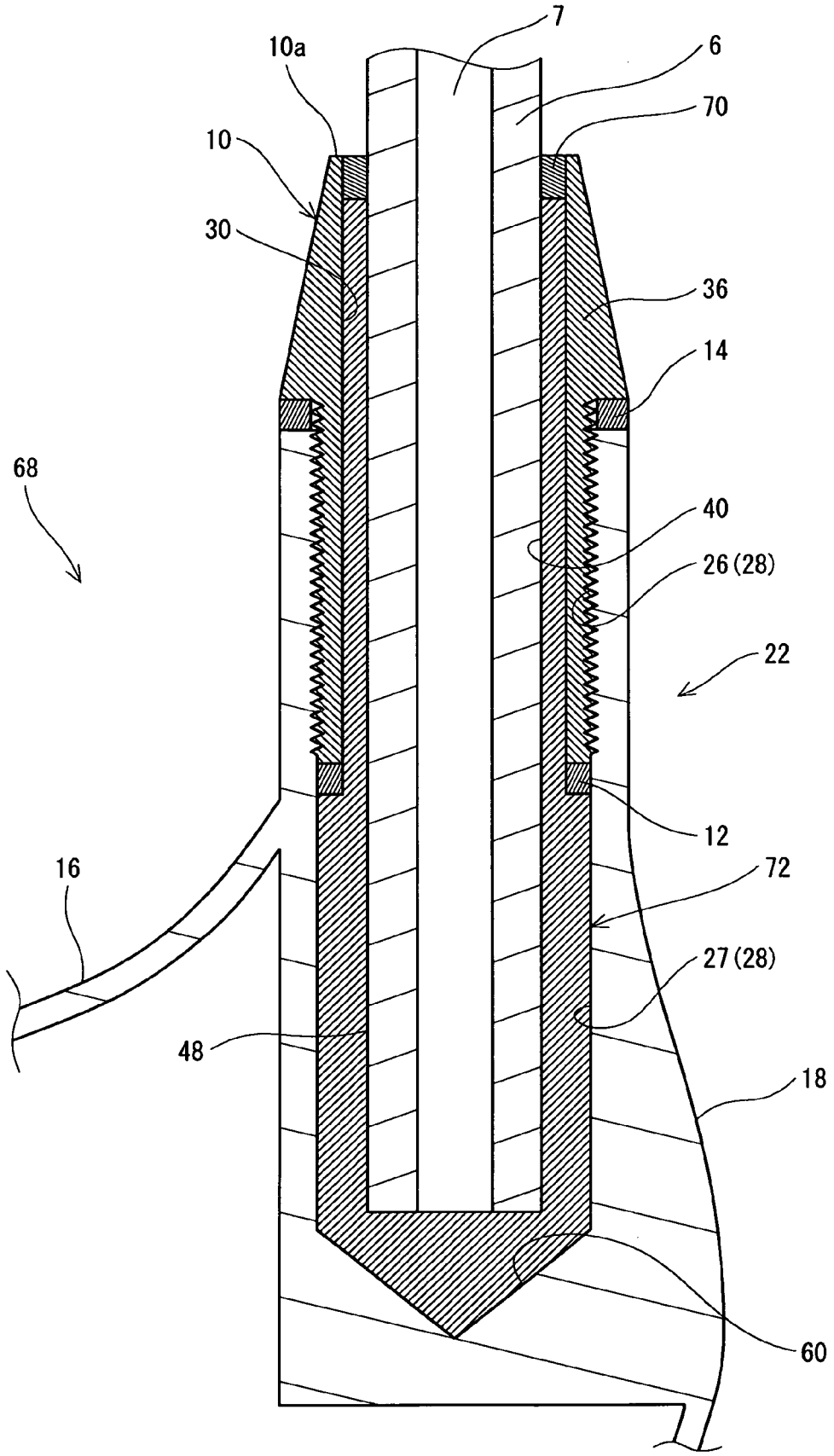
FIG. 12 is a sectional view showing a golf club according to a second embodiment, which is taken along a shaft axis.

FIG. 12 is a sectional view showing the vicinity of a hosel in a head 68 according to a second embodiment. A structure of the head 68 is the same as that of the head 4 except that a buffering member 70 is provided. The buffering member 70 is provided on an upper side of an inner member 72. In order to maintain a space for providing the buffering member 70, a length of the inner member 72 is set to be shorter than that of the inner member 8. An inside diameter of the buffering member 70 is substantially equal to an outside diameter of the shaft 6 in the buffering member 70. An outside diameter of the buffering member 70 is substantially equal to an inside diameter of a screw member 10 (a diameter of a through hole 30). The buffering member 70 is disposed on an upper end of the screw member 10.

In hitting, an impact force acts on the head 68. By the impact force, a stress might act between the head 68 and the shaft 6. The stress tends to concentrate in an upper end face 10*a* of the screw member 10. The buffering member 70 can effectively relieve the concentration of the stress. In order to relieve the concentration of the stress, examples of a material of the buffering member 70 include a resin, a rubber and the like. Examples of the resin include a thermoplastic resin, a thermosetting resin and the like. Examples of the thermoplastic resin include a thermoplastic elastomer. Examples of the thermoplastic elastomer include a thermoplastic urethane elastomer having a hard segment and a soft segment. For the resin, cellulose acetate, cellulose nitrate, an ABS resin and polypropylene are preferable and the cellulose acetate is more preferable.

Figure 13:
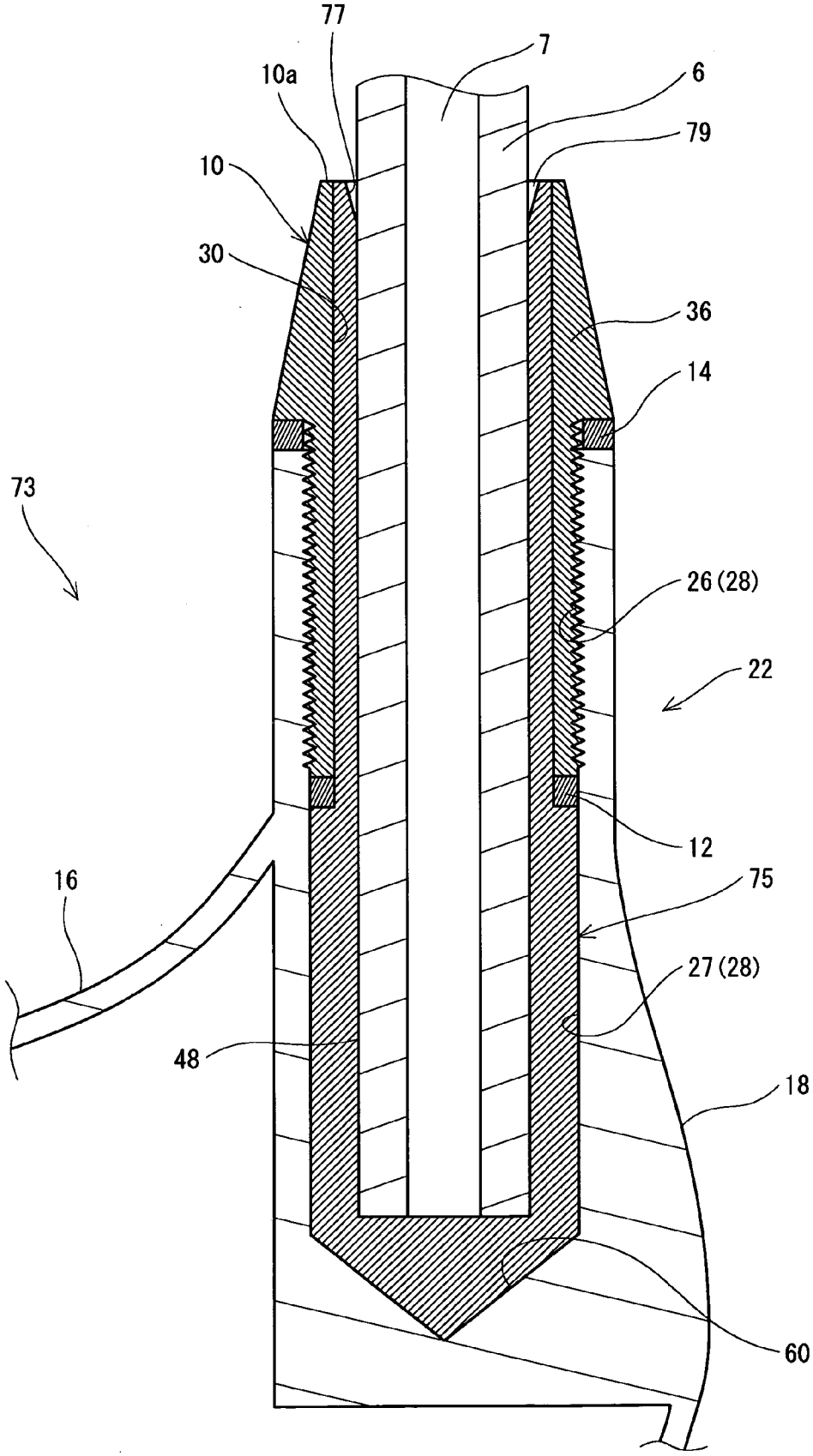
FIG. 13 is a sectional view showing a golf club according to a third embodiment, which is taken along a shaft axis.

FIG. 13 is a sectional view showing the vicinity of a hosel in a head 73 according to a third embodiment. A structure of the head 73 is the same as that of the head 4 except for a shape of an upper end of an inner member 75. An inclined surface 77 is provided on an upper end of an internal surface of the inner member 75. The inclined surface 77 is tapered. The inclined surface 77 is a conical recess surface. The inclined surface 77 is inclined apart from a shaft 6 in an upward direction. The inclined surface 77 is inclined to increase an inside diameter of the inner member 75 in the upward direction. By the inclined surface 77, a space 79 is maintained between the inner member 75 and the shaft 6. By the inclined surface 77, it is possible to relieve a concentration of a stress on the shaft 6 which tends to be generated on the upper end face 10*a* of a screw member 10. In the third embodiment, it is possible to relieve the concentration of the stress without providing a buffering member.

Figure 14:
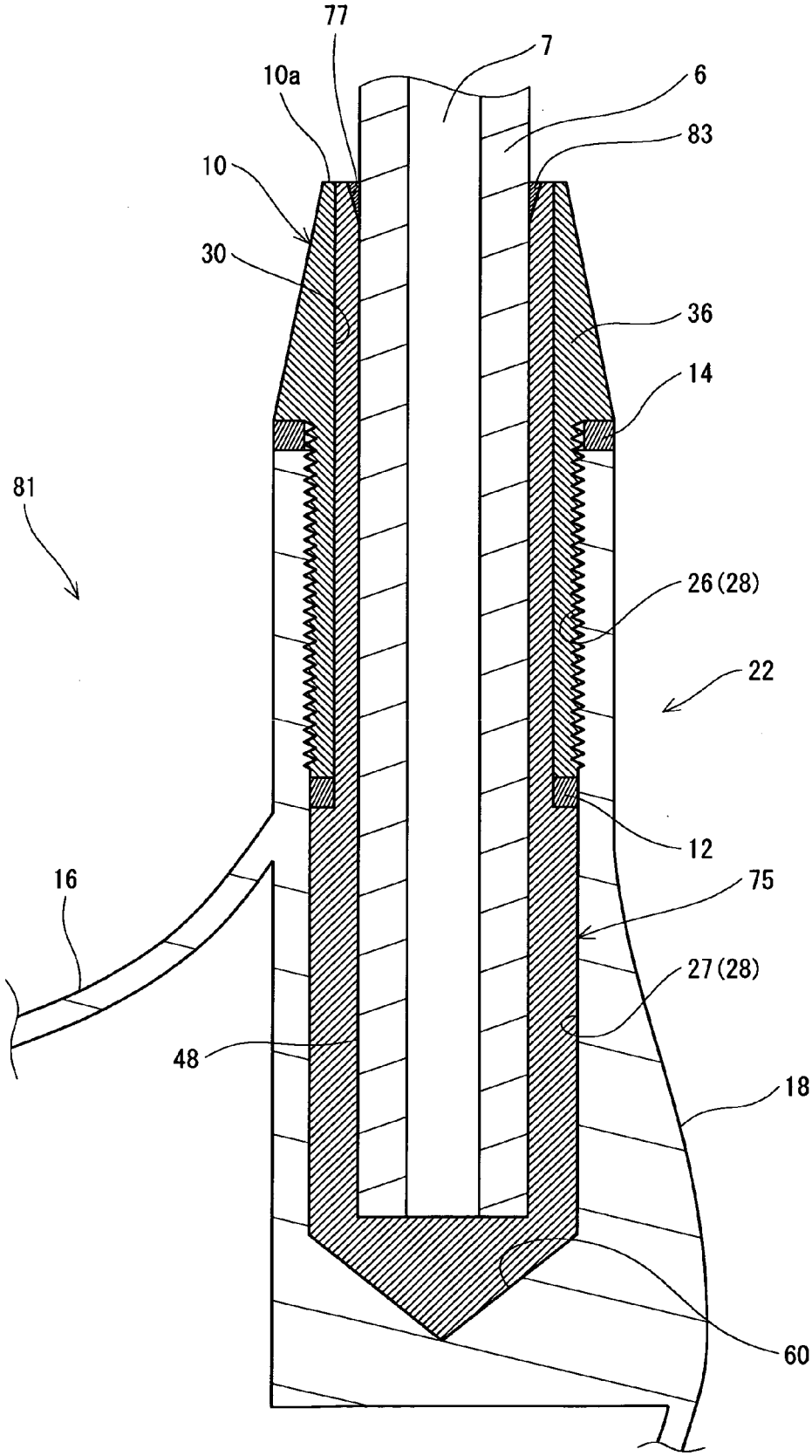
FIG. 14 is a sectional view showing a golf club according to a fourth embodiment, which is taken along a shaft axis.

FIG. 14 is a sectional view showing the vicinity of a hosel in a head 81 according to a fourth embodiment. A structure of the head 81 is the same as that of the head 73 except for presence of a buffering member 83. In the head 81, the space 79 is occupied by the buffering member 83. An external surface of the buffering member 83 is inclined. The external surface of the buffering member 83 is a conical projection surface. The external surface of the buffering member 83 abuts on an inclined surface 77. An inside diameter of the buffering member 83 is constant. An outside diameter of the buffering member 83 is increased in the upward direction. An upper end face of the buffering member 83 is substantially on the same plane with the upper end face 10*a* of a screw member 10. By the buffering member 83, it is possible to still more relieve a concentration of a stress on a shaft 6 which tends to be generated on the upper end face 10*a* of the screw member 10.

Figure 15:
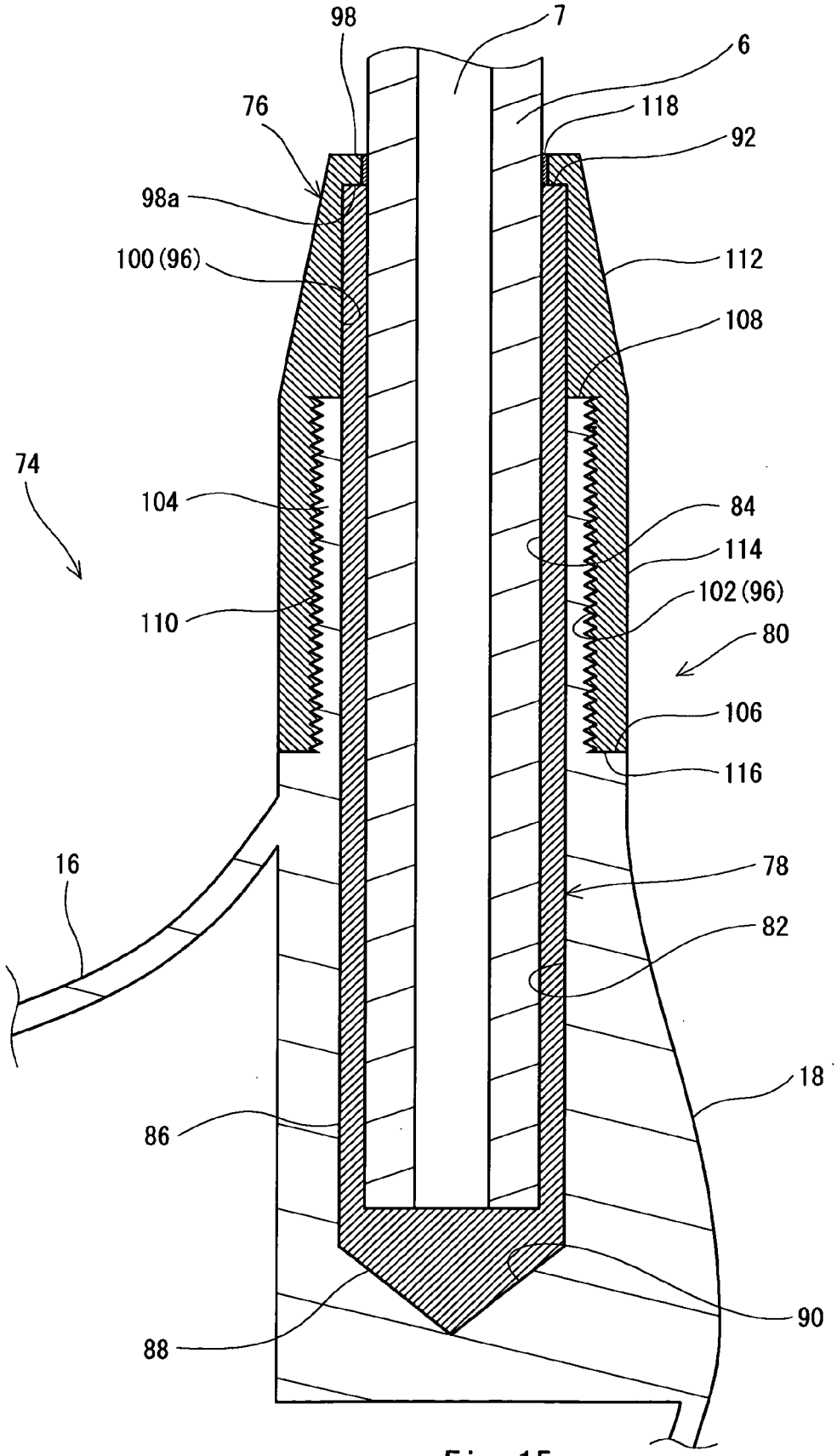
FIG. 15 is a sectional view showing a golf club according to a fifth embodiment, which is taken along a shaft axis.

In the embodiments, the screw portion of the hosel portion is a female screw and the screw portion of the screw member 10 is a male screw. To the contrary, the screw portion of the hosel portion may be the male screw and the screw portion of the screw member may be the female screw. In this case, there is employed a structure in which the male screw is formed on the external surface of the hosel portion and the female screw is formed on the internal surface of the screw member, and the female screw of the screw member is fixed into the outside of the male screw of the hosel portion. FIG. 15 shows an embodiment illustrating an example of the structure.

FIG. 15 is a sectional view showing a head 74 according to a fifth embodiment of the present invention. In the head 74, a screw portion of a hosel portion is a male screw and a screw portion of a screw member is a female screw. The head 74 according to the fifth embodiment has a screw member 76, an inner member 78 and a hosel portion 80. The hosel portion 80 has a hosel hole 82. The inner member 78 has a shaft inserting hole 84. A shaft 6 is inserted and bonded into the shaft inserting hole 84.

The inner member 78 has a cylindrical portion 86 and a lower surface 88. A configuration of the lower surface 88 is the same as that of the lower surface 42 of the inner member 8. A configuration of a receiving surface 90 abutting on the lower surface 88 is the same as the receiving surface 60.

The inner member 8 has the upward surface 44 in the middle position in the longitudinal direction. On the other hand, the inner member 78 according to the present embodiment has no upward surface in a middle position in a longitudinal direction thereof. An outside diameter of the inner member 78 is constant excluding the receiving surface 90. More specifically, an outside diameter of the cylindrical portion 86 is constant. The inner member 78 has no step surface.

An upward surface 92 of the inner member 78 serves as an upper end face of the inner member 78. The upward surface 92 is engaged with the screw member 76.

The screw member 76 has a through hole 96 and an inward extended portion 98. The screw member 76 has a screw portion 102. The screw portion 102 is a female screw. The through hole 96 is constituted by a non-screw portion 100 and the screw portion 102. An inside diameter of the screw portion 102 is larger than that of the non-screw portion 100.

The hosel portion 80 has a cylindrical portion 104, an upward surface 106 and an upper end face 108. A through hole penetrating the cylindrical portion 104 constitutes a part of the hosel hole 82. The upward surface 106 is positioned on a lower end of the cylindrical portion 104. The upper end face 108 constitutes an upper end of the cylindrical portion 104.

An external surface of the cylindrical portion 104 is set to be a screw portion 110. The screw portion 110 is a male screw. The screw portion 110 to be the male screw and the screw portion 102 to be a female screw are coupled to each other.

A lower surface 98*a* of the inward extended portion 98 is directly engaged with the upward surface 92 to be the upper end face of the inner member 78. The lower surface 98*a* is a downward surface of the screw member 76. The engagement may be indirectly carried out through a washer or the like. In the screw member 76, the inward extended portion 98 is protruded inward in a radial direction from the non-screw portion 100 of the through hole 96. The inward extended portion 98 takes an annular shape. The inward extended portion 98 may be a projection, for example. By the engagement of the inward extended portion 98 and the upward surface 92, the inner member 78 is controlled to be moved upward with respect to the hosel hole 82.

An external surface of the screw member 76 has a tapered surface 112 and a circumferential surface 114. The tapered surface 112 is positioned on an upper side of the circumferential surface 114. The tapered surface 112 and the circumferential surface 114 are continuously provided without a step. A lower end face 116 of the screw member 76 directly abuts on the upward surface 106. The abutment may be indirectly carried out through a washer or the like. An outside diameter of the lower end face 116 is substantially equal to that of the upward surface 106. The external surface of the screw member 76 and that of the hosel portion 80 are continuously provided substantially without a step at the lower end of the screw member 76. Consequently, the beauty of the head is enhanced. An outside diameter of the tapered surface 112 is reduced in the upward direction. The tapered surface 112 takes the same shape as that of a so-called ferrule. The beauty of the head is enhanced by the tapered surface 112.

A buffering member 118 is provided between the inward extended surface 98 and the shaft 6. The buffering member 118 takes an annular shape. The buffering member 118 relieves a concentration of a stress on an upper surface of the inward extended surface 98 so that a durability of the shaft 6 can be enhanced. A preferable material of the buffering member 118 is the same as that of the buffering member 70.

The configurations of the lower surface of the inner member and the receiving surface are not restricted to those in the embodiments. It is sufficient that the rotation of the inner member with respect to the hosel hole is controlled through the engagement of the lower surface of the inner member with the receiving surface. In the lower surface of the inner member, recesses and projections formed by two adjacent planes takes a sectional shape of a triangle. The sectional shape may be rectangular or trapezoidal. Moreover, surfaces constituting the lower surface of the inner member and the receiving surface are not restricted to planes but may be curved surfaces.

It is preferable that the lower surface of the inner member should have at least one projection or recess, the receiving surface should have at least one recess or projection which can come in face contact with the projection or recess of the lower surface, and the projection present on the lower surface of the inner member or the receiving surface should take a tapered sectional shape. This respect has been described above.

In the lower surface of the inner member or the receiving surface, the edge line r may be replaced with a surface. The surface can be formed by chamfering the edge line r according to the embodiments, for example. In this case, the projection formed on the lower surface of the inner member or the receiving surface takes a sectional shape of a trapezoid. The trapezoid takes a tapered shape. In the lower surface of the inner member or the receiving surface, moreover, the valley line t may be replaced with a surface.

A plane pv which is perpendicular to the shaft axis Z1 may be present on the lower surface of the inner member and the receiving surface. In order to enhance the effect of controlling a relative rotation of the inner member and the hosel hole, it is preferable that the plane pv should not be present on the lower surface of the inner member and the receiving surface. The effect of controlling a relative rotation of the inner member and the hosel hole will be hereinafter referred to as a "relative rotation controlling effect".

It is preferable that the lower surface of the inner member should have a rotational symmetry in which the central axis Z2 of the inner member 8 is set to be a rotational symmetric axis. The rotational symmetry implies that a coincidence with a shape before a rotation is obtained when a rotation of (360/N) degrees is carried out around the rotational symmetric axis. N is an integer of two or more. It is preferable that the receiving surface should also have the rotational symmetry in which the central axis Z2 (the central axis Z3) is set to be the rotational symmetric axis. A coincidence with a shape before a rotation of (360/N) degrees around the rotational symmetric axis will also be referred to as an "N-fold rotational symmetry". By the rotational symmetry, it is possible to increase the degree of freedom for fitting of the lower surface of the inner member in the receiving surface, thereby engaging the lower surface of the inner member with the receiving surface easily.

In the inner member 8 according to the embodiment, the lower surface 42 has the rotational symmetry in which the central axis Z2 is set to be the rotational symmetric axis. The lower surface 42 is six-fold rotational symmetric with the central axis Z2 set to be the rotational symmetric axis. The receiving surface 60 is also six-fold rotational symmetric. The lower surface 42 and the receiving surface 60 are three-fold rotational symmetric as well as two-fold rotational symmetric, and the N has a maximum value of six. It is preferable that the N of the lower surface 42 should be equal to that of the receiving surface 60. It is preferable that the maximum value of the N of the lower surface 42 should be equal to that of the N of the receiving surface 60.

In order to enhance the relative rotation controlling effect and to increase the degree of freedom for the fitting of the lower surface in the receiving surface, the maximum value of the N in the rotational symmetry is preferably equal to or greater than three, is more preferably equal to or greater than four and is further preferably equal to or greater than six. In the case in which the maximum value of the N is great, the projection takes a sharp shape or a width of the projection is reduced. Therefore, a durability of the projection tends to be deteriorated. From this viewpoint, the maximum value of the N is preferably equal to or smaller than 20, is more preferably equal to or smaller than 12 and is further preferably equal to or smaller than eight.

In the present invention, the lower surface of the inner member and the receiving surface do not need to be engaged with each other. For example, the internal surface of the hosel hole and the side surface of the inner member may be engaged with each other, and the rotation of the inner member with respect to the hosel hole may be controlled through the engagement. In the present invention, moreover, it is not necessary to control the rotation through the engagement of the inner member with the hosel hole. For example, the lower surface of the inner member may be pressed against the receiving surface of the hosel portion by the axial force of the screw coupling and the rotation of the inner member with respect to the hosel hole may be controlled by a frictional force generated by the pressing. In this case, both the lower surface of the inner member and the receiving surface may be planes which are perpendicular to the shaft axis Z1.

For the configuration to engage the inner member with the hosel portion, it is possible to propose a configuration in which the inner member is provided with a projection which is protruded outward in a radial direction and the hosel portion is provided with a notch extended downward from the end face thereof. By fitting the projection of the inner member in the notch of the hosel portion, it is possible to control the relative rotation of the inner member and the hosel portion. In this case, the notch of the hosel portion can be visually recognized from an outside. Therefore, a different appearance from that of a conventional golf club is obtained. In respect of a beauty, accordingly, this configuration is not preferable as compared with the present invention.

A material of the head is not restricted. Examples of the material of the head include titanium, a titanium alloy, CFRP (carbon fiber reinforced plastic), stainless steel, maraging steel, a magnesium alloy, an aluminum alloy, iron and the like. It is also possible to employ a head obtained by combining a plurality of materials. It is also possible to employ a head obtained by bonding a head body fabricated through casting to a face portion fabricated through forging or pressing.

A structure of the head is not restricted. The head may be wholly formed integrally or may be obtained by bonding a plurality of members. A method of manufacturing the head is not restricted. Examples of the method of manufacturing the head include casting such as lost wax precision casting, forging and the like.

A material of the shaft is not restricted. Examples of the material of the shaft include CFRP (carbon fiber reinforced plastic) and a metal. It is possible to suitably use a so-called carbon shaft or steel shaft. Moreover, a structure of the shaft is not restricted.

A material of the inner member is not restricted. In order to suppress an increase in a weight of the club, it is preferable that the inner member should have a small weight. From this viewpoint, a specific gravity of the inner member is preferably equal to or smaller than 4.6 and is more preferably equal to or smaller than 4.5. In order to prevent a breakage from being caused by an impact of hitting, it is preferable that the inner member should have a high strength. From these viewpoints, a preferable material of the inner member includes aluminum, an aluminum alloy, titanium, a titanium alloy, magnesium, a magnesium alloy, CFRP (carbon fiber reinforced plastic), a resin and the like.

A material of the screw member is not restricted. In order to suppress an increase in the weight of the club, it is preferable that the screw member should have a small weight. From this viewpoint, a specific gravity of the screw member is preferably equal to or smaller than 4.6 and is more preferably equal to or smaller than 4.5. In order to prevent the breakage from being caused by the impact of the hitting, it is preferable that the screw member should have a high strength. From these viewpoints, a preferable material of the screw member includes aluminum, an aluminum alloy, titanium, a titanium alloy, magnesium, a magnesium alloy, CFRP (carbon fiber reinforced plastic), a resin and the like.

A material of the washer (the interposed member) is not restricted. In order to suppress an increase in the weight of the club, it is preferable that the washer should have a small weight. From this viewpoint, a specific gravity of the washer is preferably equal to or smaller than 4.6 and is more preferably equal to or smaller than 4.5. In order to prevent the breakage from being caused by the impact of the hitting, it is preferable that the washer should have a high strength. From these viewpoints, a preferable material of the washer includes aluminum, an aluminum alloy, titanium, a titanium alloy, magnesium, a magnesium alloy, CFRP (carbon fiber reinforced plastic), a rubber, a resin and the like. As described above, moreover, the washer is preferably formed by an elastic member and is more preferably formed by the rubber or the resin. A preferable material of the washer (the interposed member) is the same as that of the buffering member 70.

A double arrow A in FIG. 8 indicates a diameter of the shaft inserting hole. In order to easily insert the shaft, when the outside diameter of the shaft in the portion to be inserted into the shaft inserting hole is set to be D1 mm, the diameter A is preferably equal to or greater than (D1+0.02) mm, is more preferably equal to or greater than (D1+0.03) mm and is further preferably equal to or greater than (D1+0.04) mm. In order to increase a bonding strength to the shaft, A is preferably equal to or smaller than (D1+0.20) mm, is more preferably equal to or smaller than (D1+0.15) mm, and is further preferably equal to or smaller than (D1+0.10) mm. Usually, the outside diameter D1 of the shaft is equal to or greater than 8.5 mm and is equal to or smaller than 10.0 mm.

A double arrow B in FIG. 8 indicates an outside diameter (mm) of the small diameter portion. In order to enhance a durability of the inner member, a thickness of the small diameter portion [(B−A)/2] is preferably equal to or greater than 0.25 mm, is more preferably equal to or greater than 0.30 mm and is further preferably equal to or greater than 0.40 mm. In order to control a weight of the inner member and to prevent a center of gravity of the head from being excessively close to a heel, the thickness of the small diameter portion [(B−A)/2] is preferably equal to or smaller than 1.50 mm, is more preferably equal to or smaller than 1.20 mm and is further preferably equal to or smaller than 0.8 mm.

A double arrow C in FIG. 8 indicates an outside diameter (mm) of the large diameter portion 54. In order to enhance the durability of the inner member, a width in a radial direction of the upward surface [(C−B)/2] is preferably equal to or greater than 0.25 mm, is more preferably equal to or greater than 0.30 mm and is further preferably equal to or greater than 0.40 mm. In order to control the weight of the inner member and to prevent the center of gravity of the head from being excessively close to the heel, the width in the radial direction of the upward surface [(C−B)/2] is preferably equal to or smaller than 1.50 mm, is more preferably equal to or smaller than 1.20 mm and is further preferably equal to or smaller than 0.8 mm.

A double arrow D in FIG. 8 indicates a length in an axial direction of the small diameter portion. The length D is measured along the central axis Z2 of the inner member. In order to increase a length in an axial direction of the screw portion of the screw member, thereby enhancing a fastening force of the screw coupling, the length D is preferably equal to or greater than 11 mm, is more preferably equal to or greater than 15 mm and is further preferably equal to or greater than 20 mm. If the length D is too great, the size of the screw member is increased excessively so that the weight of the head tends to be increased excessively. From this viewpoint, the length D is preferably equal to or smaller than 35 mm, is more preferably equal to or smaller than 31 mm and is further preferably equal to or smaller than 28 mm.

A double arrow E in FIG. 8 indicates a depth of the shaft inserting hole 40. The depth E is measured along the central axis Z2. In order to increase the bonding strength to the shaft, the depth E is preferably equal to or greater than 25 mm, is more preferably equal to or greater than 30 mm and is further preferably equal to or greater than 35 mm. In order to prevent the weight from being increased excessively, the length E is preferably equal to or smaller than 45 mm, is more preferably equal to or smaller than 43.5 mm and is further preferably equal to or smaller than 42 mm.

A double arrow F in FIG. 8 indicates a length in an axial direction of the lower surface of the inner member. The length F is measured along the central axis Z2. In order to enhance the relative rotation controlling effect, the length F is preferably equal to or greater than 3 mm, is more preferably equal to or greater than 4 mm and is further preferably equal to or greater than 5 mm. In order to control the weight, the length F is preferably equal to or smaller than 10 mm, is more preferably equal to or smaller than 9 mm and is further preferably equal to or smaller than 8 mm.

A double arrow G in FIG. 3 indicates a thickness of the upper end face of the screw member. The thickness G is measured in the radial direction. In respect of the strength of the screw member, the thickness G is preferably equal to or greater than 0.5 mm, is more preferably equal to or greater than 0.6 mm and is further preferably equal to or greater than 0.7 mm. In order to prevent the weight from being increased excessively, the thickness G is preferably equal to or smaller than 2 mm, is more preferably equal to or smaller than 1.5 mm and is further preferably equal to or smaller than 1 mm. A preferable range of the thickness of the screw portion in the screw member 10 (a thickness in the radial direction) is the same as that of the thickness G and the reason for the preferable thickness is also the same as that for the thickness G.

A double arrow H in FIG. 3 indicates a thickness of the tapered surface provided in the exposed portion of the screw member. The thickness H is measured in the radial direction. In order to increase the strength of the screw member, the thickness H is preferably equal to or greater than 0.5 mm, is more preferably equal to or greater than 0.7 mm and is further preferably equal to or greater than 0.9 mm. In order to prevent the weight from being increased excessively, the thickness H is preferably equal to or smaller than 2 mm, is more preferably equal to or smaller than 1.7 mm and is further preferably equal to or smaller than 1.3 mm.

A double arrow M in FIG. 3 indicates a hole diameter of the non-screw portion 27 in the hosel hole 28. In order to reliably support the inner member through the hosel hole, it is preferable that the outside diameter C of the large diameter portion 54 should be almost equal to the hole diameter M of the non-screw portion 27. More specifically, it is preferable that the outside diameter C (mm) and the hole diameter M (mm) should satisfy the following expression.

$$[M-0.20] \leqq C \leqq M$$

As described above, in the embodiments, the shaft 6 and the head 4 are fixed to each other through the engagement of the downward surface 56 and the upward surface 44 and the engagement of the receiving surface 60 and the lower surface 42. As described above, it is possible to implement the golf club 2 in which the head and the shaft can freely be attached to and removed from each other with a simple structure. The screw portion on the head side can easily be fabricated if the head has an ordinary hosel. More specifically, the present invention can be applied to a head having a general structure and has a high universality.

Figure 16:
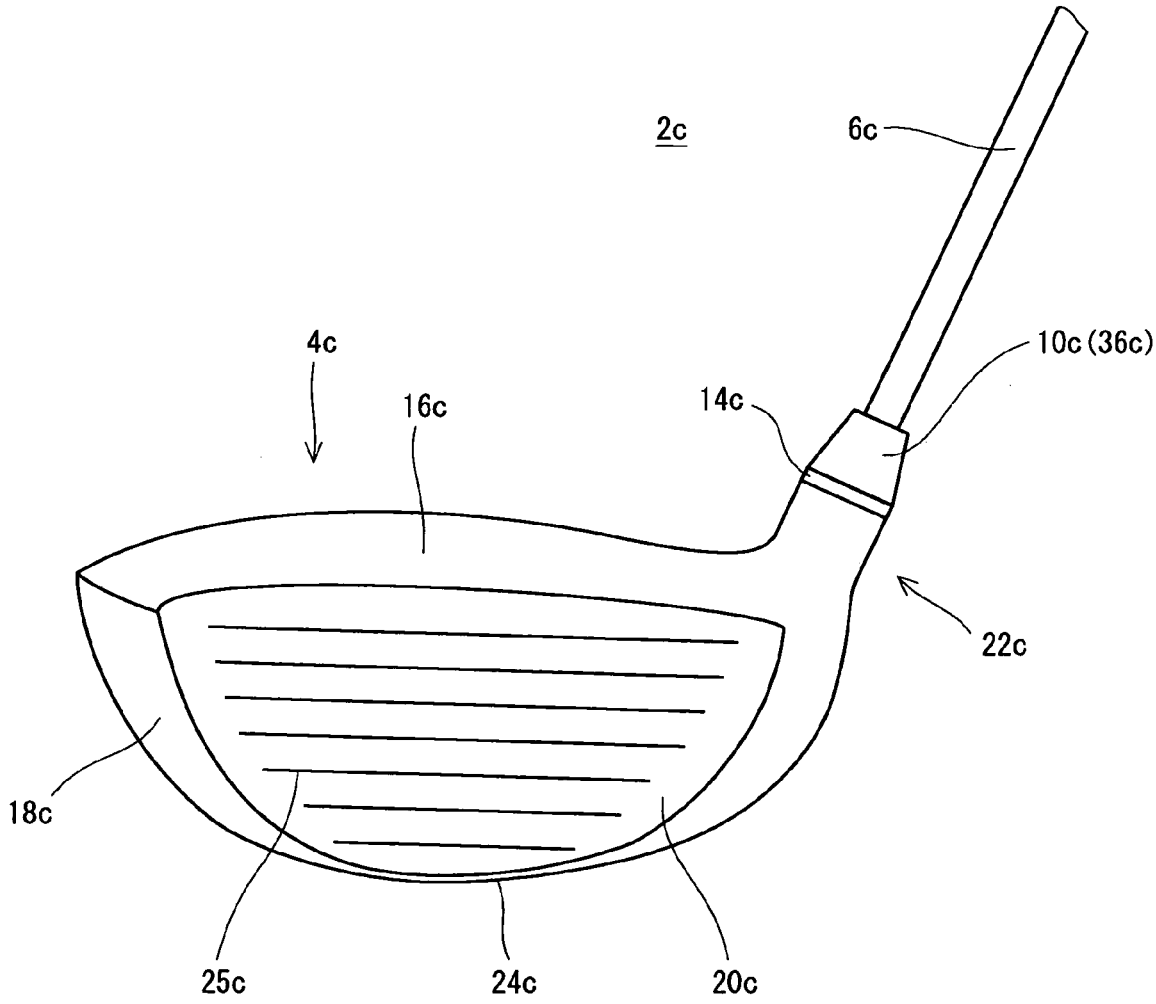
FIG. 16 is a view showing a part of a golf club according to a sixth embodiment of the present invention.
Figure 17:
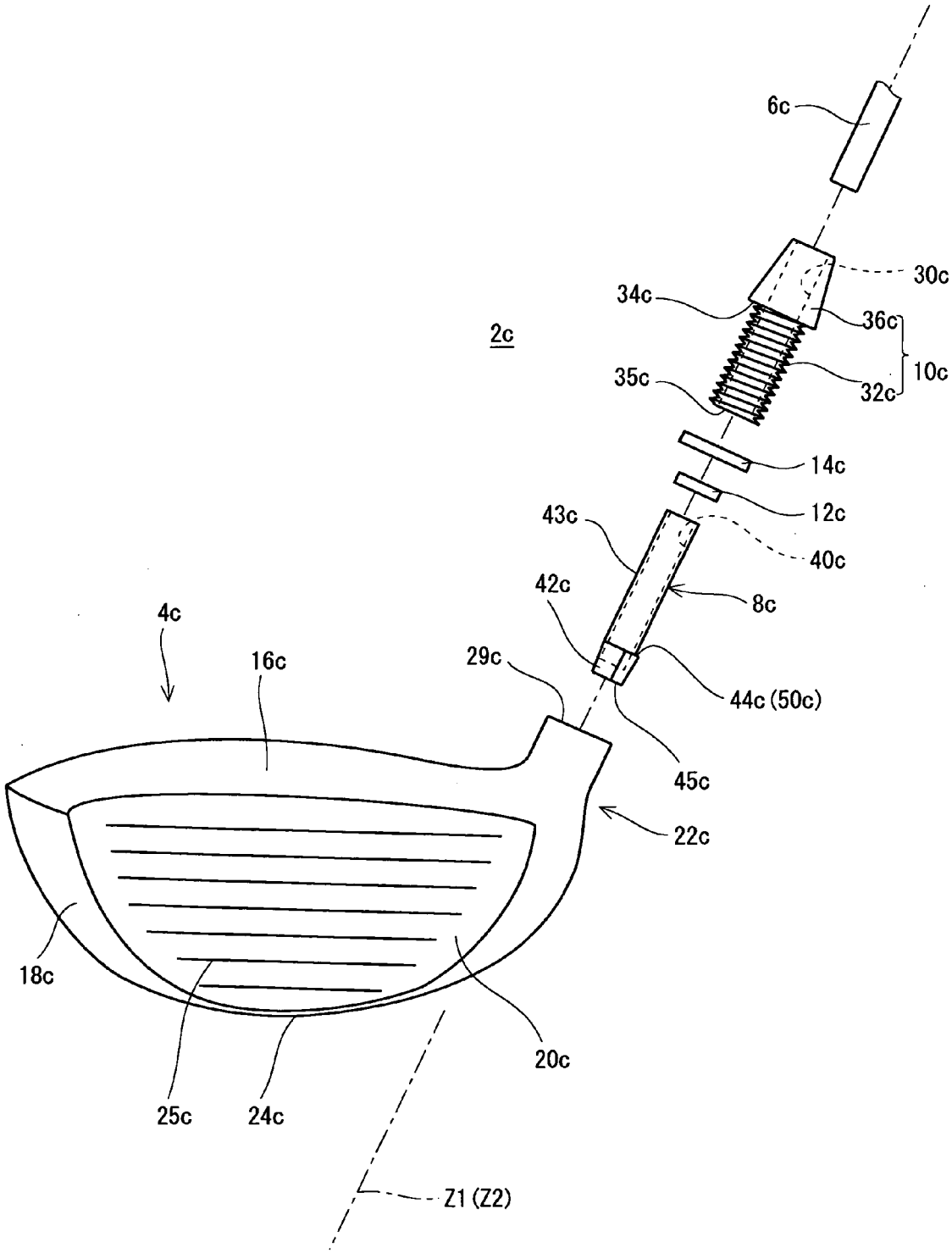
FIG. 17 is an exploded view showing the golf club of FIG. 16.

FIG. 16 is a view showing a part of a golf club 2*c* according to a sixth embodiment of the present invention and FIG. 17 is an exploded view showing the golf club 2*c*. The golf club 2*c* includes a head 4*c* and a shaft 6*c*. The head 4*c* is attached to one of ends of the shaft 6*c*. A grip is attached to the other end of the shaft 6*c*, which is not shown. The shaft 6*c* is tubular.

As shown in FIG. 17, the golf club 2*c* includes an inner member 8*c*, a screw member 10*c*, a washer 12*c* and a washer 14*c*. The inner member 8*c*, the screw member 10*c*, the washer 12*c* and the washer 14*c* are concerned in a bond of the head 4*c* and the shaft 6*c*.

The head 4*c* is a golf club head of a wood type. The head 4*c* has a crown portion 16*c*, a side portion 18*c*, a face portion 20*c*, a hosel portion 22*c* and a sole portion 24*c*. The head 4*c* is hollow. The face portion 20*c* is provided with a face line 25*c*. The head 4*c* may be a golf club head of an iron type or any other type.

Figure 18:
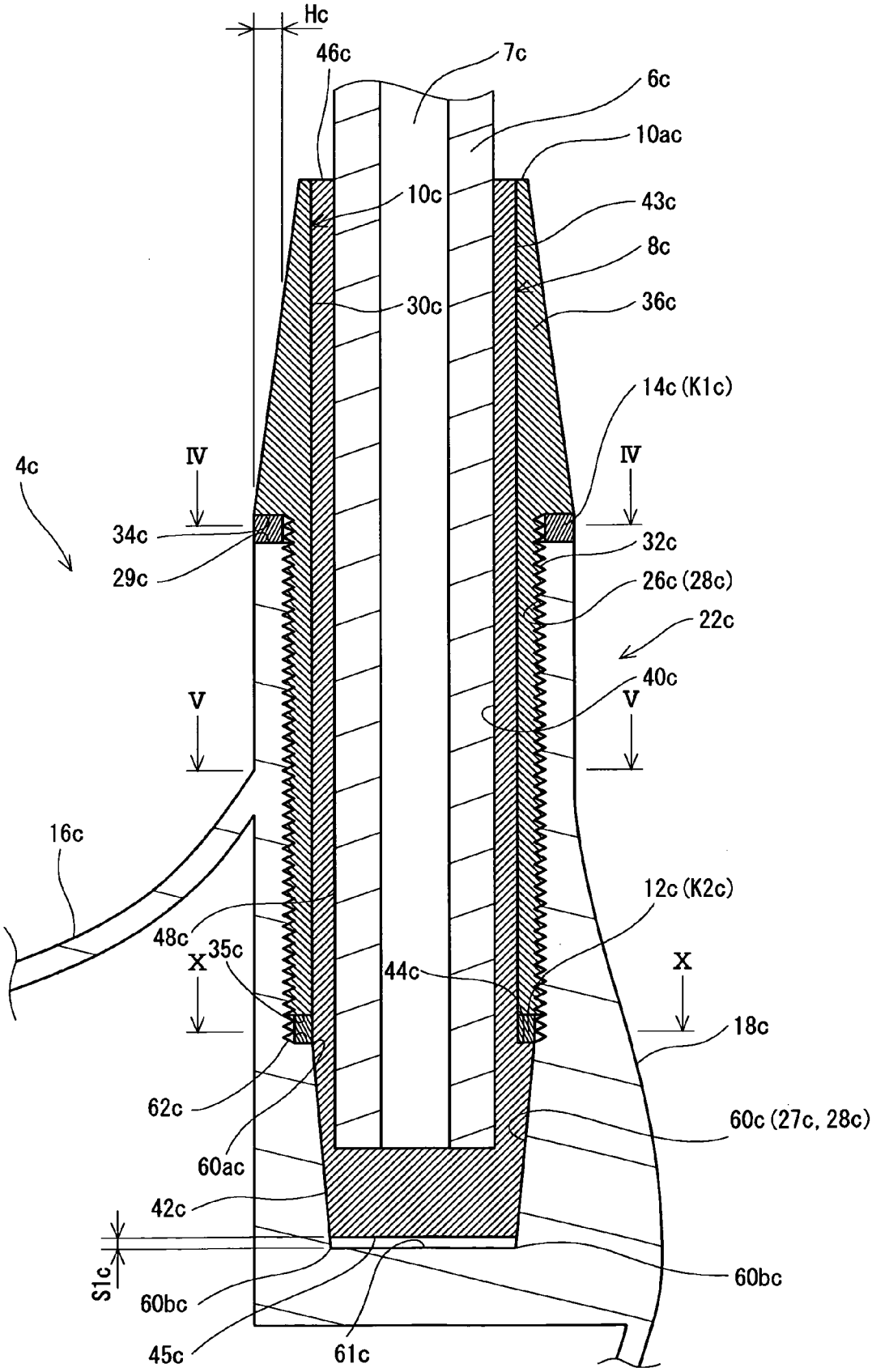
FIG. 18 is a sectional view showing the golf club of FIG. 16, which is taken along a shaft axis.
Figure 19:
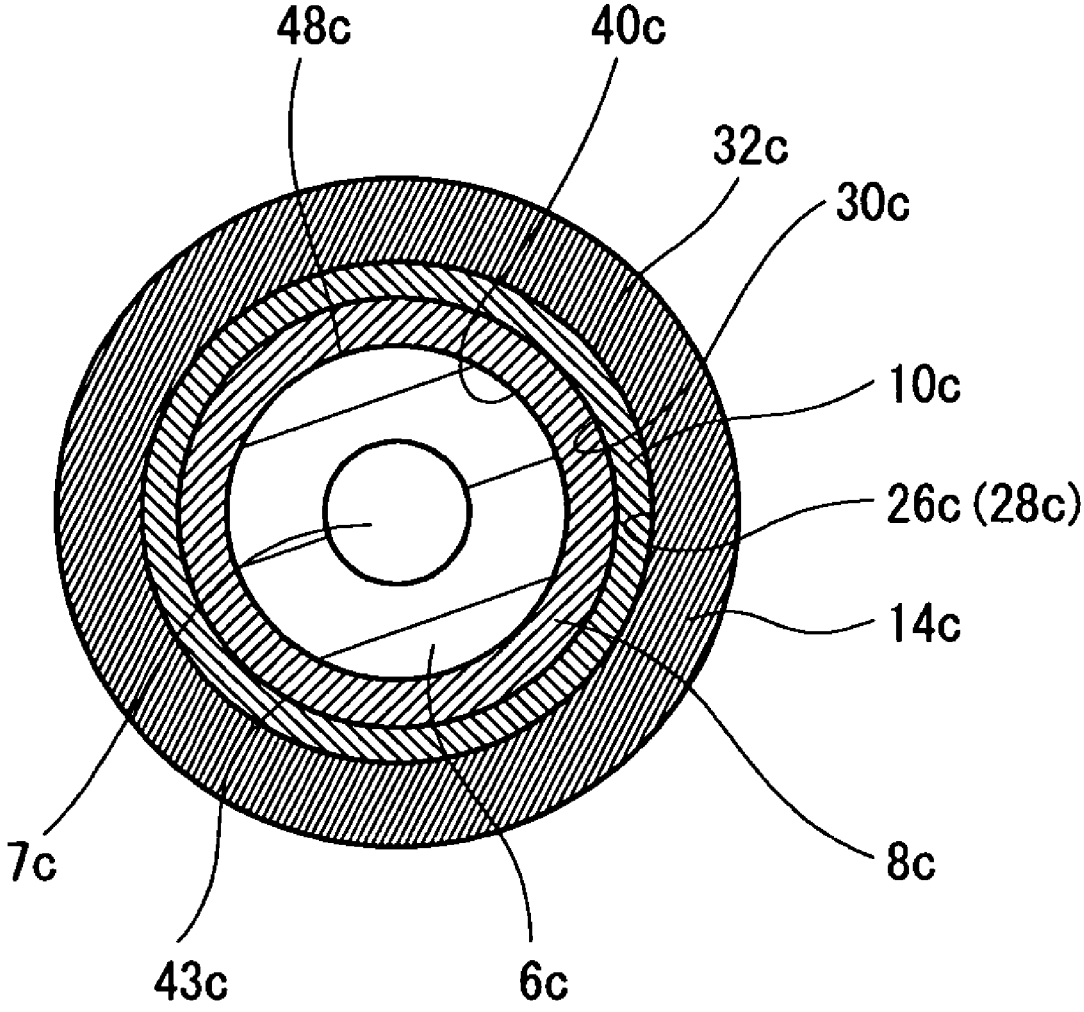
FIG. 19 is a sectional view showing the golf club taken along an IV-IV line in FIG. 18.
Figure 20:
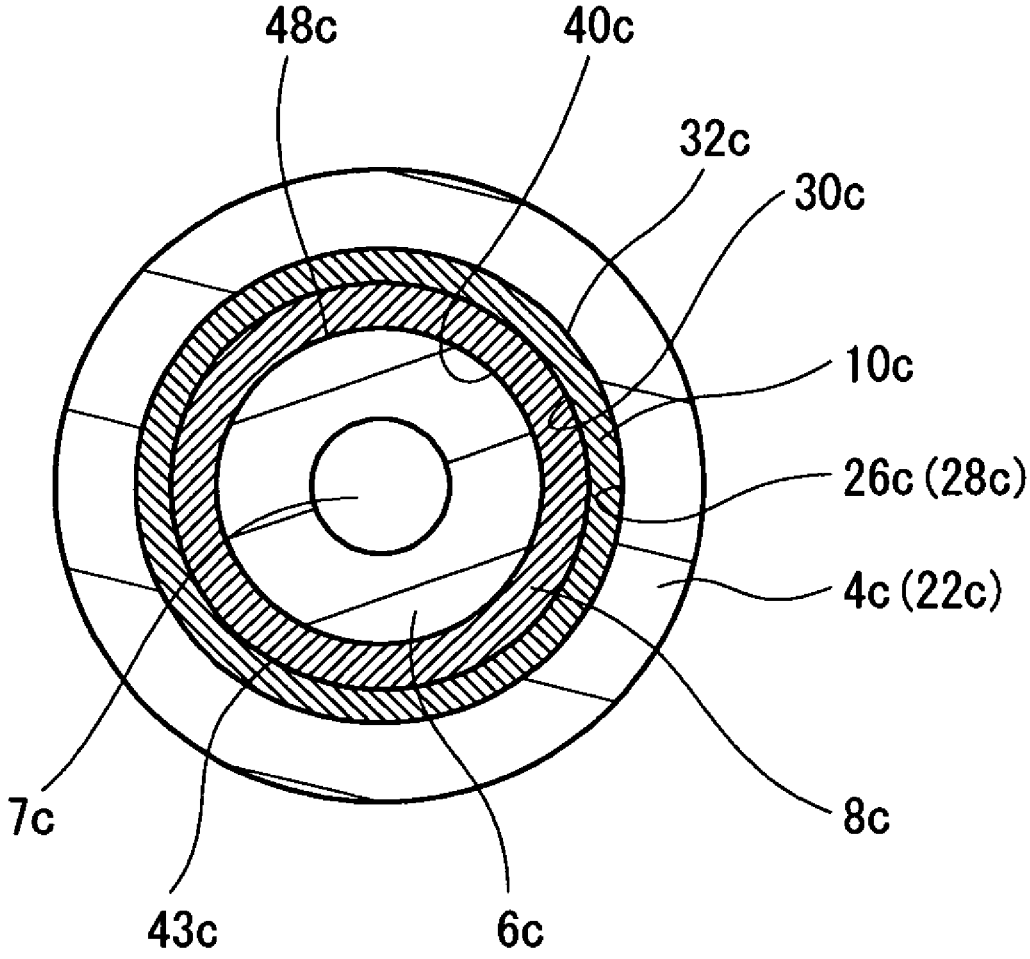
FIG. 20 is a sectional view showing the golf club taken along a V-V line in FIG. 18.

FIG. 18 is a sectional view showing the vicinity of the hosel portion 22*c*. FIG. 18 is a sectional view taken along a plane including the shaft axis Z1. FIG. 19 is a sectional view showing the golf club 2*c* taken along an IV-IV line in FIG. 18. FIG. 20 is a sectional view showing the golf club 2*c* taken along a V-V line in FIG. 18. For easy understanding of the drawings, a sectional shape of a screw portion is not taken into consideration in FIGS. 19 and 20.

The shaft 6*c* has a hollow portion 7*c*. The hosel portion 22*c* has a screw portion 26*c* formed on an internal surface thereof and a hosel hole 28*c*. The screw portion 26*c* constitutes a part of the hosel hole 28*c*. The hosel hole 28*c* has a screw portion 26*c* and a non-screw portion 27*c*. The non-screw portion 27*c* is positioned on a lower side of the screw portion 26*c*. The non-screw portion 27*c* forms a receiving surface which will be described below. As shown in FIG. 18, the screw portion 26*c* is a female screw. The screw portion 26*c* is formed in an upper part of the hosel hole 28*c*. The screw portion 26*c* is provided from an end face 29*c* of the hosel portion 22*c* to a middle position of the hosel hole 28*c*.

The screw member 10*c* has a screw portion 32*c* and an exposed portion 36*c*. The screw portion 32*c* has a downward surface 35*c*. The exposed portion 36*c* has a downward surface 34*c*. The through hole 30*c* penetrates the screw portion 32*c* and the exposed portion 36*c*. A lower part of the screw member 10*c* is set to be the screw portion 32*c*. The screw portion 32*c* constitutes a part of an external surface of the screw member 10*c*. The screw portion 32*c* is a male screw. An internal surface of the screw portion 32*c* serves as the through hole 30*c*. An upper part of the screw member 10*c* is set to be the exposed portion 36*c*. The screw portion 32*c* is not visually recognized from an outside. In the golf club 2*c*, the exposed portion 36*c* is exposed to the outside. An internal surface of the exposed portion 36*c* serves as the through hole 30*c*.

The downward surface 35*c* is a lower end face of the screw member 10*c*. The downward surface 35*c* is a lower end face of the screw portion 32*c*. The downward surface 35*c* is a plane. The downward surface 35*c* takes an annular shape. The downward surface 35*c* is extended in a radial direction. The downward surface 35*c* may be inclined to the radial direction. The downward surface can receive an upward force.

The downward surface 34*c* is positioned on a boundary between the screw portion 32*c* and the exposed portion 36*c*. The downward surface 34*c* is a step surface. The downward surface 34*c* is a plane. The downward surface 34*c* takes an annular shape. The downward surface 34*c* is extended in the radial direction. An outside diameter of the downward surface 34*c* is larger than an outside diameter (a maximum diameter) of the screw portion 32*c*. In the screw member 10*c*, the outside diameter of the downward surface 34*c* is larger than a maximum diameter in a portion provided under the downward surface 34*c*. The downward surface 34*c* is extended outward in the radial direction from the screw portion 32*c*.

An external surface of the exposed portion 36*c* forms a conical surface (a conical projection surface). An outside diameter of the exposed portion 36*c* is increased in a downward direction. The exposed portion 36*c* has a maximum outside diameter at a lower end thereof. The maximum diameter of the exposed portion 36*c* is substantially equal to an outside diameter of the end face 29*c* of the hosel portion 22*c*.

In an appearance, the exposed portion 36*c* looks like a so-called ferrule. The golf club usually has the ferrule. The appearance of the exposed portion 36*c* is the same as that of the ferrule. The golf club 2*c* has the same appearance as that of an ordinary golf club. A large number of golf players that are familiar with the ordinary golf club do not feel uncomfortable in the appearance of the golf club 2*c*.

The through hole 30*c* penetrates the screw member 10*c*. The through hole 30*c* and the screw member 10*c* are coaxial with each other. The screw member 10*c* and the shaft 6*c* are disposed coaxially. The screw member 10*c* and the inner member 8*c* are disposed coaxially.

The washer 14*c* takes an annular shape. The washer 14*c* is provided between the end face 29*c* of the hosel portion 22*c* and the downward surface 34*c*. An outside diameter of the washer 14*c* is substantially equal to that of the end face 29*c* of the hosel portion 22*c*. The outside diameter of the washer 14*c* is substantially equal to that of the downward surface 34*c*. In an appearance, the washer 14*c* easily seems to be integral with the hosel portion 22*c* or the exposed portion 36*c*. A large number of golf players that are familiar with an ordinary golf club do not feel uncomfortable in the appearances of the washer 14*c* and the hosel portion 22*c*. It is preferable that a color of an external surface of the washer 14*c* should be the same as that of the external surface of the hosel portion 22*c* or the exposed portion 36*c*. For example, the external surfaces of the exposed portion 36*c* and the washer 14*c* may have a black color. The washer 14*c* may be eliminated. In the case in which the washer 14*c* is not provided, the appearance of the golf club 2*c* is substantially identical to that of the ordinary golf club, resulting in no uncomfortable feeling.

As shown in FIG. 18, the screw portion 32*c* of the screw member 10*c* and the screw portion 26*c* of the hosel portion 22*c* are coupled to each other. More specifically, the screw portion 32*c* to be the male screw and the screw portion 26*c* to be the female screw are coupled to each other. Through the screw coupling, the screw member 10*c* is fixed to the head 4*c*.

Figure 21:
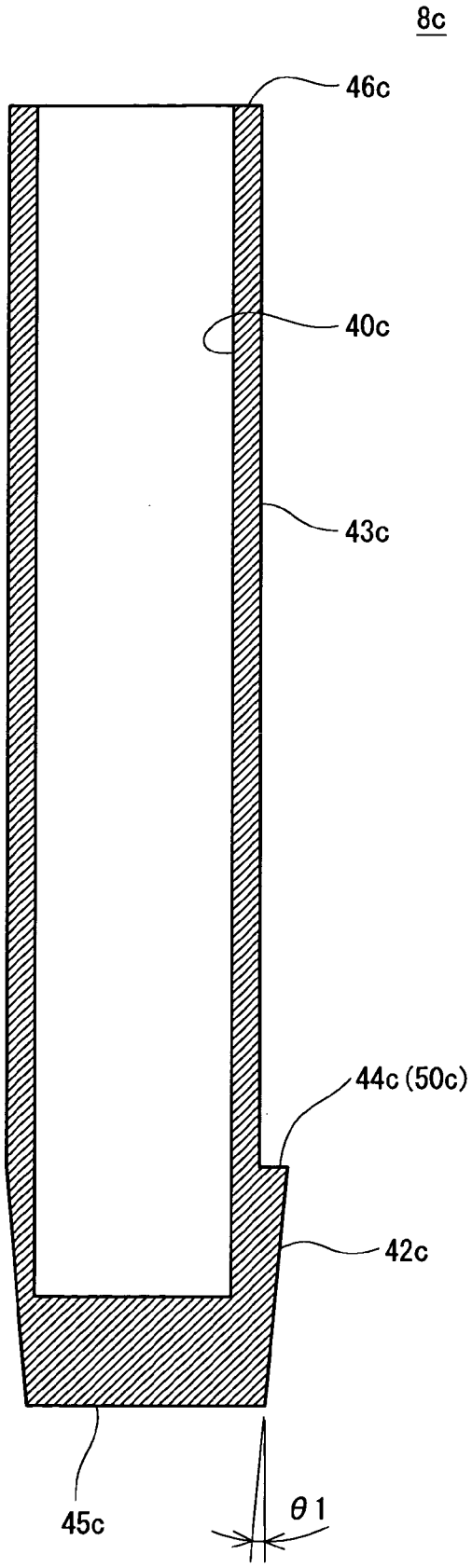
FIG. 21 is a sectional view showing an inner member.
Figure 22:
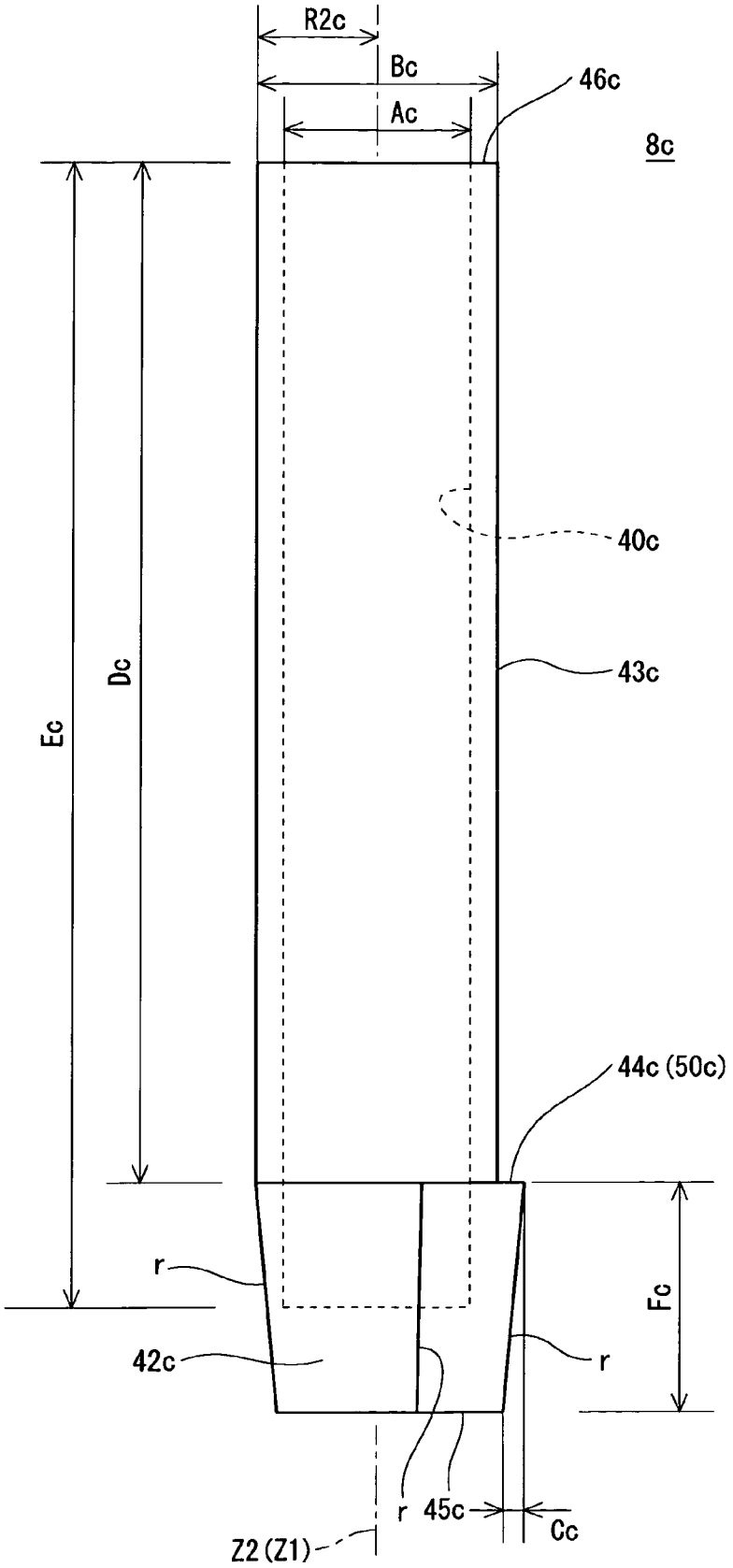
FIG. 22 is a side view showing the inner member.
Figure 23:
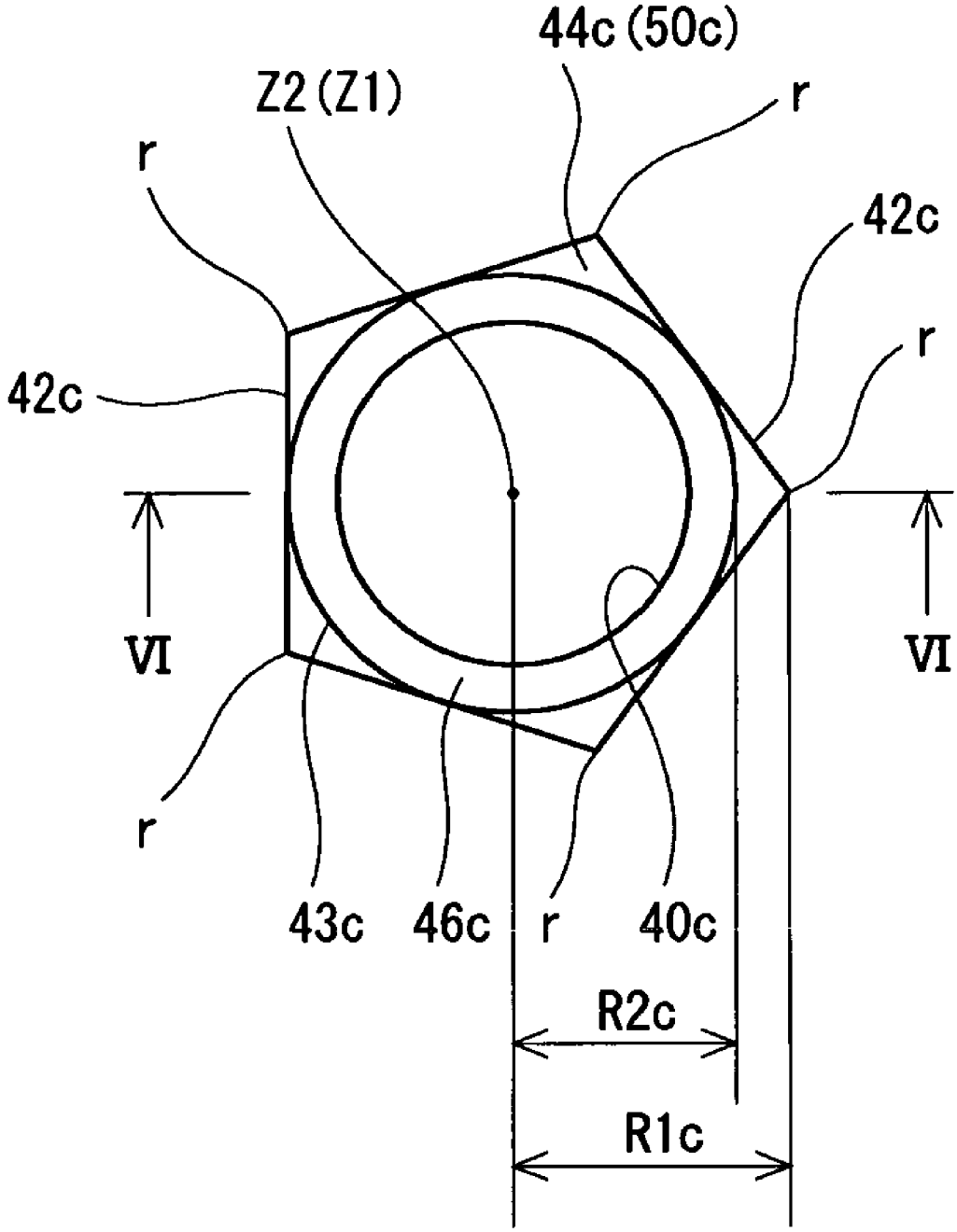
FIG. 23 is a plan view showing the inner member seen from above.
Figure 24:
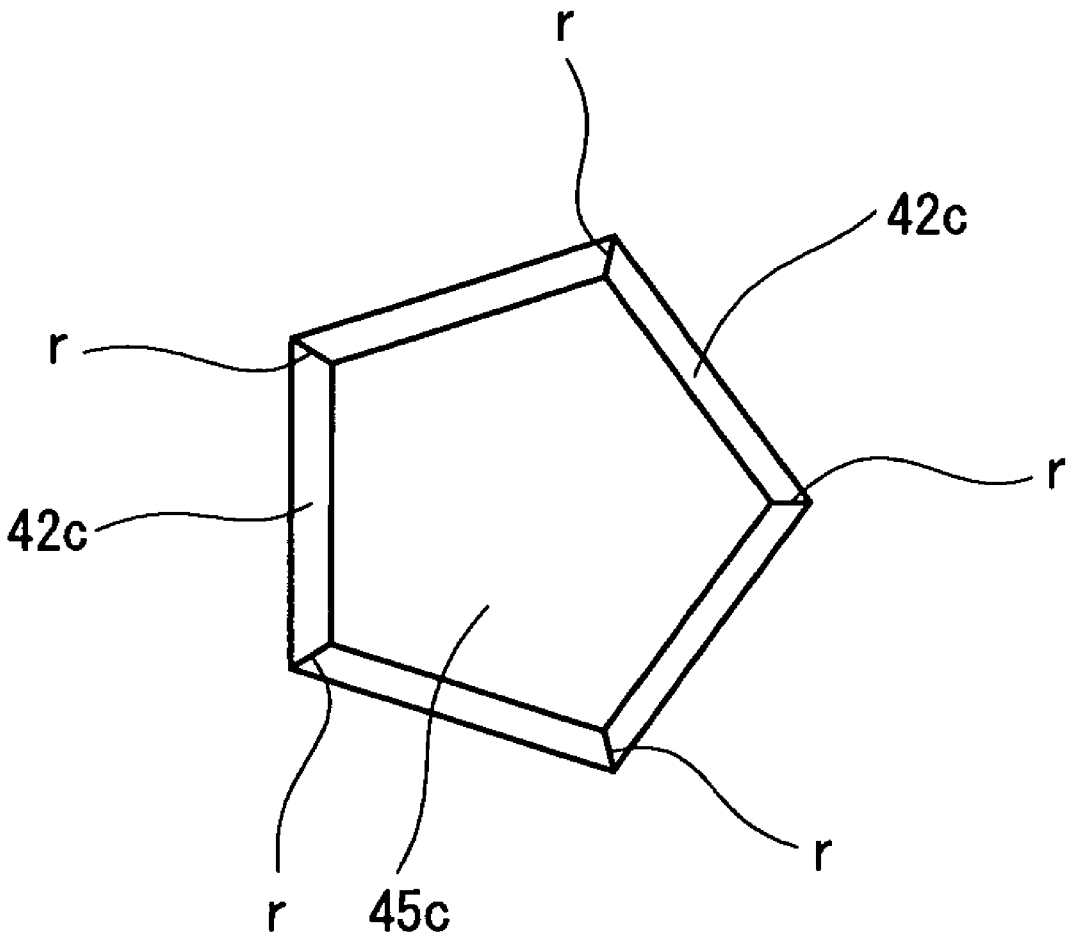
FIG. 24 is a plan view showing the inner member seen from below.
Figure 25:
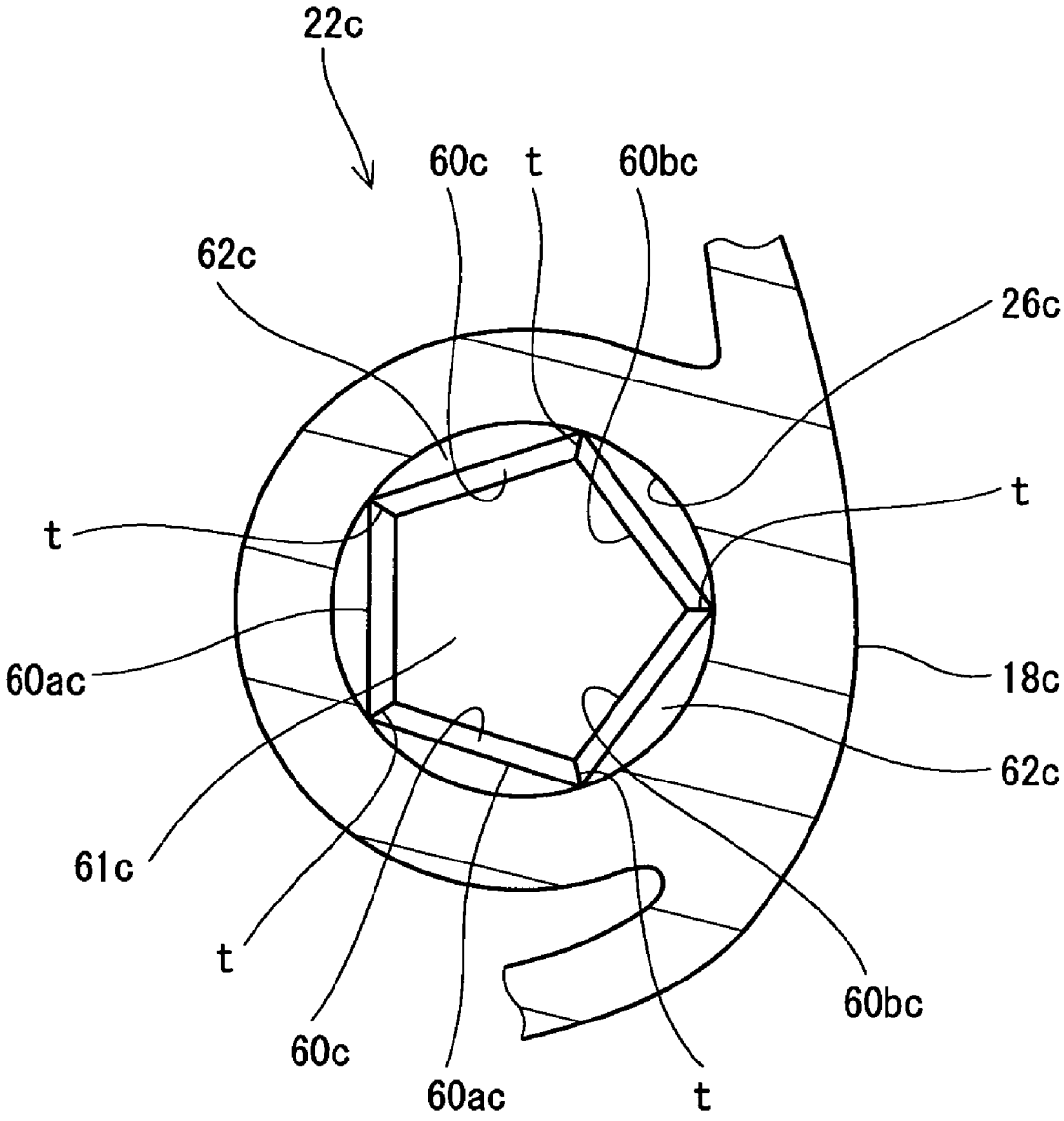
FIG. 25 is a sectional view showing a hosel portion taken along an X-X line in FIG. 18.

FIG. 21 is a sectional view showing the inner member 8*c*. FIG. 21 is a sectional view taken along a plane including the shaft axis Z1. FIG. 22 is a side view showing the inner member 8*c*. FIG. 23 is a plan view showing the inner member 8*c* seen from above. FIG. 24 is a plan view showing the inner member 8*c* seen from below. FIG. 25 is a sectional view showing the hosel portion 22*c* taken along an X-X line in FIG. 18.

The inner member 8*c* has a part inserted in the hosel hole 28*c*. As shown in FIG. 18, a lower part of the inner member 8*c* is inserted in the hosel hole 28*c*. A portion of the inner member 8*c* which is not inserted in the hosel hole 28*c* is positioned on an inside of the exposed portion 36*c* in the screw member 10*c* and an inside of the washer 14*c*.

As shown in FIG. 21 and the like, the inner member 8*c* has a shaft inserting hole 40*c*, an engaging side surface 42*c*, a cylindrical surface 43*c*, an upward surface 44*c* and a bottom face 45*c*. The shaft inserting hole 40*c* is opened on an upper end side of the inner member 8*c*. The shaft inserting hole 40*c* is opened on an upper end face 46*c* of the inner member 8*c*. The bottom face 45*c* is a plane. The bottom face 45*c* is extended in a perpendicular direction to the shaft axis Z1. In other words, the bottom face 45*c* is extended in the radial direction.

The bottom face 45*c* may be an engaging surface which can be engaged with the receiving surface of the head. For example, the bottom face 45*c* may be set to have the same configuration as the lower surface 42, and the receiving surface may be engaged with the bottom face 45*c*. More specifically, the engaging surface of the inner member may have a bottom face which can be engaged with the receiving surface and an engaging side surface which can be engaged with the receiving surface. In this case, a configuration of the receiving surface can be engaged with both the bottom face and the engaging side surface. Examples of a configuration of the bottom face which can be engaged with the receiving surface include the configuration of the lower surface described above.

The cylindrical surface 43*c* constitutes a part of the external surface of the inner member 8*c*. The cylindrical surface 43*c* is extended from the upper end face 46*c* of the inner member 8*c* to the upward surface 44*c*. A radius R2*c* of the cylindrical surface 43*c* (see FIG. 22) is constant. The central axis Z2 of the inner member 8*c* is shown in a one-dotted chain line in FIG. 22.

The engaging side surface 42*c* is positioned on a lower side of the cylindrical surface 43*c*. The engaging side surface 42*c* and the cylindrical surface 43*c* are adjacent to each other. A step surface 50*c* is provided on a boundary between the engaging side surface 42*c* and the cylindrical surface 43*c*. An upper end of the engaging side surface 42*c* is extended outward in the radial direction from the cylindrical surface 43*c* so that the step surface 50*c* is formed. The step surface 50*c* serves as the upward surface 44*c*. The upward surface 44*c* is extended outward in the radial direction from the cylindrical surface 43*c* so that a maximum radius Rmc of the engaging side surface 42*c* is increased and a rotation moment (a moment for inhibiting a rotation) received from a receiving surface 60*c* (which will be described below) by the engaging side surface 42*c* is increased. Consequently, it is possible to enhance a relative rotation controlling effect. The relative rotation controlling effect implies an effect for controlling a rotation of the inner member 8*c* with respect to the hosel hole 28*c*. Furthermore, the upward surface 44*c* is extended outward in the radial direction from the cylindrical surface 43*c* so that the upward surface 44*c* is maintained.

In the present application, a section taken along the radial direction is also referred to as a section in the radial direction. The section in the radial direction of the engaging side surface 42*c* takes a non-circular shape. As is understood from FIGS. 23 and 24, the section in the radial direction of the engaging side surface 42*c* takes a polygonal shape. The polygon is a regular polygon. The polygon is a regular pentagon.

In every position in the axial direction, the section in the radial direction of the engaging side surface 42*c* takes an identical shape. A size of the section in the radial direction of the engaging side surface 42*c* is reduced in a downward direction. In the engaging side surface 42*c*, the sections in the respective positions in the axial direction take analogous shapes to each other. A center of the section in every position in the axial direction is present on the central axis Z2.

The engaging side surface 42*c* wholly takes a tapered shape. The engaging side surface 42*c* has an inclined surface which is inclined to approach the shaft axis Z1 in a downward direction. The whole engaging side surface 42*c* is constituted by the inclined surface which is inclined to approach the shaft axis Z1 in the downward direction. The engaging side surface 42*c* is constituted by a plurality of inclined surfaces. The engaging side surface 42*c* is constituted by five inclined surfaces. The inclined surfaces which are adjacent to each other are divided through an edge line r. The respective inclined surfaces are planes. The respective inclined surfaces are identical to each other. FIG. 21 is a sectional view taken along a VI-VI line in FIG. 23.

The upward surface 44*c* is disposed in a middle position in a longitudinal direction of the inner member 8*c*. A contour shape of the upward surface 44*c* is analogous to the shape of the section in the radial direction of the engaging side surface 42*c*. The contour shape of the upward surface 44*c* is larger than the section in the radial direction of the engaging side surface 42*c* in every position in the axial direction. As shown in FIG. 23, the contour shape of the upward surface 44*c* is not annular. The contour shape of the upward surface 44*c* is non-circular. The contour shape of the upward surface 44*c* is a polygon. The polygon is a regular polygon. The polygon is a regular pentagon. The upward surface 44*c* is extended in the radial direction. The upward surface 44*c* may be inclined to the radial direction. The position of the upward surface 44*c* is not restricted. The shape of the upward surface 44*c* is not restricted. The upward surface can receive a downward force.

As shown in FIG. 23, a diameter of the cylindrical surface 43*c* is equal to that of an inscribed circle which is inscribed on a contour line of the upward surface 44*c*. A lower end of the cylindrical surface 43*c* is inscribed on the contour line of the upward surface 44*c*. By the structure, the outside diameter of the screw portion 32*c* and a hole diameter of the hosel hole 28*c* are controlled so that the weight of the inner member 8*c* is controlled. Accordingly, it is possible to prevent the position of the center of gravity of the head 4*c* from being excessively close to a heel.

The inner member 8*c* is fixed to the shaft 6*c*. The inner member 8*c* is bonded to the shaft 6*c*. The inner member 8*c* is bonded to the shaft 6*c* with an adhesive. The shaft inserting hole 40*c* is bonded to an external surface 48*c* of the shaft 6*c*. In the sectional views of the present application, an adhesive layer is not shown. The inner member 8*c* and the shaft 6*c* may be fixed by a method other than the bond. Examples of the fixing method include fitting. In respect of a productivity and a fixing strength, the bonding through the adhesive is preferable.

As shown in FIG. 18, the washer 12*c* is provided between the upward surface 44*c* and the screw member 10*c*. The washer 12*c* is provided between the downward surface 35*c* of the screw member 10*c* and the upward surface 44*c*. The washer 12*c* can prevent the upward surface 44*c* and the downward surface 35*c* from being worn out. The washer 12*c* does not need to be provided.

As shown in FIGS. 18 and 25, the head 4*c* has a receiving surface 60*c*. The receiving surface 60*c* constitutes a lower portion of the hosel hole 28*c*. A bottom face 61*c* of the hosel hole 28*c* is formed below the receiving surface 60*c*. The bottom face 61*c* of the hosel hole 28*c* is extended in the radial direction. The bottom face 61*c* of the hosel hole 28*c* serves as a bottom face of the hosel hole 28*c*.

As shown in FIG. 25, the receiving surface 60*c* is constituted by a plurality of planes. The receiving surface 60*c* is constituted by five planes. The receiving surface 60*c* has an upper side 60*ac* and a lower side 60*bc*. The upper side 60*ac* is a regular polygon. The upper side 60*ac* is a regular pentagon. A shape of the upper side 60*ac* is analogous to that of a section in the radial direction of the receiving surface 60*c*. The lower side 60*bc* is a regular polygon. The lower side 60*bc* is a regular pentagon. A shape of the lower side 60*bc* is analogous to that of the section in the radial direction of the receiving surface 60*c*. The lower side 60*bc* also serves as a contour line of the bottom face 61*c* of the hosel hole 28*c*.

A step surface 62*c* is provided around the receiving surface 60*c*. The step surface 62*c* is extended in the radial direction. An edge on an inside in the radial direction of the step surface 62*c* serves as the upper side 60*ac* of the receiving surface 60*c*. An edge on an outside in the radial direction of the step surface 62*c* serves as an internal surface of the hosel hole 28*c*.

The shape of the section in the radial direction of the receiving surface 60*c* is non-circular. As is understood from FIG. 25, the shape of the section in the radial direction of the receiving surface 60*c* is a polygon. The polygon is a regular polygon. The polygon is a regular pentagon.

In every position in the axial direction, the shape of the section in the radial direction of the receiving surface 60*c* is identical. A size of the section in the radial direction of the receiving surface 60*c* is reduced in a downward direction. In the receiving surface 60*c*, the sections in the respective positions in the axial direction are analogous to each other. A center of the section in every position in the axial direction is present on the central axis Z2.

The receiving surface 60*c* has an inclined surface which is inclined to approach the shaft axis Z1 in the downward direction. The whole receiving surface 60*c* is constituted by the inclined surface which is inclined to approach the shaft axis Z1 in the downward direction. The receiving surface 60*c* is constituted by a plurality of inclined surfaces. The receiving surface 60*c* is constituted by five inclined surfaces. The inclined surfaces which are adjacent to each other are divided through a valley line t. The respective inclined surfaces are planes. The respective inclined surfaces are identical to each other. Thus, a shape of the receiving surface 60*c* corresponds to that of the engaging side surface 42*c*. The shape of the section in the radial direction of the receiving surface 60*c* corresponds to that of the section in the radial direction of the engaging side surface 42*c*.

The receiving surface 60*c* is provided in face contact with the engaging side surface 42*c*. At least one of the receiving surface 60*c* and the engaging side surface 42*c* is wholly provided in contact with the other side (the receiving surface 60*c* or the engaging side surface 42*c*). The edge line r of the engaging side surface 42*c* is provided in line contact with the valley line t of the receiving surface 60*c*.

The shape of the section in the radial direction of the engaging side surface 42*c* has a rotational symmetry. The engaging side surface 42*c* has the rotational symmetry. A rotational symmetric axis serves as the central axis Z2. The rotational symmetry implies that a shape obtained by a rotation of (360/N) degrees around the rotational symmetric axis is coincident with a shape obtained before the rotation. N is an integer of two or more. The engaging side surface 42*c* according to the present embodiment is five-fold rotational symmetric.

The shape of the section in the radial direction of the receiving surface 60*c* has the rotational symmetry. The receiving surface 60*c* has the rotational symmetry. The rotational symmetric axis serves as the central axis Z2. The receiving surface 60*c* according to the present embodiment is five-fold rotational symmetric. The N (a maximum value) of the engaging side surface 42*c* is equal to the N (a maximum value) of the receiving surface 60*c*.

By the rotational symmetry of the engaging side surface 42*c* and the receiving surface 60*c*, the degree of freedom for fitting of the engaging side surface 42*c* in the receiving surface 60*c* is enhanced so that the engaging side surface 42*c* can easily be engaged with the receiving surface 60*c*. Accordingly, the head 4*c* and the shaft 6*c* can easily be attached to and removed from each other.

In the present embodiment, the engaging side surface 42*c* wholly takes a tapered shape. Therefore, the engaging side surface 42*c* can easily be fitted in the receiving surface 60*c*. More specifically, the engaging side surface 42*c* and the receiving surface 60*c* are constituted by the inclined surfaces. Therefore, the engaging side surface 42*c* can easily be fitted in the receiving surface 60*c*. Therefore, the inner member 8*c* can easily be attached to and removed from the head 4*c*. In other words, the shaft 6*c* can easily be attached to and removed from the head 4*c*.

By the engagement of the engaging side surface 42*c* and the receiving surface 60*c*, the inner member 8*c* is controlled to be rotated with respect to the hosel hole 28*c*. The engaging side surface 42*c* and the receiving surface 60*c* are engaged to control the rotation of the inner member 8*c* (the rotation around the shaft axis Z1) in the hosel hole 28*c*. Another member may be provided between the engaging side surface 42*c* and the receiving surface 60*c*.

The downward surface 35*c* of the screw member 10*c* and the upward surface 44*c* of the inner member 8*c* are engaged with each other. In the embodiment, the engagement is indirectly carried out. More specifically, the engagement is performed through the washer 12*c*. The downward surface 35*c* and the upward surface 44*c* may be directly engaged with each other. In other words, the downward surface 35*c* may directly abut on the upward surface 44*c*. By the engagement, the inner member 8*c* is controlled to be moved upward with respect to the hosel hole 28*c*.

The engagement (abutment) of the engaging side surface 42*c* and the receiving surface 60*c* is maintained until the inner member 8*c* is moved upward with respect to the hosel hole 28*c*. By the engagement of the engaging side surface 42*c* and the receiving surface 60*c*, the inner member 8*c* cannot be rotated with respect to the hosel hole 28*c*. Through the receiving surface 60*c*, the inner member 8*c* is also controlled to be moved downward with respect to the hosel hole 28*c*.

Thus, the inner member 8*c* cannot be moved vertically with respect to the hosel hole 28*c* and cannot be rotated with respect to the hosel hole 28*c*. The inner member 8*c* is fixed to the hosel hole 28*c*. The inner member 8*c* and the hosel hole 28*c* are not bonded to each other. However, the inner member 8*c* is held in the hosel hole 28*c*, and at the same time, is fixed to the hosel hole 28*c*.

The shaft 6*c* having the inner member 8*c* can be attached to and removed from the head 4*c*. The shaft 6*c* can be attached by fixing the screw member 10*c* to the head 4*c*. The shaft 6*c* can be removed by releasing the screw member 10*c* from the head 4*c*. By loosening the screw mechanism, the fixation of the head 4*c* and the shaft 6*c* can easily be released.

A double arrow R1*c* in FIG. 23 indicates a radius of a circle which is circumscribed on the upward surface 44*c*. A double arrow R2*c* in FIG. 23 indicates a radius of the cylindrical surface 43*c*. It is preferable that the radii R1*c* and R2*c* should satisfy the following expression.

$$1.15 \leqq R1c/R2c \leqq 1.50$$

In order to increase a strength in the tip portion of the inner member 8*c*, a ratio (R1*c*/R2*c*) is preferably equal to or higher than 1.15, is more preferably equal to or higher than 1.18 and is further preferably equal to or higher than 1.20. In order to control a weight of the inner member 8*c*, the ratio (R1*c*/R2*c*) is preferably equal to or lower than 1.4 and is more preferably equal to or lower than 1.3.

A double arrow θ1 in FIG. 21 indicates an inclination angle of the engaging side surface 42*c* with respect to the shaft axis Z1. In order to easily carry out the engagement (fitting) of the engaging side surface 42*c* with the receiving surface 60*c* and the disengagement (the separation of the engaging side surface 42*c* from the receiving surface 60), the inclination angle θ1 is preferably equal to or greater than one degree, is more preferably equal to or greater than two degrees, and is further preferably equal to or greater than three degrees. In order to enhance the relative rotation controlling effect, the inclination angle θ1 is preferably equal to or smaller than ten degrees, is more preferably equal to or smaller than seven degrees, and is further preferably equal to or greater than five degrees.

Examples of a procedure for assembling the golf club 2*c* include the following procedure.

[Assembling Procedure] Steps (1c) to (5c) which will be Described Below (1c) The screw portion 32*c* of the screw member 10*c* is inserted into the washer 14*c* and the shaft 6*c* is inserted into the through hole 30*c* of the screw member 10*c*.

(2c) The cylindrical surface 43*c* of the inner member 8*c* is inserted into the washer 12*c*.

(3c) The shaft 6*c* is inserted into the shaft inserting hole 40*c* of the inner member 8*c* and the shaft 6*c* and the inner member 8*c* are bonded to each other with an adhesive or the like.

(4c) The inner member 8*c* is inserted into the hosel hole 28*c*.

(5c) The screw member 10*c* and the hosel portion 22*c* are screwed to each other.

After the assembly is carried out in accordance with the procedure, the shaft 6*c* can easily be attached and removed. More specifically, the shaft 6*c* can be attached to and removed from the head 4*c* through the screw mechanism. When the shaft 6*c* is to be sold as a component which has not been assembled, a member subjected to the steps (1c) to (3c) may be sold in the assembling procedure.

The washers 14*c* and 12*c* do not need to be provided. However, the washers 12*c* and 14*c* are important for reliably engaging the receiving surface 60*c* with the engaging side surface 42*c*. In order to achieve an abutment (1c) of the receiving surface 60*c* and the engaging side surface 42*c*, an abutment (2c) of the end face 29*c* and the downward surface 34*c* and an abutment (3c) of the downward surface 35*c* and the upward surface 44*c* at the same time, high dimensional accuracy is required. By setting the washer 14*c* or 12*c* to be formed by an elastically deformable material, it is possible to reduce the dimensional accuracy. From this viewpoint, it is preferable that a material of a member K1*c* (the washer 14*c*) interposed between the downward surface 34*c* and the end face 29*c* should be elastically deformable by an axial force of screw coupling. It is preferable that the abutment (engagement) of the receiving surface 60*c* and the engaging side surface 42*c* should be achieved within a range of the elastic deformation of the member K1*c* through the axial force of the screw coupling. Similarly, it is preferable that a material of a member K2*c* (the washer 12*c*) interposed between the downward surface 35*c* of the screw member 10*c* and the upward surface 44*c* should be elastically deformable by the axial force of the screw coupling. It is preferable that the abutment of the receiving surface 60*c* and the engaging side surface 42*c* should be achieved within a range of the elastic deformation of the member K2*c* through the axial force of the screw coupling. It is preferable that the engaging side surface 42*c* should press the receiving surface 60*c* by the axial force of the screw coupling. By the pressing, it is possible to enhance a relative rotation controlling effect. By the presence of the member K1*c* or K2*c*, it is possible to easily achieve the structure in which the engaging side surface 42*c* presses the receiving surface 60*c*.

In order to enhance a beauty without the interposed member recognized visually, it is preferable that the member K1*c* (the washer 14*c*) should not be provided but the member K2*c* (the washer 12*c*) should be provided. In this case, it is preferable that the abutment of the downward surface 34*c* and the end face 29*c* should be achieved and the abutment (engagement) of the receiving surface 60*c* and the engaging side surface 42*c* should be achieved within the range of the elastic deformation of the member K2*c* through the axial force of the screw coupling. It is preferable that a clearance should not be present between the end face 29*c* of the hosel portion 22*c* and the downward surface 34*c* and the engaging side surface 42*c* should press the receiving surface 60*c* by the axial force of the screw coupling. In the case in which the member K1*c* (the washer 14*c*) is not provided, it is preferable that the engaging side surface 42*c* should press the receiving surface 60*c* by the axial force of the screw coupling in a state in which the end face 29*c* of the hosel portion 22*c* abuts on the downward surface 34*c*. This structure can be achieved by the member k2*c*.

It is also possible to employ a structure in which a clearance is provided between the end face 29*c* of the hosel portion 22*c* and the downward surface 34*c* in a state in which the receiving surface 60*c* abuts on the engaging side surface 42*c*. In this case, the structure is preferable in that the abutment of the receiving surface 60*c* and the engaging side surface 42*c* can be reliably carried out and is not referable in that a clearance between the end face 29*c* and the downward surface 34*c* can be visually recognized. In respect of an appearance, it is preferable that the clearance should not be present between the end face 29*c* of the hosel portion 22*c* and the downward surface 34*c*. In respect of the appearance, it is also preferable that the member K1*c* should be present.

As shown in FIG. 18, a clearance S1*c* is provided between the bottom face 45*c* of the inner member 8*c* and the bottom face 61*c* of the hosel hole 28*c*. In a state in which the clearance S1*c* is provided between the bottom face 45*c* of the inner member 8*c* and the bottom face 61*c* of the hosel hole 28*c*, the engaging side surface 42*c* and the receiving surface 60*c* abut on each other (are engaged with each other). Thus, the head 4*c* is constituted in such a manner that the bottom face 61*c* of the hosel hole 28*c* does not disturb the engagement (abutment) of the engaging side surface 42*c* and the receiving surface 60*c*. The clearance S1*c* reliably carries out the abutment (engagement) of the engaging side surface 42*c* and the receiving surface 60*c*. The step surface 62*c* is constituted so as not to disturb the abutment (engagement) of the engaging side surface 42*c* and the receiving surface 60*c*. The engaging side surface 42*c* and the receiving surface 60*c* come in face contact with other, and at the same time, the downward surface 35*c* abuts on (is engaged with) the step surface 62*c* through the washer 12*c*. Differently from the present embodiment, in order to carry out the abutment (engagement) of the engaging side surface 42*c* and the receiving surface 60*c* more reliably, a clearance may be provided between the downward surface 35*c* and the step surface 62*c* in the state in which the engaging side surface 42*c* abuts on (is engaged with) the receiving surface 60*c*. More specifically, it is preferable that the downward surface 35*c* and the step surface 62*c* should not abut on each other (should not be engaged with each other) directly or indirectly in the state in which the engaging side surface 42*c* abuts on (is engaged with) the receiving surface 60*c*. In the state in which the engaging side surface 42*c* and the receiving surface 60*c* abut on each other (are engaged with each other), it is preferable that a space should be present on an upper side of the step surface 62*c*.

The screw coupling is constituted to carry out tightening by a force received from a ball in hitting. The head 4*c* is right-handed. In case of the right-handed head 4*c*, the head 4*c* tries to be rotated clockwise around the shaft axis Z1 as seen from above (the grip side) by the force received from the ball in the hitting. By the rotation, the screw portion 26*c* (the female screw) and the screw portion 32*c* (the male screw) are tightened. When the screw member 10*c* is rotated counterclockwise as seen from above (the grip side), the screw portion 26*c* and the screw portion 32*c* are tightened. To the contrary, when the screw member 10*c* is rotated clockwise as seen from above (the grip side), the tightening of the screw portions 26*c* and 32*c* is loosened. Thus, the screw portions 26*c* and 32*c* are left-hand screws.

In case of the right-handed golf club, thus, it is preferable that the screw portions 26*c* and 32*c* should be set to be the left-hand screws. By setting them to be the left-hand screws, the screw coupling can be prevented from being loosened due to an impact in the hitting. In order to prevent the screw coupling from being loosened due to the impact in the hitting, it is preferable that the screw portions 26*c* and 32*c* should be right-handed screws in case of the left-handed golf club.

Figure 26:
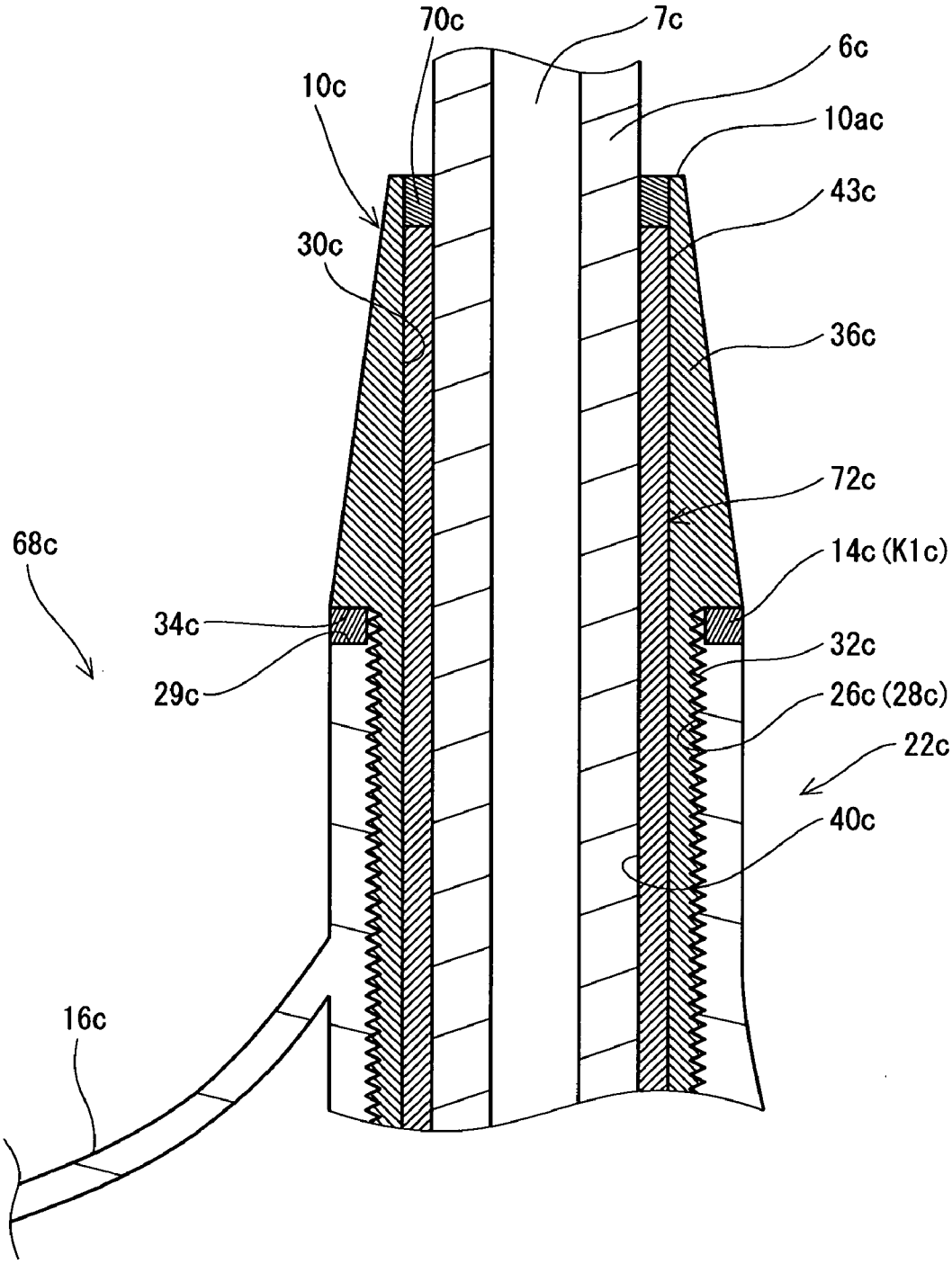
FIG. 26 is a sectional view showing a golf club according to a seventh embodiment, which is taken along a shaft axis.

FIG. 26 is a sectional view showing the vicinity of a hosel in a head 68*c* according to a seventh embodiment. A structure of the head 68*c* is the same as that of the head 4*c* except that a buffering member 70*c* is provided. The buffering member 70*c* is provided on an upper side of an inner member 72*c*. In order to maintain a space for providing the buffering member 70*c*, a length of the inner member 72*c* is set to be shorter than that of the inner member 8*c*. An inside diameter of the buffering member 70*c* is substantially equal to an outside diameter of the shaft 6*c* in the buffering member 70*c*. An outside diameter of the buffering member 70*c* is substantially equal to an inside diameter of a screw member 10*c* (a diameter of a through hole 30*c*). The buffering member 70*c* is disposed on an upper end of the screw member 10*c*.

In the hitting, an impact force acts on the head 68*c*. By the impact force, a stress might act between the head 68*c* and the shaft 6*c*. The stress tends to concentrate in an upper end face 10*ac* of the screw member 10*c*. The buffering member 70*c* can effectively relieve the concentration of the stress. In order to relieve the concentration of the stress, examples of a material of the buffering member 70*c* include a resin, a rubber and the like. Examples of the resin include a thermoplastic resin, a thermosetting resin and the like. Examples of the thermoplastic resin include a thermoplastic elastomer. Examples of the thermoplastic elastomer include a thermoplastic urethane elastomer having a hard segment and a soft segment. For the resin, cellulose acetate, cellulose nitrate, an ABS resin and polypropylene are preferable and the cellulose acetate is more preferable.

Figure 27:
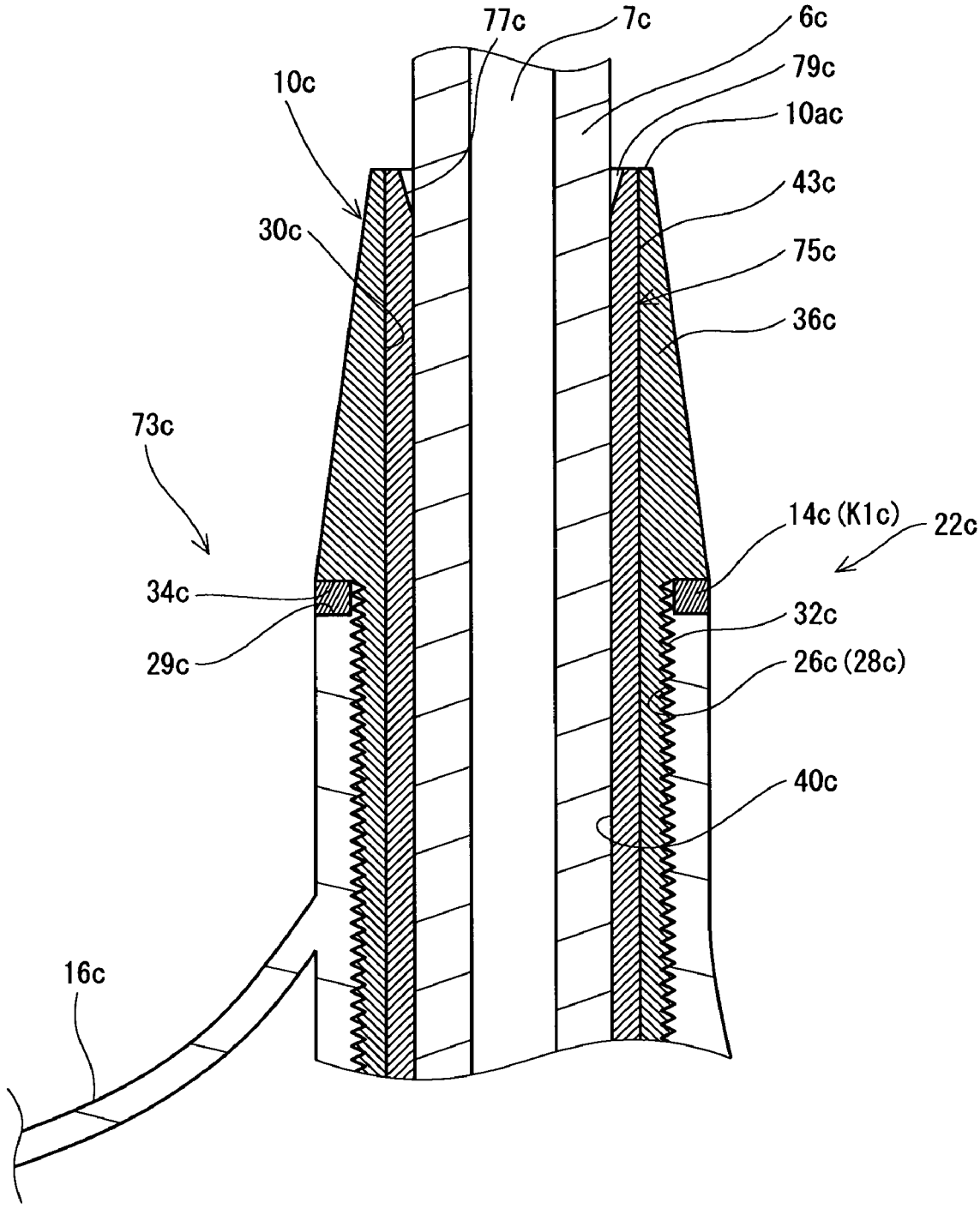
FIG. 27 is a sectional view showing a golf club according to an eighth embodiment, which is taken along a shaft axis.

FIG. 27 is a sectional view showing the vicinity of a hosel in a head 73*c* according to an eighth embodiment. A structure of the head 73*c* is the same as that of the head 4*c* except for a shape of an upper end portion of an inner member 75*c*. An inclined surface 77*c* is provided on an upper end portion of an internal surface of the inner member 75*c*. The inclined surface 77*c* is tapered. The inclined surface 77*c* is a conical recess surface. The inclined surface 77*c* is inclined apart from a shaft 6*c* in an upward direction. The inclined surface 77*c* is inclined to increase an inside diameter of the inner member 75*c* in the upward direction. By the inclined surface 77*c*, a space 79*c* is maintained between the inner member 75*c* and the shaft 6*c*. By the inclined surface 77*c*, it is possible to relieve a concentration of a stress on the shaft 6*c* which tends to be generated on the upper end face 10*ac* of the screw member 10*c*. In the eighth embodiment, it is possible to relieve the concentration of the stress without providing a buffering member.

Figure 28:
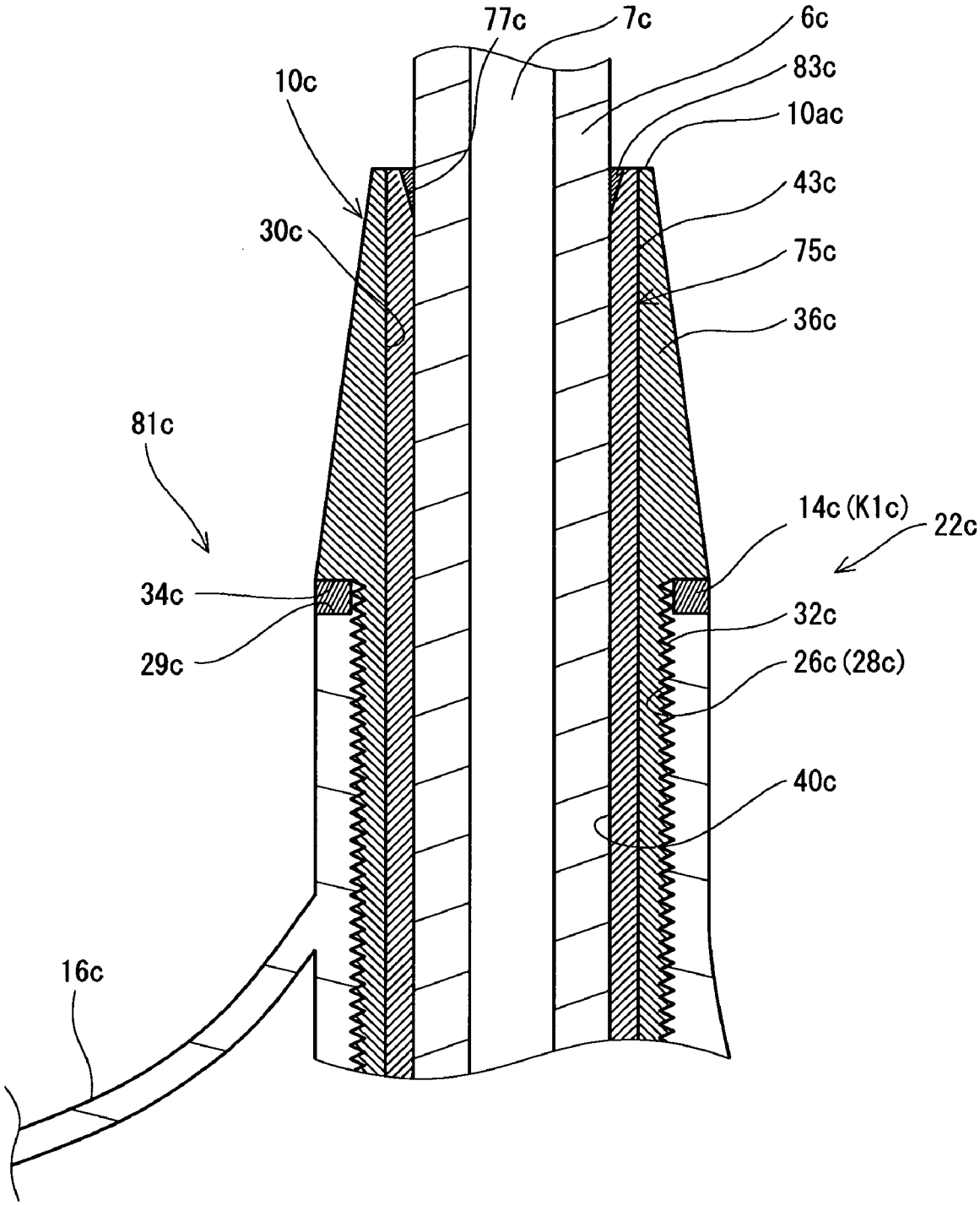
FIG. 28 is a sectional view showing a golf club according to a ninth embodiment, which is taken along a shaft axis.

FIG. 28 is a sectional view showing the vicinity of a hosel in a head 81*c* according to a ninth embodiment. A structure of the head 81*c* is the same as that of the head 73*c* except for presence of a buffering member 83*c*. In the head 81*c*, the space 79*c* is occupied by the buffering member 83*c*. An external surface of the buffering member 83*c* is inclined. The external surface of the buffering member 83*c* is a conical projection surface. The external surface of the buffering member 83*c* abuts on an inclined surface 77*c*. An inside diameter of the buffering member 83*c* is constant. An outside diameter of the buffering member 83*c* is increased in the upward direction. An upper end face of the buffering member 83*c* is substantially on the same plane with the upper end face 10*ac* of the screw member 10*c*. By the buffering member 83*c*, it is possible to still more relieve the concentration of the stress on the shaft 6*c* which tends to be generated on the upper end face 10*ac* of the screw member 10*c*.

Figure 29:
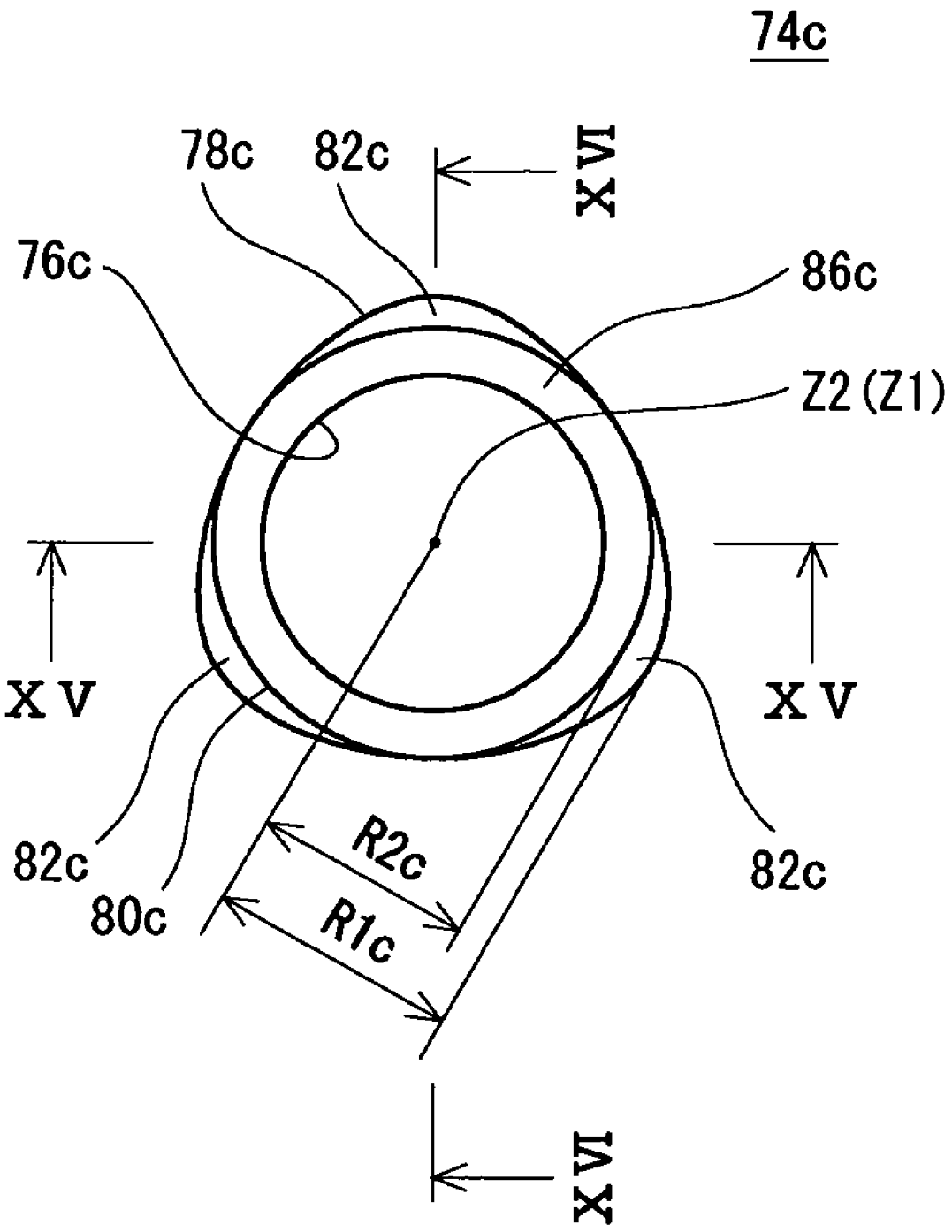
FIG. 29 is a plan view showing an inner member according to another embodiment as seen from above.
Figure 30:
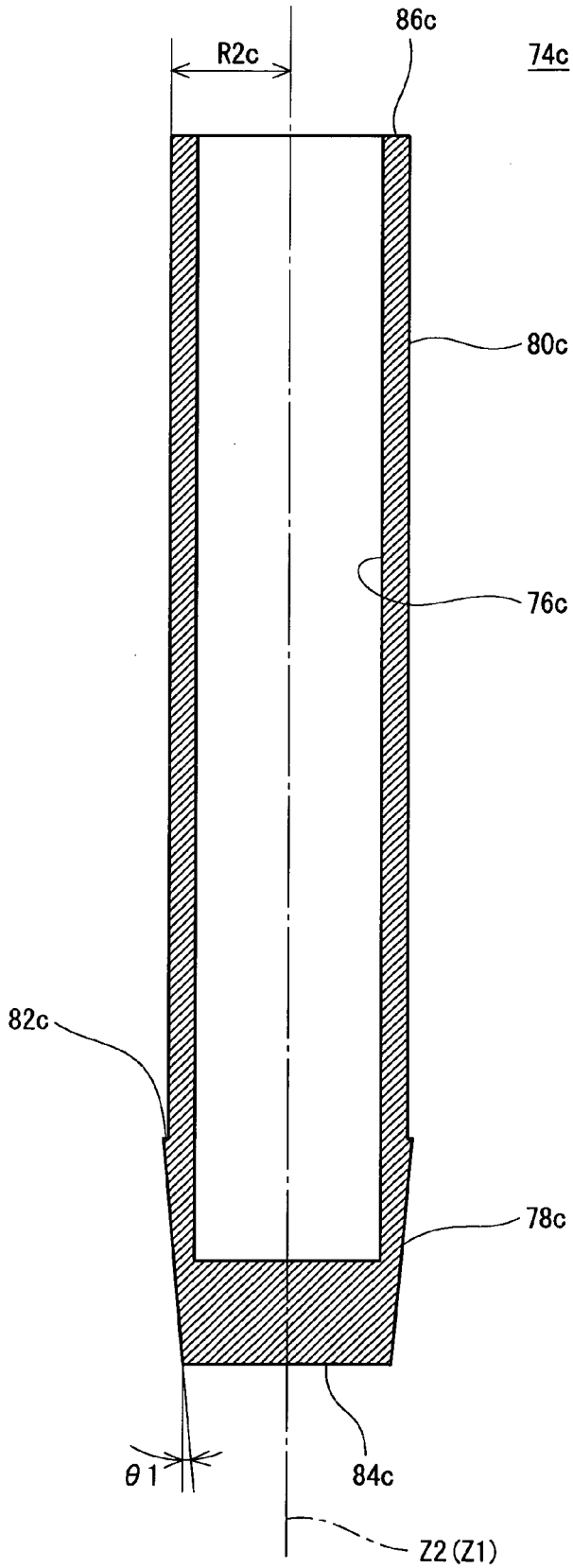
FIG. 30 is a sectional view taken along an XV-XV line in FIG. 29.
Figure 31:
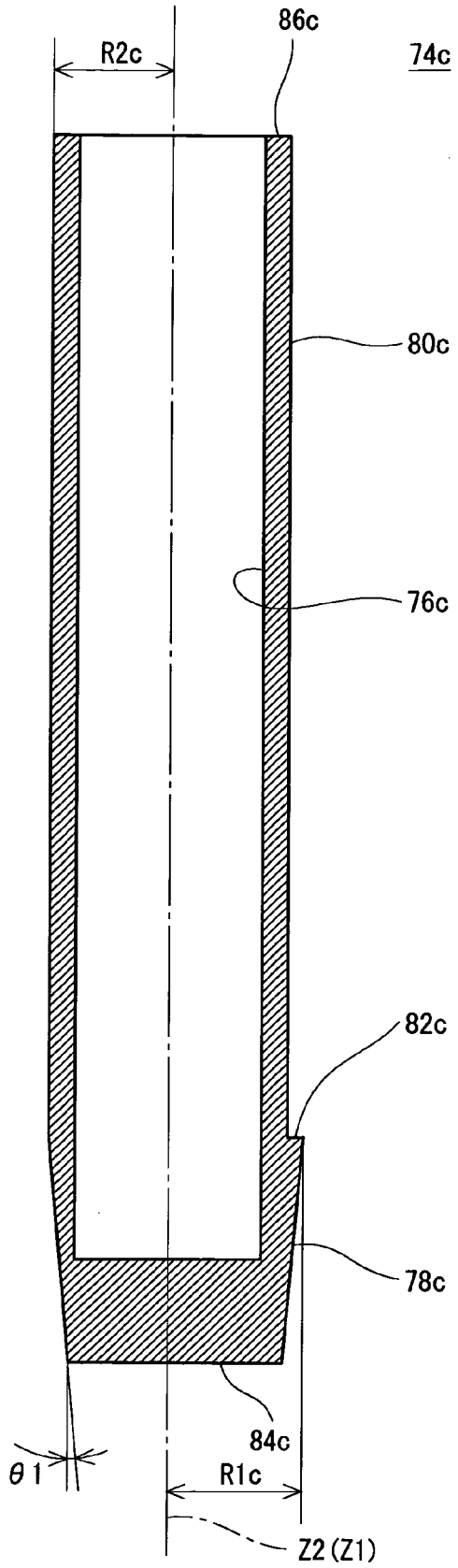
FIG. 31 is a sectional view taken along an XVI-XVI line in FIG. 29.

FIG. 29 is a plan view showing an inner member 74*c* according to another embodiment as seen from above. FIG. 30 is a sectional view taken along an XV-XV line in FIG. 29. FIG. 31 is a sectional view taken along an XVI-XVI line in FIG. 29.

The inner member 74*c* has a shaft inserting hole 76*c*, an engaging side surface 78*c*, a cylindrical surface 80*c*, an upward surface 82*c* and a bottom face 84*c*. The shaft inserting hole 76*c* is opened on an upper end side of the inner member 74*c*. The shaft inserting hole 76*c* is opened on an upper end face 86*c* of the inner member 74*c*. The bottom face 84*c* is a plane. The bottom face 84*c* is extended in a perpendicular direction to the shaft axis Z1. In other words, the bottom face 84*c* is extended in the radial direction.

The cylindrical surface 80*c* constitutes a part of the external surface of the inner member 74*c*. The cylindrical surface 80*c* is extended from the upper end face 86*c* of the inner member 74*c* to the upward surface 82*c*. A radius R2*c* of the cylindrical surface 80*c* is constant. The central axis Z2 of the inner member 74*c* is shown in a one-dotted chain line in FIGS. 30 and 31. The central axis Z2 is substantially coincident with the shaft axis Z1.

The engaging side surface 78*c* is positioned on a lower side of the cylindrical surface 80*c*. The engaging side surface 78*c* and the cylindrical surface 80*c* are adjacent to each other. A step surface is provided on a boundary between the engaging side surface 78*c* and the cylindrical surface 80*c*. An upper end of the engaging side surface 78*c* is extended outward in the radial direction from the cylindrical surface 80*c* so that the step surface is formed. The step surface serves as the upward surface 82*c*.

The section in the radial direction of the engaging side surface 78*c* takes a non-circular shape. As is understood from FIG. 29, the section in the radial direction of the engaging side surface 78*c* takes a shape in which sides and angles of a polygon are rounded. The respective sides are similarly rounded each other. The respective angles are similarly rounded each other. The polygon is a regular polygon. The polygon is a regular triangle.

In every position in the axial direction, the section in the radial direction of the engaging side surface 78*c* takes an identical shape. A size of the section in the radial direction of the engaging side surface 78*c* is reduced in a downward direction. In the engaging side surface 78*c*, the sections in the respective positions in the axial direction take analogous shapes to each other. A center of the section in every position in the axial direction is present on the central axis Z2.

The engaging side surface 78*c* wholly takes a tapered shape. The engaging side surface 78*c* is constituted by an inclined surface which is inclined to approach the shaft axis Z1 in the downward direction. The whole engaging side surface 78*c* is a curved surface which is smoothly provided continuously.

The upward surface 82*c* is disposed in a middle position in a longitudinal direction of the inner member 74*c*. A contour shape of the upward surface 82*c* is analogous to the shape of the section in the radial direction of the engaging side surface 78*c*. The contour shape of the upward surface 82*c* is larger than the section in the radial direction of the engaging side surface 78*c* in every position in the axial direction. As shown in FIG. 29, the shape of the upward surface 82*c* is not annular. The contour shape of the upward surface 82*c* is non-circular. The upward surface 82*c* takes a contour shape in which sides and angles of a polygon are rounded. The respective sides are similarly rounded each other. The respective angles are similarly rounded each other. The polygon is a regular polygon. The polygon is a regular triangle. The upward surface 82*c* is extended in the radial direction. The upward surface 82*c* may be inclined to the radial direction. The position of the upward surface 82*c* is not restricted. The shape of the upward surface 82*c* is not restricted.

As shown in FIG. 29, a diameter of the cylindrical surface 80*c* is equal to that of an inscribed circle which is inscribed on a contour line of the upward surface 82*c*. A lower end of the cylindrical surface 80*c* is inscribed on the contour line of the upward surface 82*c*.

The shape of the receiving surface which can be engaged with the engaging side surface 78*c* directly or indirectly corresponds to the engaging side surface 78*c*, which is not shown. In each position in the axial direction, the section in the radial direction of the receiving surface (the contour line of the section) is substantially identical to the section in the radial direction of the engaging side surface 78*c* (the contour line of the section). The receiving surface is provided in face contact with the engaging side surface 78*c*. By the engagement of the receiving surface and the engaging side surface 78*c*, the relative rotation controlling effect can be produced.

Figure 32:
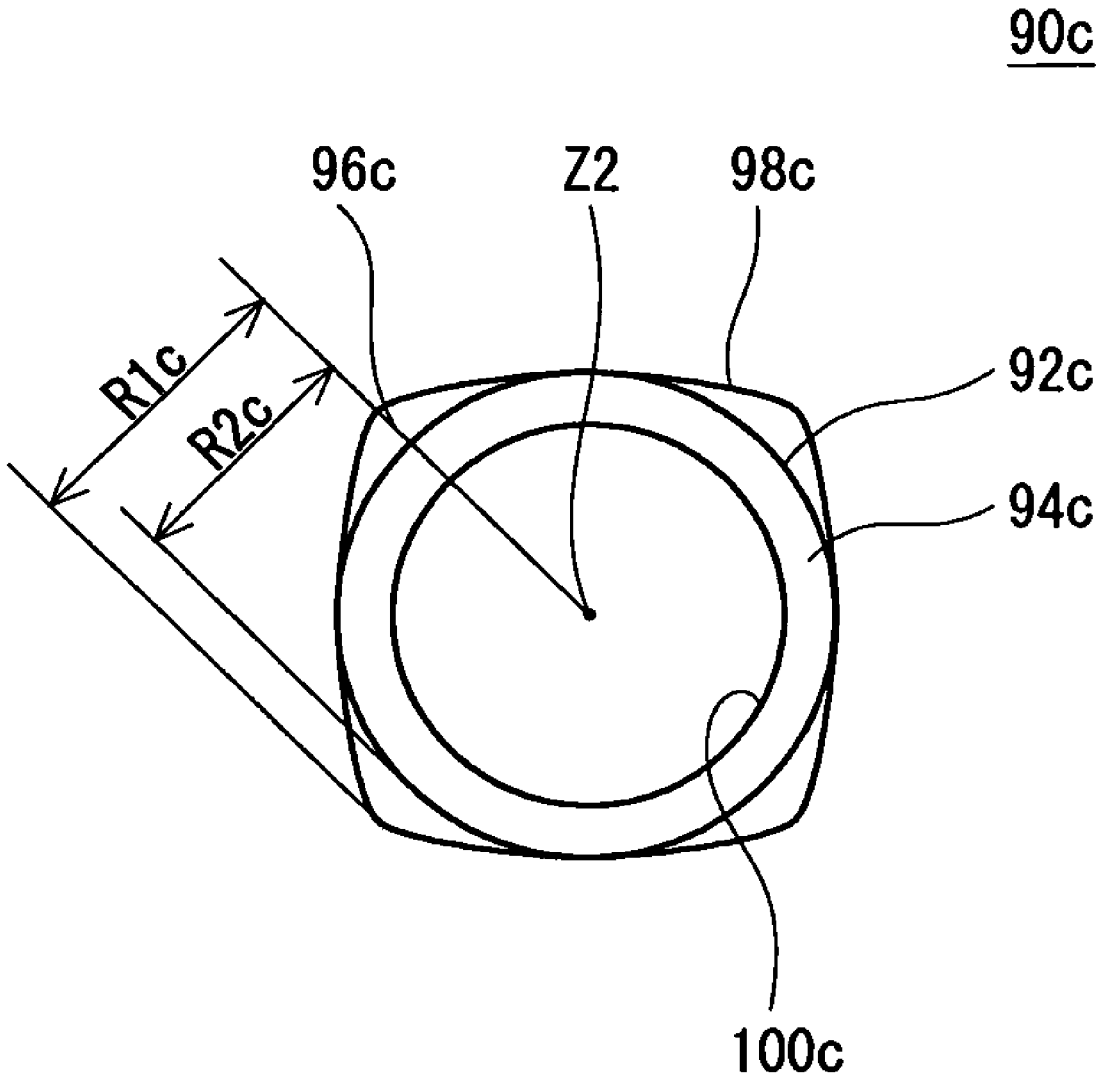
FIG. 32 is a plan view showing an inner member according to a further embodiment as seen from above.
Figure 33:
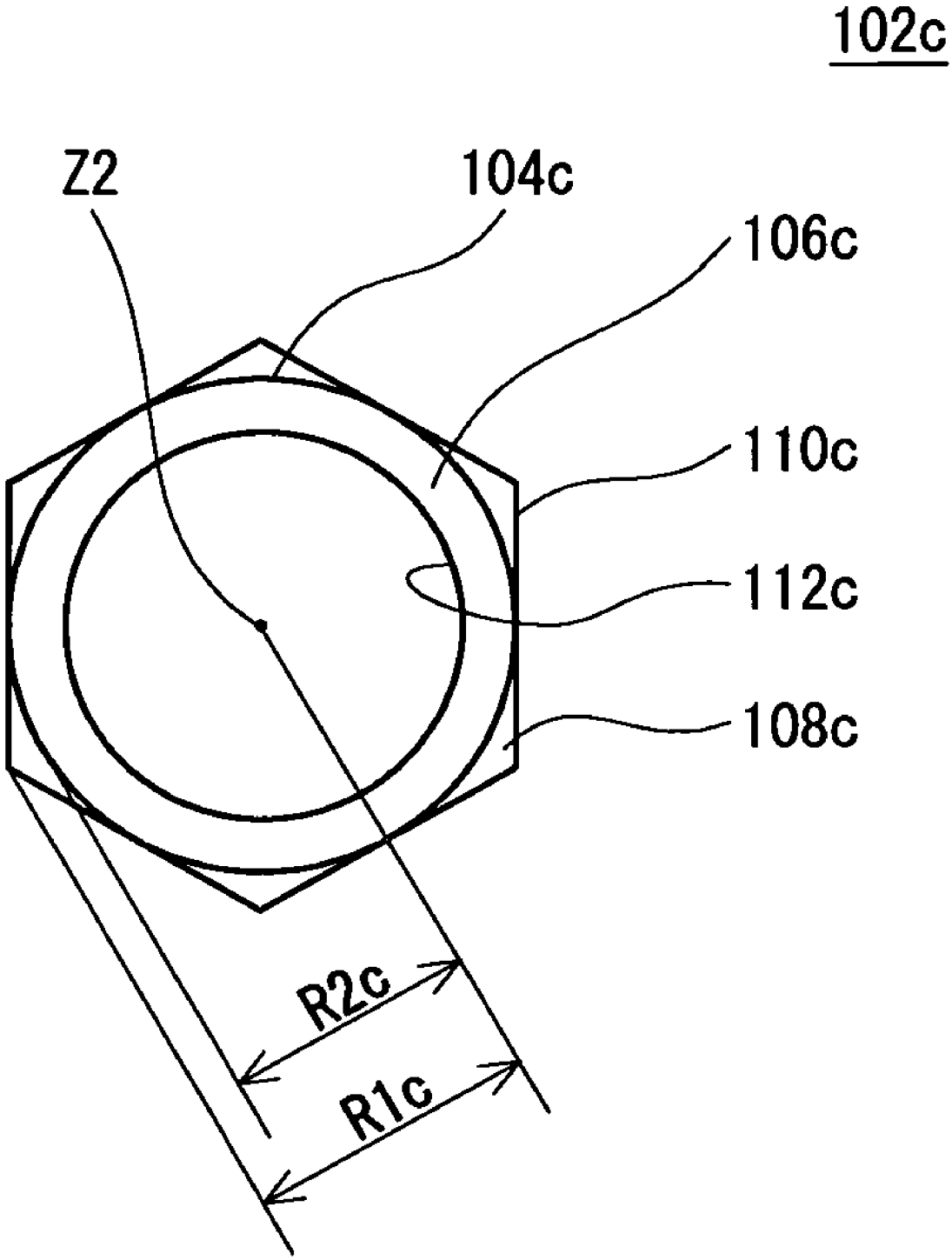
FIG. 33 is a plan view showing an inner member according to a further embodiment as seen from above.
Figure 34:
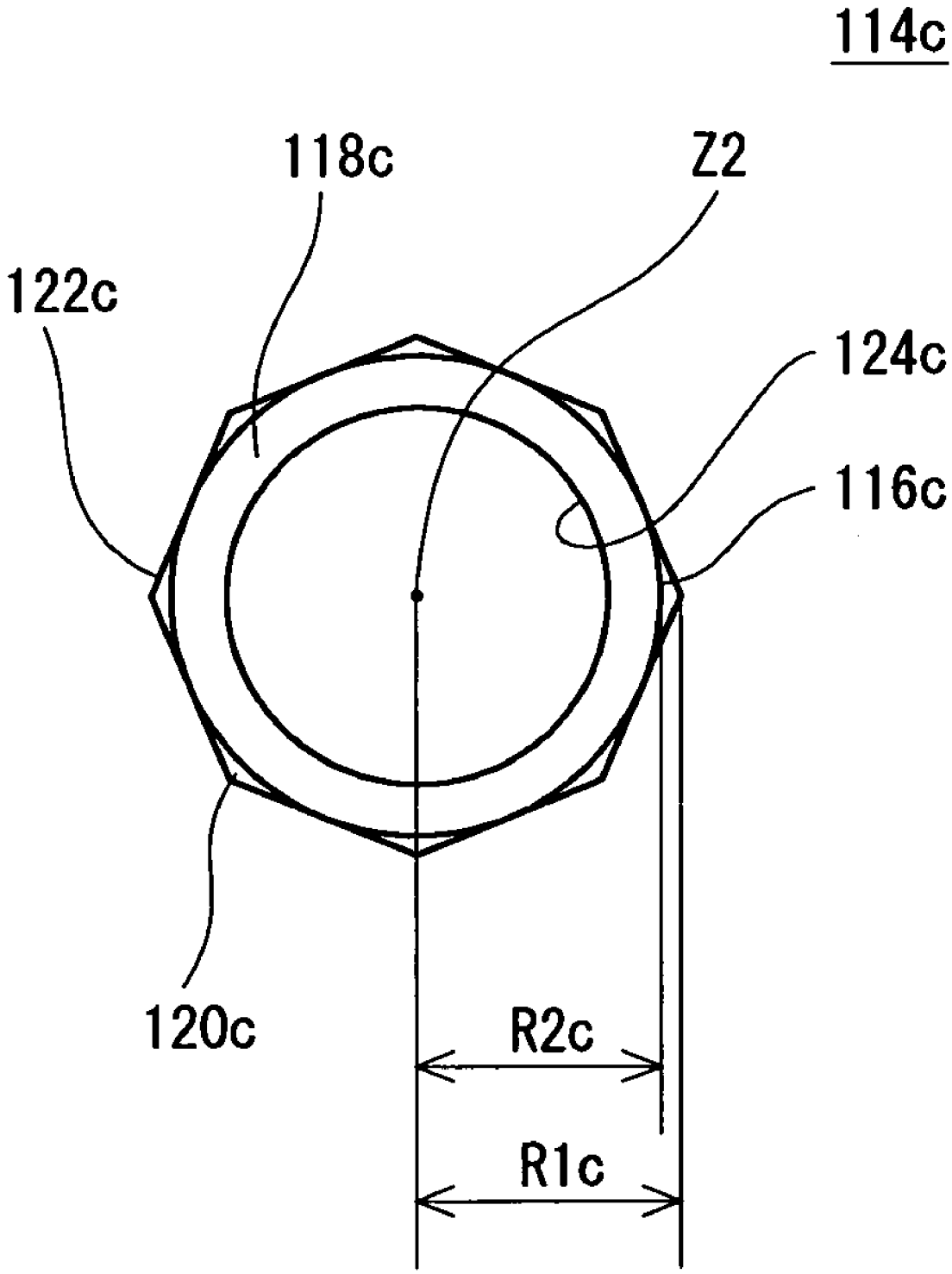
FIG. 34 is a plan view showing an inner member according to a further embodiment as seen from above.

As described above, the shape of the section in the radial direction of the engaging side surface is not restricted. Similarly, the shape of the section in the radial direction of the receiving surface is not restricted. FIGS. 32, 33 and 34 are plan views showing an inner member according to variants as seen from above. In the variants, the shape of the section in the radial direction of the engaging side surface is different from that of the inner member described above. The shape of the section in the radial direction of the receiving surface according to the variants corresponds to that of the section in the radial direction of the engaging side surface in the same manner as in the head 4*c*, which is not shown.

An inner member 90*c* according to the variant shown in FIG. 32 includes a cylindrical surface 92*c*, an upper end face 94*c*, an upward surface 96*c*, an engaging side surface 98*c* and a shaft inserting hole 100*c*. Except for a shape of a section in the radial direction of the engaging side surface 98*c* and a shape of the upward surface 96*c*, a structure of the inner member 90*c* is the same as that of the inner member 8*c*.

The section in the radial direction of the engaging side surface 98*c* takes a shape in which respective sides and angles of a square are rounded. All of the sides are similarly rounded. All of the sides have identical shapes to each other. All of the angles are similarly rounded. All of the angles have identical shapes to each other. The whole shape of the section in the radial direction of the engaging side surface 98*c* is a curved line which is smoothly formed continuously. The section in the radial direction of the engaging side surface 98*c* is reduced in a downward direction, which is not shown. The sections in the radial direction of the engaging side surface 98*c* in respective positions in the axial direction are analogous to each other. In every position in the axial direction, the shape of the section in the radial direction of the engaging side surface 98*c* has a rotational symmetry in which the central axis Z2 is set to be a rotational symmetric axis.

An inner member 102*c* according to the variant shown in FIG. 33 includes a cylindrical surface 104*c*, an upper end face 106*c*, an upward surface 108*c*, an engaging side surface 110*c* and a shaft inserting hole 112*c*. Except for a shape of a section in the radial direction of the engaging side surface 110*c* and a shape of the upward surface 108*c*, a structure of the inner member 102*c* is the same as that of the inner member 8*c*.

The section in the radial direction of the engaging side surface 110*c* takes a shape of a regular polygon. The regular polygon is a regular hexagon. The section in the radial direction of the engaging side surface 110*c* is reduced in a downward direction, which is not shown. The sections in the radial direction of the engaging side surface 110*c* in respective positions in the axial direction are analogous to each other. In every position in the axial direction, the shape of the section in the radial direction of the engaging side surface 110*c* has a rotational symmetry in which the central axis Z2 is set to be a rotational symmetric axis.

An inner member 114*c* according to the variant shown in FIG. 34 includes a cylindrical surface 116*c*, an upper end face 118*c*, an upward surface 120*c*, an engaging side surface 122*c* and a shaft inserting hole 124*c*. Except for a shape of a section in the radial direction of the engaging side surface 122*c* and a shape of the upward surface 120*c*, a structure of the inner member 114*c* is the same as that of the inner member 8*c*.

The section in the radial direction of the engaging side surface 122*c* takes a shape of a regular polygon. The regular polygon is a regular octagon. The section in the radial direction of the engaging side surface 122*c* is reduced in a downward direction, which is not shown. The sections in the radial direction of the engaging side surface 122*c* in respective positions in the axial direction are analogous to each other. In every position in the axial direction, the shape of the section in the radial direction of the engaging side surface 122*c* has a rotational symmetry in which the central axis Z2 is set to be a rotational symmetric axis.

In order to enhance the relative rotation controlling effect and to increase the degree of freedom for the fitting of the engaging side surface in the receiving surface, thereby attaching and removing the shaft easily, the maximum value of the N in the rotational symmetry is preferably equal to or greater than three, is more preferably equal to or greater than four and is further preferably equal to or greater than five. In the case in which the maximum value of the N is great, the sectional shape of the engaging side surface is close to a circular shape so that the relative rotation controlling effect tends to be deteriorated. From this viewpoint, the maximum value of the N is preferably equal to or smaller than 20, is more preferably equal to or smaller than 12, is further preferably equal to or smaller than eight, and is further preferably equal to or smaller than seven.

Figure 35:
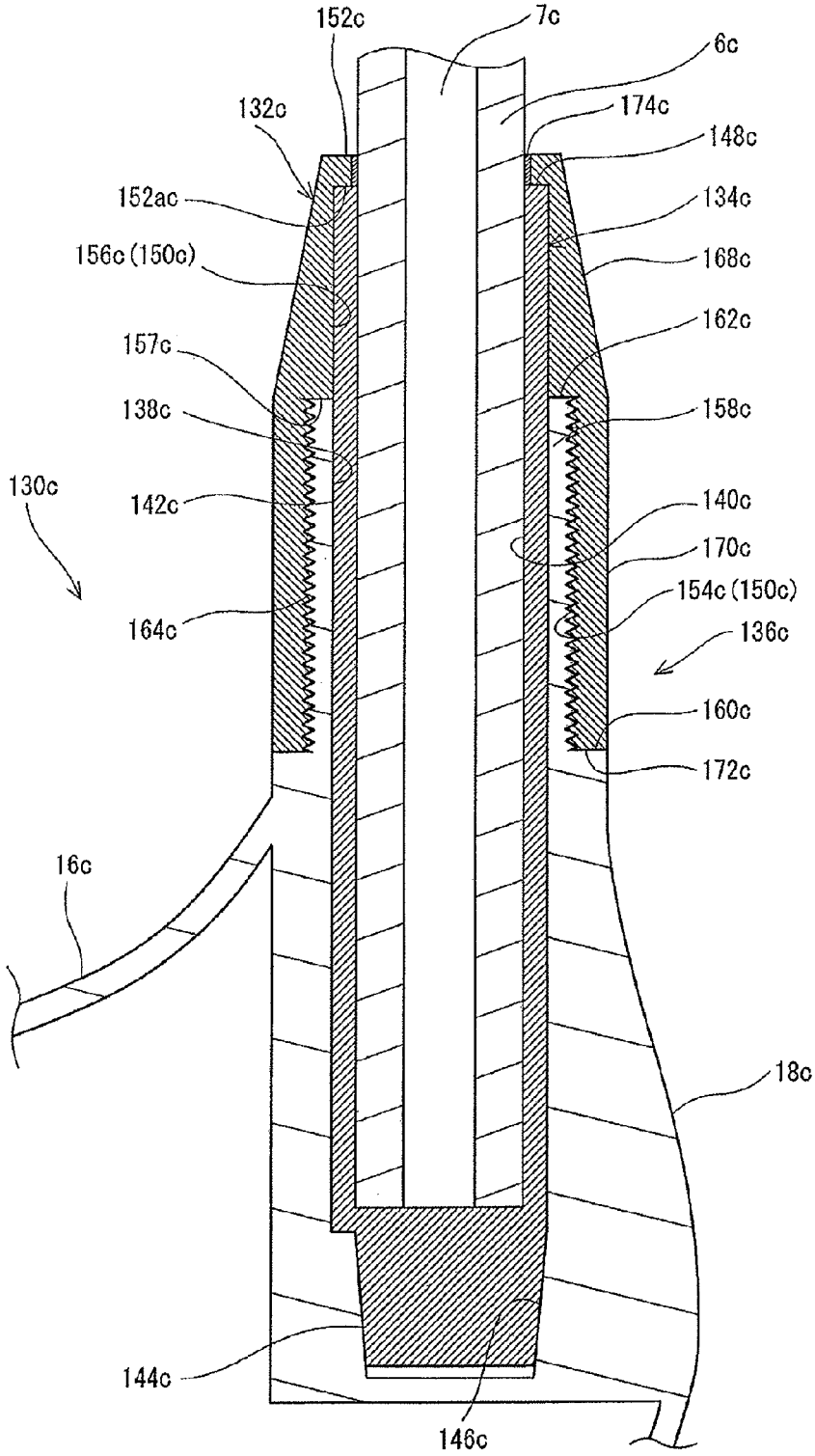
FIG. 35 is a sectional view showing a golf club according to a tenth embodiment, which is taken along a shaft axis.

In the embodiments, the screw portion of the hosel portion is a female screw and the screw portion of the screw member is a male screw. To the contrary, the screw portion of the hosel portion may be the male screw and the screw portion of the screw member may be the female screw. In this case, there is employed a structure in which the male screw is formed on the external surface of the hosel portion and the female screw is formed on the internal surface of the screw member, and the female screw of the screw member is fixed into the outside of the male screw of the hosel portion. FIG. 35 shows an embodiment illustrating an example of the structure.

FIG. 35 is a sectional view showing a head 130*c* according to a tenth embodiment of the present invention. In the head 130*c*, a screw portion of a hosel portion is a male screw and a screw portion of a screw member is a female screw. The head 130*c* has a screw member 132*c*, an inner member 134*c* and a hosel portion 136*c*. The hosel portion 136*c* has a hosel hole 138*c*. The inner member 134*c* has a shaft inserting hole 140*c*. A shaft 6*c* is inserted and bonded into the shaft inserting hole 140*c*.

The inner member 134*c* has a cylindrical portion 142*c* and an engaging side surface 144*c*. A shape of a section in a radial direction of the engaging side surface 144*c* is the same as that of the engaging side surface 42*c* of the inner member 8*c*. A shape of a section in the radial direction of a receiving surface 146*c* which abuts on the engaging side surface 144*c* is the same as that of the receiving surface 60*c*.

The inner member 8*c* has the upward surface 44*c* in the middle position in the longitudinal direction. On the other hand, the inner member 134*c* according to the present embodiment has no upward surface in a middle position in a longitudinal direction thereof. The engaging side surface 144*c* has no portion positioned on an outside in the radial direction from the cylindrical surface 142*c*. The inner member 134*c* has no upward step surface.

An upward surface 148*c* of the inner member 134*c* serves as an upper end face of the inner member 134*c*. The upward surface 148*c* is engaged with the screw member 132*c*.

The screw member 132*c* has a through hole 150*c* and an inward extended portion 152*c*. The through hole 150*c* has a screw portion 154*c*. The screw portion 154*c* is a female screw. The through hole 150*c* is constituted by a non-screw portion 156*c* and the screw portion 154*c*. An inside diameter of the screw portion 154*c* is larger than that of the non-screw portion 156*c*. A step surface 157*c* is formed on a boundary between the screw portion 154*c* and the non-screw portion 156*c*. The step surface 157*c* is a downward surface.

The hosel portion 136*c* has a cylindrical portion 158*c*, an upward surface 160*c* and an upper end face 162*c*. A through hole penetrating the cylindrical portion 158*c* constitutes a part of the hosel hole 138*c*. The upward surface 160*c* is positioned on a lower end of the cylindrical portion 158*c*. The upper end face 162*c* constitutes an upper end of the cylindrical portion 158*c*.

An external surface of the cylindrical portion 158*c* is set to be a screw portion 164*c*. The screw portion 164*c* is a male screw. The screw portion 164*c* to be the male screw and the screw portion 154*c* to be a female screw are coupled to each other.

A lower surface 152*ac* of the inward extended portion 152*c* is directly engaged with (abuts on) the upward surface 148*c* to be the upper end face of the inner member 134*c*. The lower surface 152*ac* is a downward surface of the screw member 132*c*. The engagement may be indirectly carried out through a washer or the like. In the screw member 132*c*, the inward extended portion 152*c* is provided inward in the radial direction from the non-screw portion 156*c* of the through hole 150*c*. The inward extended portion 152*c* takes an annular shape. The inward extended portion 152*c* may be a projection, for example. By the engagement of the inward extended portion 152*c* and the upward surface 148*c*, the inner member 134*c* is controlled to be moved upward with respect to the hosel hole 138*c*.

An external surface of the screw member 132*c* has a tapered surface 168*c* and a circumferential surface 170*c*. The tapered surface 168*c* is positioned on an upper side of the circumferential surface 170*c*. The tapered surface 168*c* and the circumferential surface 170*c* are continuously provided without a step. A lower end face 172*c* of the screw member 132*c* directly abuts on the upward surface 160*c*. The abutment may be indirectly carried out through a washer or the like. An outside diameter of the lower end face 172*c* is substantially equal to that of the upward surface 160*c*. The external surface of the screw member 132*c* and that of the hosel portion 136*c* are continuously provided substantially without a step at the lower end of the screw member 132*c*. Consequently, the beauty of the head is enhanced. An outside diameter of the tapered surface 168*c* is reduced in an upward direction. The tapered surface 168*c* takes the same shape as that of a so-called ferrule. The beauty of the head is enhanced by the tapered surface 168*c*. An interposing member such as a washer may be provided between the upper end face 162*c* and the downward surface 157*c*.

A buffering member 174*c* is provided between the inward protruded surface 152*c* and the shaft 6*c*. The buffering member 174*c* takes an annular shape. The buffering member 174*c* relieves a concentration of a stress on an upper surface of the inward protruded surface 152*c* so that a durability of the shaft 6*c* can be enhanced. A preferable material of the buffering member 174*c* is the same as that of the buffering member 70*c*.

The configurations of the engaging side surface of the inner member and the receiving surface are not restricted to those in the embodiments. It is sufficient that the rotation of the inner member with respect to the hosel hole is controlled through the engagement of the engaging side surface of the inner member with the receiving surface. As described above, it is preferable that the shapes of the sections in the radial direction of the engaging side surface and the receiving surface should have a rotational symmetry in which the central axis Z2 is set to be a rotational symmetric axis.

In order to enhance the relative rotation controlling effect while applying the rotational symmetry, it is preferable that the section in the radial direction of the engaging side surface should take the following shape A, B or C. In the same respect, it is preferable that the section in the radial direction of the receiving surface should also take the following shape A, B or C.

(Shape A) a regular polygon (Shape B) a shape in which all of angles (apexes) of the regular polygon are rounded (Shape C) a shape in which all of angles (apexes) and all of sides in the regular polygon are rounded In the embodiments shown in FIGS. 23, 33 and 34, the shape A is employed. In the embodiments shown in FIGS. 29 and 32, the shape C is employed.

The shapes B and C have the same rotational symmetry as that of the regular polygon to be a base (the rotational symmetry in which the central axis Z2 is set to be the rotational symmetric axis).

The regular polygon in each of the shapes A, B and C may be a convex polygon or a concave polygon, and the convex polygon is preferable in respect of forming easiness of the engaging side surface and the receiving surface.

The regular polygon will be hereinafter referred to as a regular n-polygon. n is an integer of three or more. For example, in the case in which n is three, the regular n-polygon is a regular triangle. In order to enhance the relative rotation controlling effect, n is preferably equal to or smaller than eight, is more preferably equal to or smaller than seven, and is further preferably equal to or smaller than six in the regular n-polygon in each of the shapes A, B and C. In order to relieve a concentration of a stress in the apex portion, thereby enhancing a durability, it is preferable that n should be equal to or greater than four in the regular n-polygon in each of the shapes A, B and C.

In order to enhance the relative rotation controlling effect, the shape A is preferable. On the other hand, the roundness of the apex portion in each of the shapes B and C is preferable in respect of an enhancement in the durability of the apex portion. In order to enhance the durability, a radius of curvature K of the roundness in the apex portion is preferably equal to or greater than 0.2 mm, is more preferably equal to or greater than 0.5 mm, and is further preferably equal to or greater than 1 mm. In order to enhance the relative rotation controlling effect, the radius of curvature K of the roundness in the apex portion is preferably equal to or smaller than a half of the radius R1*c*, is more preferably 0.3 time as great as the radius R1*c* or less, and is further preferably 0.2 time as great as the radius R1*c* or less. The radius of curvature K has a value in the section in the radial direction.

In the shape B, it is preferable that all of the angles should be rounded into the same shape. In the shape C, it is preferable that all of the angles should be rounded into the same shape and all of the sides should be rounded into the same shape. It is preferable that the shapes A, B and C should be line symmetrical with respect to a line Lp passing through a centroid and an apex and the line symmetry with respect to the line Lp should be established for all of the apexes. The apex implies the most distant point from the centroid. In case of the regular polygon, the apex is an angle (a corner). The centroid is positioned on the central axis Z2. The engaging side surface and the receiving surface which have a high symmetry can be formed easily.

For the configuration in which the inner member is engaged with the hosel portion, it is possible to propose a configuration in which the inner member is provided with a projection which is protruded outward in the radial direction and the hosel portion is provided with a notch extended downward from the end face thereof. By fitting the projection of the inner member in the notch of the hosel portion, it is possible to control the relative rotation of the inner member and the hosel portion. In this case, the notch of the hosel portion can be visually recognized from an outside. Therefore, a different appearance from that of a conventional golf club is obtained. In respect of a beauty, accordingly, this configuration is not preferable as compared with the present invention. In the present invention, the notch is not required in the hosel portion. Consequently, the beauty can be enhanced and a strength of the hosel portion can be increased.

A material of the head is not restricted. Examples of the material of the head include titanium, a titanium alloy, CFRP (carbon fiber reinforced plastic), stainless steel, maraging steel, a magnesium alloy, an aluminum alloy, iron and the like. It is also possible to employ a head obtained by combining a plurality of materials. It is also possible to employ a head obtained by bonding a head body fabricated through casting to a face portion fabricated through forging or pressing.

A structure of the head is not restricted. The head may be wholly formed integrally or may be obtained by bonding a plurality of members. A method of manufacturing the head is not restricted. Examples of the method of manufacturing the head include casting such as lost wax precision casting, forging and the like.

A material of the shaft is not restricted. Examples of the material of the shaft include CFRP (carbon fiber reinforced plastic) and a metal. It is possible to suitably use a so-called carbon shaft or steel shaft. Moreover, a structure of the shaft is not restricted.

A material of the inner member is not restricted. In order to suppress an increase in a weight of the club, it is preferable that the inner member should have a small weight. From this viewpoint, a specific gravity of the inner member is preferably equal to or smaller than 4.6 and is more preferably equal to or smaller than 4.5. In order to prevent a breakage from being caused by an impact of hitting, it is preferable that the inner member should have a high strength. From these viewpoints, a preferable material of the inner member includes aluminum, an aluminum alloy, titanium, a titanium alloy, magnesium, a magnesium alloy, CFRP (carbon fiber reinforced plastic), a resin and the like.

A material of the screw member is not restricted. In order to suppress an increase in the weight of the club, it is preferable that the screw member should have a small weight. From this viewpoint, a specific gravity of the screw member is preferably equal to or smaller than 4.6 and is more preferably equal to or smaller than 4.5. In order to prevent the breakage from being caused by the impact of the hitting, it is preferable that the screw member should have a high strength. From these viewpoints, a preferable material of the screw member includes aluminum, an aluminum alloy, titanium, a titanium alloy, magnesium, a magnesium alloy, CFRP (carbon fiber reinforced plastic), a resin and the like.

A material of the washer (the interposed member) is not restricted. In order to suppress an increase in the weight of the club, it is preferable that the washer should have a small weight. From this viewpoint, a specific gravity of the washer is preferably equal to or smaller than 4.6 and is more preferably equal to or smaller than 4.5. In order to prevent the breakage from being caused by the impact of the hitting, it is preferable that the washer should have a high strength. From these viewpoints, a preferable material of the washer includes aluminum, an aluminum alloy, titanium, a titanium alloy, magnesium, a magnesium alloy, CFRP (carbon fiber reinforced plastic), a rubber, a resin and the like. As described above, moreover, the washer is preferably formed by an elastic member and is more preferably formed by the rubber or the resin. A preferable material of the washer (the interposed member) is the same as that of the buffering member 70.

A double arrow Ac in FIG. 22 indicates a diameter of the shaft inserting hole. In order to easily insert the shaft, when the outside diameter of the shaft in the portion to be inserted into the shaft inserting hole is set to be D1*c* mm, the diameter Ac is preferably equal to or greater than (D1*c*+0.02) mm, is more preferably equal to or greater than (D1*c*+0.03) mm and is further preferably equal to or greater than (D1*c*+0.04) mm. In order to increase a bonding strength to the shaft, Ac is preferably equal to or smaller than (D1*c*+0.20) mm, is more preferably equal to or smaller than (D1*c*+0.15) mm, and is further preferably equal to or smaller than (D1*c*+0.10) mm. Usually, the outside diameter D1*c* of the shaft is equal to or greater than 8.5 mm and is equal to or smaller than 10.0 mm.

A double arrow Bc in FIG. 22 indicates an outside diameter (mm) of the cylindrical surface. In order to enhance a durability of the inner member, a thickness of the cylindrical surface [(Bc−Ac)/2] is preferably equal to or greater than 0.25 mm, is more preferably equal to or greater than 0.30 mm and is further preferably equal to or greater than 0.40 mm. In order to control a weight of the inner member and to prevent a center of gravity of the head from being excessively close to a heel, the thickness of the cylindrical surface [(Bc−Ac)/2] is preferably equal to or smaller than 1.50 mm, is more preferably equal to or smaller than 1.30 mm and is further preferably equal to or smaller than 1.10 mm.

A double arrow Cc in FIG. 22 indicates a width in the radial direction of the upward surface. In order to enhance the durability of the inner member, a maximum value of the width Cc is preferably equal to or greater than 0.5 mm, is more preferably equal to or greater than 0.7 mm and is further preferably equal to or greater than 0.9 mm. In order to control the weight of the inner member and to prevent the center of gravity of the head from being excessively close to the heel, the maximum value of the width Cc is preferably equal to or smaller than 2.0 mm, is more preferably equal to or smaller than 1.6 mm and is further preferably equal to or smaller than 1.2 mm. The width Cc is measured in the radial direction.

A double arrow Dc in FIG. 22 indicates a length in an axial direction of the cylindrical surface. The length Dc is measured along the central axis Z2 of the inner member. In order to increase a length in an axial direction of the screw portion of the screw member, thereby enhancing a fastening force of the screw coupling, the length Dc is preferably equal to or greater than 11 mm, is more preferably equal to or greater than 15 mm, and is further preferably equal to or greater than 20 mm. In some cases in which the length Dc is too great, the strength of the inner member is reduced, and furthermore, the size of the screw member is increased excessively so that the weight of the head tends to be increased excessively. From this viewpoint, the length Dc is preferably equal to or smaller than 35 mm, is more preferably equal to or smaller than 31 mm, and is further preferably equal to or smaller than 28 mm.

A double arrow Ec in FIG. 22 indicates a depth of the shaft inserting hole. The depth Ec is measured along the central axis Z2. In order to increase the bonding strength to the shaft, the depth Ec is preferably equal to or greater than 25 mm, is more preferably equal to or greater than 30 mm, and is further preferably equal to or greater than 35 mm. In order to prevent the weight from being increased excessively, the length Ec is preferably equal to or smaller than 45 mm, is more preferably equal to or smaller than 43.5 mm, and is further preferably equal to or smaller than 42 mm.

A double arrow Fc in FIG. 22 indicates a length in an axial direction of the engaging side surface of the inner member. The length Fc is measured along the central axis Z2. In order to enhance the relative rotation controlling effect, the length Fc is preferably equal to or greater than 5 mm, is more preferably equal to or greater than 7 mm and is further preferably equal to or greater than 9 mm. In order to prevent the length Dc from being reduced excessively, the length Fc is preferably equal to or smaller than 20 mm, is more preferably equal to or smaller than 16 mm, and is further preferably equal to or smaller than 12 mm. Referring to a length in the axial direction of a contact portion of the engaging side surface and the receiving surface, a preferable range and a preferable reason are the same as those for the length Dc.

In respect of the strength of the screw member, a minimum value of a thickness Gc (not shown) of the screw portion in the screw member is preferably equal to or greater than 0.5 mm, is more preferably equal to or greater than 0.8 mm, and is further preferably equal to or greater than 1 mm. In order to prevent the weight from being excessively increased, the minimum value of the thickness Gc is preferably equal to or smaller than 2 mm, is more preferably equal to or smaller than 1.7 mm, and is further preferably equal to or smaller than 1.4 mm. The thickness Gc is measured in the radial direction.

A double arrow Hc in FIG. 18 indicates a width in the radial direction of the downward surface of the screw member. In order to increase the strength of the screw member, the width Hc is preferably equal to or greater than 0.5 mm, is more preferably equal to or greater than 0.8 mm, and is further preferably equal to or greater than 1 mm. In order to prevent the weight from being excessively increased, the width Hc is preferably equal to or smaller than 2.5 mm, is more preferably equal to or smaller than 2 mm, and is further preferably equal to or smaller than 1.5 mm.

As described above, in the embodiments, the shaft and the head are fixed to each other through the engagement of the downward surface and the upward surface and the engagement of the receiving surface and the engaging side surface. As described above, in the golf club according to the present invention, it is possible to implement a golf club in which the head and the shaft can be freely attached to and removed from each other with the simple structure. The screw portion on the head side can be easily fabricated in case of a head having an ordinary hosel. More specifically, the present invention can be applied to a head having a general structure and has a universality.

EXAMPLES

Although the advantages of the present invention will be apparent from examples, the present invention should not be construed restrictively based on description of the examples.

Example 1

In the same manner as the golf club 2, a head, a shaft, an inner member, a screw member and a washer were fabricated. Their structures and shapes were set to be the same as those of the golf club 2. The head was integrally formed through lost wax precision casting. A material of the head was set to be Ti-6Al-4V. A weight of the head was 170 g. A material of the inner member was set to be an aluminum alloy. A weight of the inner member was 4.2 g. A material of the screw member was set to be an aluminum alloy. A weight of the screw member was 2.5 g. Both of materials of two washers were set to be resins. A type of the resin was set to be an urethane resin. A weight of a first washer corresponding to the washer 12 was set to be 0.2 g. A weight of a second washer corresponding to the washer 14 was set to be 0.4 g. They were assembled in accordance with the procedure described above so that the golf club shown FIG. 1 was obtained. Trade name "ESPRENE" manufactured by Tohritu Kasei Kohgyou Co., Ltd. was used as an adhesive for bonding the shaft to the inner member.

In the example 1, the diameter A was set to be 9.05 mm, the outside diameter B of the small diameter portion was set to be 10.0 mm, the outside diameter C of the large diameter portion was set to be 11.8 mm, the length D was set to be 25.5 mm, the depth E was set to be 41 mm, the length F was set to be 7.0 mm, the thickness G was set to be 0.75 mm, the thickness H was set to be 1.0 mm, and the hole diameter M was set to be 11.9 mm. The outside diameter D1 of the shaft was set to be 9.0 mm. When hitting was carried out with a golf club, the fixation of the head to the shaft was maintained.

Example 2

In the same manner as the golf club 2*c*, a head, a shaft, an inner member, a screw member and a washer were fabricated. Their structures and shapes were set to be the same as those of the golf club 2*c*. The head was integrally formed through lost wax precision casting. A material of the head was set to be Ti-6Al-4V. A weight of the head was 170 g. A material of the inner member was set to be an aluminum alloy. A weight of the inner member was 5.0 g. A material of the screw member was set to be an aluminum alloy. A weight of the screw member was 5.7 g. Both of materials of two washers were set to be resins. A type of the resin was set to be an urethane resin. A weight of a first washer corresponding to the washer 12*c* was set to be 0.2 g. A weight of a second washer corresponding to the washer 14*c* was set to be 0.4 g. They were assembled in accordance with the procedure described above so that the golf club shown FIG. 16 was obtained. Trade name "ESPRENE" manufactured by Tohritu Kasei Kohgyo Co., Ltd. was used as an adhesive for bonding the shaft to the inner member.

In the example 2, the diameter Ac was set to be 9.05 mm, the outside diameter Bc was set to be 11.2 mm, the maximum value of the width Cc was set to be 1.3 mm, the length Dc was set to be 35 mm, the depth Ec was set to be 41 mm, the length Fc was set to be 10 mm, the thickness Gc was set to be 1.35 mm, the width Hc was set to be 1.25 mm, and the inclination angle θ1 was set to be three degrees. The outside diameter D1*c* of the shaft was set to be 9.0 mm. When hitting was carried out with the golf club, the fixation of the head to the shaft was maintained.

The above description is only illustrative and various changes can be made without departing from the scope of the present invention.

The present invention can be applied to all of golf clubs, for example, a golf club of a wood type, a golf club of an iron type and a patter club.

What is claimed is:

1. A golf club comprising a shaft, a head, an inner member and a screw member, wherein the head has a hosel portion and a receiving surface, the hosel portion has a screw portion formed on an internal surface or external surface thereof and a hosel hole, the screw member has a through hole for causing the shaft and the inner member to penetrate therethrough, a screw portion and a downward surface, a screw portion of the screw member and a screw portion of the hosel portion are coupled to each other, the inner member has a shaft inserting hole opened on an upper end side thereof, an engaging surface which can be engaged with the receiving surface, and an upward surface, at least a part of the inner member is inserted into the hosel hole, the shaft and the shaft inserting hole are fixed to each other through bonding and/or fitting, the downward surface of the screw member and the upward surface of the inner member are engaged with each other directly or indirectly, and the inner member is controlled to be moved upward with respect to the hosel hole through the engagement, each of the engaging surface and the receiving surface have a plurality of inclined planar surfaces which are inclined to approach a shaft axis in a downward direction, the inclined planar surfaces of the receiving surface of the head and the inclined planar surfaces of the engaging surface of the inner member are engaged with each other directly or indirectly, and the inner member is controlled to be rotated with respect to the hosel hole through the engagement, and the inclined planar surfaces of the engaging surface of the inner member extend through the entire engaging surface to a bottom surface of the inner member, and fully surround an entire circumference of the inner member, wherein top ends of the inclined planar surfaces form a perimeter of the upward surface of the inner member.

2. The golf club according to claim 1, wherein the screw portion of the hosel portion is a female screw disposed on an internal surface thereof, and the screw portion of the screw member is a male screw disposed on an external surface thereof.

3. The golf club according to claim 1, wherein an inclination angle θ1 of the inclined planar surfaces with respect to the shaft axis is equal to or greater than one degree and is equal to or smaller than ten degrees.

4. The golf club according to claim 1, wherein an interposing member is provided between the downward surface of the screw member and the upward surface of the inner member.

5. The golf club according to claim 1, wherein the inner member has a cylindrical surface positioned on an upper side of the engaging surface, and a diameter of the cylindrical surface is equal to that of an inscribed circle which is inscribed on a contour line of the upward surface.

6. A golf club comprising a shaft, a head, an inner member and a screw member, wherein the head has a hosel portion and a receiving surface, the hosel portion has a screw portion formed on an internal surface or external surface thereof and a hosel hole, the screw member has a through hole for causing the shaft and the inner member to penetrate therethrough, a screw portion and a downward surface, a screw portion of the screw member and a screw portion of the hosel portion are coupled to each other, the inner member has a shaft inserting hole opened on an upper end side thereof, an engaging surface which can be engaged with the receiving surface, and an upward surface, at least a part of the inner member is inserted into the hosel hole, the shaft and the shaft inserting hole are fixed to each other through bonding and/or fitting, the downward surface of the screw member and the upward surface of the inner member are engaged with each other directly or indirectly, and the inner member is controlled to be moved upward with respect to the hosel hole through the engagement, each of the engaging surface and the receiving surface have a plurality of inclined planar surfaces which are inclined to approach a shaft axis in a downward direction, the inclined planar surfaces of the receiving surface of the head and the inclined planar surfaces of the engaging surface of the inner member are engaged with each other directly or indirectly, and the inner member is controlled to be rotated with respect to the hosel hole through the engagement, and the inclined planar surfaces of the engaging surface of the inner member extend through the entire engaging surface to a bottom surface of the inner member, and fully surround an entire circumference of the inner member, wherein the inner member has a cylindrical surface positioned on an upper side of the engaging surface, an upper end of the engaging surface is extended outward in a radial direction from the cylindrical surface so that a step surface is formed on a boundary between the cylindrical surface and the engaging surface, and the step surface serves as the upward surface, a shape of a section in a radial direction of the engaging surface is non-circular and has a rotational symmetry, and a shape of a section in the radial direction of the receiving surface is non-circular and has the rotational symmetry corresponding to the sectional shape of the engaging surface.

7. The golf club according to claim 6, wherein when a radius of a circle which is circumscribed on the upward surface is represented by R1*c* and a radius of the cylindrical surface is represented by R2*c*, the following expression is satisfied, $$1.15 \leqq R1c/R2c \leqq 1.50.$$

8. A golf club comprising a shaft, a head, an inner member and a screw member, wherein the head has a hosel portion and a receiving surface, the hosel portion has a screw portion formed on an internal surface or external surface thereof and a hosel hole, the screw member has a through hole for causing the shaft and the inner member to penetrate therethrough, a screw portion and a downward surface, a screw portion of the screw member and a screw portion of the hosel portion are coupled to each other, the inner member has a shaft inserting hole opened on an upper end side thereof, an engaging surface which can be engaged with the receiving surface, and an upward surface, at least a part of the inner member is inserted into the hosel hole, the shaft and the shaft inserting hole are fixed to each other through bonding and/or fitting, the downward surface of the screw member and the upward surface of the inner member are engaged with each other directly or indirectly, and the inner member is controlled to be moved upward with respect to the hosel hole through the engagement, each of the engaging surface and the receiving surface have a plurality of inclined planar surfaces which are inclined to approach a shaft axis in a downward direction, the inclined planar surfaces of the receiving surface of the head and the inclined planar surfaces of the engaging surface of the inner member are engaged with each other directly or indirectly, and the inner member is controlled to be rotated with respect to the hosel hole through the engagement, and the inclined planar surfaces of the engaging surface of the inner member extend through the entire engaging surface to a bottom surface of the inner member, and fully surround an entire circumference of the inner member, wherein top ends of the inclined planar surfaces are outermost in a radial direction of the inner member.

* * * * *